US010436550B2

(12) United States Patent
Lance et al.

(10) Patent No.: US 10,436,550 B2
(45) Date of Patent: Oct. 8, 2019

(54) HOLSTER

(71) Applicant: Vista Outdoor Operations LLC, Anoka, MN (US)

(72) Inventors: Troy E. Lance, Livingston, MT (US); Liam Yarbrough, Nampa, ID (US); Robert Kincaid, Manhattan, MT (US); Paul N. Smith, Bozeman, MT (US); Christopher J. Michael, Belgrade, MT (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 16/087,532

(22) PCT Filed: Mar. 22, 2017

(86) PCT No.: PCT/US2017/023631

§ 371 (c)(1),
(2) Date: Sep. 21, 2018

(87) PCT Pub. No.: WO2017/165547

PCT Pub. Date: Sep. 28, 2017

(65) Prior Publication Data

US 2019/0212096 A1 Jul. 11, 2019

Related U.S. Application Data

(63) Continuation of application No. 15/077,583, filed on Mar. 22, 2016, now Pat. No. 9,777,986.
(Continued)

(51) Int. Cl.

| | |
|---|---|
| ***F41C 33/00*** | (2006.01) |
| ***F41C 33/02*** | (2006.01) |
| ***F41G 11/00*** | (2006.01) |

(52) U.S. Cl.
CPC ..... *F41C 33/0245* (2013.01); *F41C 33/0263* (2013.01); *F41G 11/003* (2013.01)

(58) Field of Classification Search
CPC . F41C 33/0245; F41C 33/0263; F41G 11/003
(Continued)

(56) References Cited

U.S. PATENT DOCUMENTS

| | | | |
|---|---|---|---|
| 1,046,912 | A | 12/1912 | Wanee |
| 1,113,530 | A | 10/1914 | Audley |

(Continued)

FOREIGN PATENT DOCUMENTS

| | | | |
|---|---|---|---|
| EP | 1975542 | A2 | 10/2008 |
| EP | 2757271 | | 7/2014 |

(Continued)

OTHER PUBLICATIONS

European Patent Office, Search Opinion of Application No. 10828676. 6, dated Feb. 16, 2015 3 pages.

(Continued)

*Primary Examiner* — Peter N Helvey
(74) *Attorney, Agent, or Firm* — Christensen, Fonder, Dardi & Herbert PLLC

(57) ABSTRACT

A holster system that comprises a holster and an accessory configured to be fixed to a mounting rail of a handgun. The holster has a holster body with a pair of opposing wall portions defining a cavity. A retention mechanism of the system has a blocking portion movable between a blocking position and a non-blocking position. The blocking member at least inhibits removal of the handgun and accessory if the handgun and accessory are urged rearwardly before a thumb receiving portion is depressed. The blocking portion is on a spring member that is deflected by an elongate exteriorly extending sliding member that has a cam surface that selectively deflects the spring member from the blocking position.

20 Claims, 37 Drawing Sheets

Related U.S. Application Data

(60) Provisional application No. 62/355,115, filed on Jun. 27, 2016.

(58) Field of Classification Search
USPC ..... 224/243
See application file for complete search history.

(56) References Cited

U.S. PATENT DOCUMENTS 1,148,935 A 2/1915 Snavely
1,421,578 A 7/1922 Schussler
1,641,439 A 8/1925 Jovino
1,635,984 A 7/1927 Corriston
1,750,139 A 2/1928 Swift
1,851,352 A 3/1932 Denkert
1,951,865 A 3/1934 Franz
2,051,844 A 8/1936 Green
2,088,811 A 8/1937 Ray
2,109,734 A 3/1938 Preneta
2,349,376 A 5/1944 Ray
2,443,397 A 6/1948 Meyres
2,551,913 A 5/1951 Toby
2,577,869 A 12/1951 Adams
2,893,615 A 7/1959 Couper
3,289,903 A 12/1966 Taormina
3,419,728 A 12/1968 Wilson
3,420,420 A 1/1969 Clark
3,550,821 A 12/1970 Daigle
3,550,822 A 12/1970 Lloyd
3,669,325 A 6/1972 Furman
3,718,240 A * 2/1973 Rose ..... F41C 33/0209 224/243
3,777,952 A 12/1973 Theodore
3,804,306 A 4/1974 Azurin
3,828,990 A 8/1974 Baldocchi
3,866,811 A 2/1975 Hamby
3,904,091 A 9/1975 Jones
3,910,469 A 10/1975 Baldocchi
3,942,692 A * 3/1976 Chica ..... F41C 33/0227 224/243
3,955,724 A * 5/1976 Perkins ..... F41C 33/0227 224/243
RE30,139 E 11/1979 Jones
4,225,067 A * 9/1980 Bianchi ..... F41C 33/0209 224/231
4,277,007 A 7/1981 Bianchi et al.
4,463,884 A * 8/1984 Parlante ..... F41C 33/0227 224/193
4,846,384 A 7/1989 Perry
4,886,197 A * 12/1989 Bowles ..... F41C 33/0227 224/243
5,018,654 A 5/1991 Rogers et al.
5,048,735 A 9/1991 McCormick
5,082,318 A 1/1992 Held et al.
5,094,376 A 3/1992 Baruch
5,100,036 A 3/1992 Rogers et al.
5,127,566 A 7/1992 Beletsky
5,129,562 A 7/1992 Bianchi
5,199,620 A 4/1993 Beletsky
5,209,383 A * 5/1993 Theodore ..... F41C 33/0227 224/193
5,215,238 A 6/1993 Baruch
5,275,317 A 1/1994 Rogers et al.
5,282,559 A 2/1994 Wisser et al.
5,284,281 A 2/1994 Nichols
5,322,200 A 6/1994 Blanchard
5,358,160 A 10/1994 Bianchi
5,372,288 A 12/1994 Rogers et al.
5,395,021 A 3/1995 Brown
5,419,474 A 5/1995 Marx et al.
5,421,497 A 6/1995 Gilmore
5,449,103 A 9/1995 Tilley
5,458,266 A 10/1995 Pichot
5,467,909 A 11/1995 Resca et al.
5,570,830 A 1/1996 Nichols
5,501,380 A 3/1996 Wu
5,501,381 A * 3/1996 Rogers ..... F41C 33/0227 224/196
5,509,591 A 4/1996 Carver
5,513,785 A 5/1996 Campagna, Jr.
5,518,155 A 5/1996 Gallagher
5,551,611 A 9/1996 Gilmore
5,573,157 A 11/1996 Mauriello et al.
5,598,958 A 2/1997 Ryan, III et al.
5,611,164 A 3/1997 Rassias
5,622,295 A 4/1997 Hellweg et al.
5,749,507 A 5/1998 Wood
5,758,448 A 6/1998 Thummel
5,768,816 A 6/1998 Rassias
5,779,114 A 7/1998 Owens
5,806,739 A 9/1998 Wood
5,810,221 A 9/1998 Beletsky et al.
5,810,222 A 9/1998 Shoemaker
5,855,305 A 1/1999 Nichols
5,916,087 A 6/1999 Owens
5,918,784 A 7/1999 Serpa
5,927,578 A 7/1999 Kay
5,931,358 A 8/1999 Rogers
5,944,239 A * 8/1999 Rogers ..... F41C 33/0209 224/193
5,961,013 A 10/1999 Collins
6,085,951 A 7/2000 Beletsky et al.
6,112,962 A * 9/2000 Matthews ..... F41C 33/0236 224/191
6,149,042 A 11/2000 Rassias
6,189,751 B1 2/2001 Tserng
6,230,946 B1 5/2001 Vor Keller et al.
6,267,279 B1 * 7/2001 Matthews ..... F41C 33/0236 224/191
6,276,581 B1 8/2001 Glock
6,320,975 B1 11/2001 Vieweg
6,349,496 B1 2/2002 Neely
6,371,341 B1 * 4/2002 Clifton, Jr. ..... F41C 33/0227 224/242
6,389,726 B1 5/2002 Bentley
6,398,089 B1 6/2002 Har-Shen
6,415,541 B1 7/2002 Rassias
6,467,660 B1 10/2002 Rogers et al.
6,523,374 B1 2/2003 Owens
6,533,149 B2 3/2003 Vor Keller et al.
6,547,111 B2 4/2003 French
6,585,209 B1 7/2003 Mattingly
6,588,635 B2 7/2003 Vor Keller et al.
6,604,657 B2 8/2003 Yirmiyahu et al.
6,616,020 B1 9/2003 Spielberger
6,634,527 B2 10/2003 Lui
6,641,009 B2 11/2003 French et al.
6,732,891 B2 5/2004 Locklear, III
6,752,300 B2 6/2004 Har-Shen
6,755,331 B2 6/2004 Rassias
6,769,581 B2 8/2004 Rogers et al.
6,769,582 B1 8/2004 Beletsky et al.
6,799,392 B2 10/2004 Milec et al.
D501,991 S 2/2005 Cook et al.
6,854,626 B2 2/2005 Liao
6,886,725 B2 5/2005 Lowe et al.
6,918,519 B2 7/2005 Vor Keller et al.
6,948,644 B1 9/2005 Beletsky
D512,561 S 12/2005 Cook et al.
7,082,426 B2 7/2006 Musgrove et al.
7,117,625 B2 10/2006 Pikielny
7,140,523 B2 11/2006 Lowe et al.
7,200,965 B2 4/2007 Vor Keller et al.
7,258,259 B1 8/2007 Owens
7,434,712 B2 10/2008 Cook et al.
7,461,765 B2 12/2008 French et al.
7,530,456 B1 5/2009 Tsai
7,543,404 B2 6/2009 Kovalchuk et al.
7,556,181 B2 7/2009 Spielberger
7,562,797 B2 7/2009 Senn et al.
7,584,875 B2 9/2009 Lowe et al.
7,591,402 B2 9/2009 Rassias

(56) References Cited

U.S. PATENT DOCUMENTS

| | | | | |
|---|---|---|---|---|
| 7,644,845 | B2 * | 1/2010 | Lowe | F41C 33/0209 224/243 |
| 7,694,860 | B2 | 4/2010 | Clifton, Jr. | |
| 7,735,255 | B1 | 6/2010 | Kincaid et al. | |
| 7,762,018 | B1 | 7/2010 | Fitzpatrick et al. | |
| 7,819,294 | B2 | 10/2010 | Lowe et al. | |
| 7,841,497 | B1 * | 11/2010 | Gregory | F41C 33/045 224/243 |
| 7,850,053 | B2 | 12/2010 | Rassias | |
| 7,922,050 | B2 | 4/2011 | Benes | |
| 7,934,333 | B1 | 5/2011 | Tuz | |
| 7,937,880 | B1 | 5/2011 | Fidlow | |
| 7,950,553 | B2 | 5/2011 | Rassias | |
| 7,954,971 | B1 | 6/2011 | Kincaid et al. | |
| 8,052,018 | B2 | 11/2011 | Gallagher | |
| 8,096,453 | B2 | 1/2012 | Lowe et al. | |
| 8,132,355 | B1 | 3/2012 | Kincaid et al. | |
| 8,141,758 | B2 | 3/2012 | Spielberger | |
| 8,177,108 | B1 | 5/2012 | Kincaid et al. | |
| 8,215,525 | B2 | 7/2012 | Rassias | |
| 8,235,263 | B1 | 8/2012 | Yeates et al. | |
| 8,251,266 | B2 | 8/2012 | Gregory et al. | |
| 8,281,512 | B2 | 10/2012 | Lara | |
| 8,302,827 | B1 | 11/2012 | Cole | |
| 8,371,487 | B1 | 2/2013 | Plappert | |
| 8,474,670 | B1 | 7/2013 | Gregory et al. | |
| RE44,428 | E | 8/2013 | Spielberger | |
| 8,517,235 | B1 | 8/2013 | Kincaid et al. | |
| 8,544,706 | B2 | 10/2013 | Crye | |
| 8,602,275 | B1 | 12/2013 | Kiger et al. | |
| 8,602,276 | B2 | 12/2013 | Tyybakinoja | |
| 8,631,981 | B2 | 1/2014 | Zusman | |
| 8,646,665 | B2 | 2/2014 | Abushaev | |
| 8,690,032 | B2 | 4/2014 | Baumann et al. | |
| 8,714,423 | B1 | 5/2014 | Kincaid et al. | |
| 8,720,753 | B2 | 5/2014 | Benes | |
| 8,720,754 | B2 | 5/2014 | Kirsch | |
| 8,720,755 | B2 | 5/2014 | Gregory et al. | |
| 8,783,532 | B2 | 7/2014 | Gregory et al. | |
| 8,807,404 | B1 | 8/2014 | Howell et al. | |
| 8,851,344 | B2 | 10/2014 | Baumann | |
| 8,870,042 | B2 | 10/2014 | Clifton | |
| 8,910,839 | B2 | 12/2014 | Clifton | |
| 8,925,773 | B2 | 1/2015 | Clifton | |
| D723,796 | S | 3/2015 | Resca | |
| 8,985,412 | B2 | 3/2015 | Rorick et al. | |
| 9,016,533 | B2 | 4/2015 | Visalli et al. | |
| 9,022,262 | B2 | 5/2015 | Pellegrini | |
| 9,057,579 | B2 | 6/2015 | Rorick et al. | |
| 9,057,580 | B2 | 6/2015 | Rorick et al. | |
| 9,086,254 | B1 | 7/2015 | Plappert | |
| 9,109,855 | B1 | 8/2015 | Kincel | |
| 9,134,093 | B2 | 9/2015 | Yeates | |
| D740,021 | S | 10/2015 | Faifer | |
| 9,175,925 | B2 | 11/2015 | Pellegrini | |
| 9,228,802 | B2 | 1/2016 | Ribas | |
| 10,024,615 | B1 | 7/2018 | Oh et al. | |
| 2002/0153396 | A1 | 10/2002 | French et al. | |
| 2002/0178963 | A1 | 12/2002 | Halverson | |
| 2004/0050887 | A1 | 3/2004 | Spielberger | |
| 2004/0195282 | A1 | 10/2004 | Beletsky et al. | |
| 2005/0035163 | A1 * | 2/2005 | French | F41C 33/0227 224/243 |
| 2005/0205621 | A1 | 9/2005 | Shults | |
| 2005/0205624 | A1 | 9/2005 | French et al. | |
| 2005/0279789 | A1 | 12/2005 | Lowe | |
| 2006/0156525 | A1 | 7/2006 | Jenkins et al. | |
| 2006/0157520 | A1 | 7/2006 | Clifton, Jr. | |
| 2006/0175366 | A1 * | 8/2006 | Dekaise | F41C 33/0227 224/243 |
| 2006/0226185 | A1 | 10/2006 | Har-Shen | |
| 2007/0181619 | A1 * | 8/2007 | Seyfert | F41C 33/0227 224/196 |
| 2008/0110947 | A1 | 5/2008 | Pikielny | |
| 2008/0121670 | A1 | 5/2008 | Buress | |
| 2008/0179359 | A1 | 7/2008 | Aberle et al. | |
| 2008/0179360 | A1 | 7/2008 | Lowe et al. | |
| 2009/0001117 | A1 | 1/2009 | Rassias | |
| 2009/0321480 | A1 * | 12/2009 | Kincaid | F41C 33/0227 224/243 |
| 2010/0276464 | A1 | 11/2010 | Hirt et al. | |
| 2011/0011904 | A1 | 1/2011 | Schultz et al. | |
| 2011/0101063 | A1 * | 5/2011 | Zusman | F41C 33/0227 224/682 |
| 2011/0163138 | A1 | 7/2011 | Tybakinoja | |
| 2011/0174849 | A1 | 7/2011 | Clifton, Jr. | |
| 2011/0174850 | A1 | 7/2011 | Clifton, Jr. | |
| 2012/0097718 | A1 | 4/2012 | Baumann et al. | |
| 2013/0240582 | A1 | 9/2013 | Tyybakinoja et al. | |
| 2013/0299543 | A1 | 11/2013 | Rorick et al. | |
| 2014/0048572 | A1 | 2/2014 | Yeates | |
| 2014/0109345 | A1 | 4/2014 | Melville | |
| 2015/0184978 | A1 | 7/2015 | Hedeen | |
| 2015/0285587 | A1 | 10/2015 | Abushaev | |
| 2016/0069639 | A1 * | 3/2016 | Yeates | F41C 33/0272 224/243 |
| 2017/0003101 | A1 | 1/2017 | Madrid et al. | |

FOREIGN PATENT DOCUMENTS

| | | |
|---|---|---|
| FR | 2893404 A1 | 5/2007 |
| WO | WO2010/064268 | 6/2010 |
| WO | WO2013/071402 | 5/2013 |
| WO | WO2014/028876 | 2/2014 |
| ZA | 986778 | 2/1999 |

OTHER PUBLICATIONS

European Patent Office, Supplementary Search Report of Application No. 10828676.6, dated Feb. 16, 2015 2 pages.

Written Opinion of the International Searching Authority for International Application No. PCT/US2010/002935 dated Jan. 7, 2011, 4 pages.

PCT International Preliminary Report on Patentability for International Application No. PCT/US2010/002935 dated May 15, 2012 5 pages.

PCT International Search Report for International Application No. PCT/US2010/002935 dated Jan. 7, 2011, 2 pages.

* cited by examiner

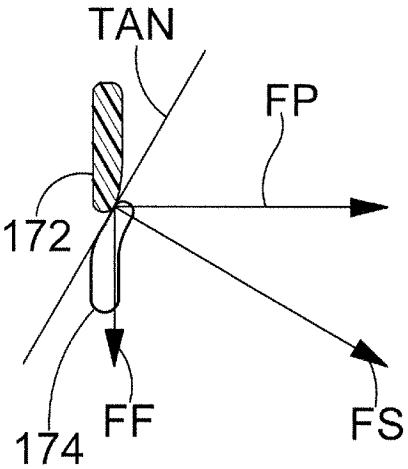
FIG. 7A
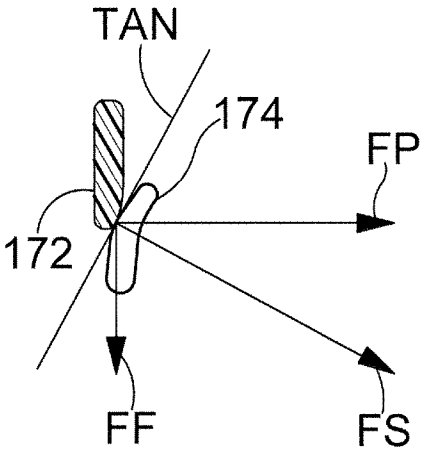
FIG. 7B
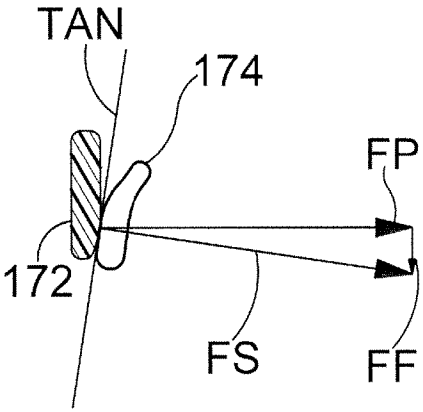
FIG. 7C
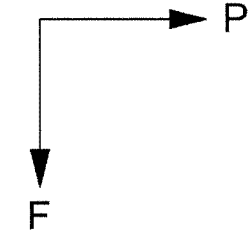

HOLSTER

The present application is a National Phase entry of PCT Application No. PCT/US2017/023631 filed Mar. 22, 2017, which is a continuation of U.S. application Ser. No. 15/077,583, filed Mar. 22, 2016, which claims the benefit of U.S. Provisional Application No. 62/355,115, filed Jun. 27, 2016, which are incorporated herein by reference.

BACKGROUND OF THE DISCLOSURE

Weapon-mounted firearm accessories have become an important tool for military, police, militia, and civilian firearm users. Examples of popular firearm accessories include targeting devices, such as LASER sighting devices, and target illuminators, such as flashlights. Many handgun designs incorporate mounting rails for supporting these accessories. Using an accessory rail interface, a given accessory may be mounted to a variety of firearms or firearms platforms. Likewise, if a particular firearm includes a rail interface, a variety of accessories may be interchangeably mounted to the firearm. The interchangeability of accessories is of particular importance to military and law enforcement personnel attached to special operations units, as this allows a single firearm to be reconfigured to meet certain mission specific needs.

One accessory that is becoming rather ubiquitous is a handgun-mounted light or flashlight. These handgun-mounted lights typically attached to a mounting rail located forward of the trigger guard and are centered along the bore axis of the handgun. A weapon-mounted flashlight is useful to light both the surrounding environment as well as possible assailants using only a single hand. This frees the other hand to call the police or fend off an attacker, or alternatively allows a user to keep both hands on the gun for a more secure grip.

Handgun-mounted lasers may similarly be attached to an accessory rail parallel to the bore axis of a handgun. A weapon-mounted laser sighting system has several advantages. First, a laser can aid in shooting accuracy and speed, particularly in high pressure situations. Further, lasers can aid in shooting at night or indoors in poorly lit environments. Lasers can also be used to safely practice trigger control. Finally, lasers may work as an intimidating deterrent for would-be assailants.

SUMMARY

In an embodiment of the invention, holster system comprises a holster and an accessory configured to be fixed to a mounting rail of a handgun. The accessory having a lower downwardly facing surface and a pair of upwardly facing shoulders with lands positioned adjacent grooves of the mounting rail. The holster having a holster body having a pair of opposing wall portions defining an interior or cavity. Each wall portion having an inwardly projecting rib dividing the interior of the holster body into an upper first cavity portion and a lower second cavity portion, the second cavity configured as a form fitting accessory pocket. In embodiments, the first cavity portion dimensioned to universally receive slides and the body of various handgun makes and models in a spaced relationship from two sides and the top of the firearm. The holster body configured such that the second cavity portion receives the accessory so that a conforming engagement is formed between the accessory and the holster body. When a handgun with the accessory mounted thereto is inserted into the holster body, the accessory is engaged by the pair of inwardly projecting ribs and an upwardly facing surface of a bottom of the holster body engages the lower downwardly facing surface of the accessory. A stop surface fixed with respect to, or part of the holster body engages a forward facing surface of the accessory upon insertion of the handgun with accessory into the holster body thereby providing a seating position of the handgun and accessory in the holster body whereby the accessory and thus the handgun is constrained forwardly, upwardly, downwardly, to the port side, and to the starboard side.

In embodiments, a retention mechanism may be supported by the wall of the holster body. The retention mechanism having a blocking portion movable between a blocking position and a non-blocking position so that the retention mechanism either prevents or allows the accessory attached to the handgun from being withdrawn from the interior of the holster body thus retaining the handgun in the holster. The blocking portion may be on a spring member biased to a blocking position and positioned to engage and block a rearward facing surface of the accessory. A sliding member configured as a flat thin bar or elongate thin plate on the port side of the holster has a thumb receiving portion and a cam surface configured as a ramp that engages cam follower surfaces on the spring member to move the spring member and blocking portion to the non-blocking position. A cam surface may alternatively engage a cam follower surface on the blocking portion. In embodiments, the blocking portion may also be urged to and/or locked in the blocking position when the handgun is pulled rearwardly, that is, in an outward or removal direction with respect to the holster. This may preclude the depression of the thumb receiving portion when the handgun is being pulled and at least inhibits the removal of the handgun from the holster when being so pulled rearwardly. Thus, a feature of embodiments is a handgun withdrawal inhibitor device that is effective to lock the release actuation mechanism in the blocking position upon a force urging the handgun rearwardly when the release actuation mechanism has not been manually actuated. In an embodiment, this feature is accomplished with a blocking member that is movable forwardly and rearwardly and that has a locking portion that engages a fixed surface to immobilize the blocking member when the firearm and/or accessory pushes the locking portion rearwardly before the locking portion has been moved out of the way of the firearm and/or accessory. The locking portion may be a ramped surface or a recess on the blocking portion. In embodiments the locking portion may be displaced from the blocking portion, for example disposed on the spring member to which the blocking portion is attached. In embodiments, the blocking member may engage conventional retention features on the holstered handgun such as the ejection port or trigger guard rather than an accessory. In embodiments, a depressing of the thumb release portion when the handgun is being pulled rearwardly will cause a bowing of the elongate spring member without causing movement of the blocking portion from the blocking position to the non-blocking position.

A feature and advantage of embodiments is the locking out of the release actuation mechanism where the handgun has been rearwardly displaced from a seating position before the release actuation mechanism is actuated.

A feature and advantage of embodiments is that thumb actuating release actuation mechanism is biased, such as by a spring, to a preactuation position and is automatically reset after withdrawal of the handgun. The handgun can be reholstered without manual reset of the retention mechanism or the release actuation mechanism.

In an embodiment, the accessory has a width less than or equal to the maximum width of the handgun. In an embodiment, the accessory has a height less than or equal to the height of the trigger guard of the handgun.

A feature and advantage of embodiments include providing a universal holster system that allows a single holster to be utilized with various makes and models of handgun. In these embodiments, a weapon mounted accessory, such as a camera and/or a light, is used as the sole or primary interface with the holster. The holster partially encloses the handgun while leaving a predetermined clearance around the handgun. In embodiments, the clearance around the handgun allows a single holster system to be utilized with various makes and models of handguns.

A feature and advantage of embodiments involves reducing or eliminating wear and tear on handgun surface finishes due to the fact that the holster cavity leaves clearance around the handgun.

A feature and advantage of embodiments is a thumb-actuated release actuation mechanism that selectively releases the retention mechanism when the user wishes to draw his or her weapon. The release actuation mechanism includes an elongate substantially flat plate sliding member and a blocking portion with cooperating sloped surfaces configured to cause deflection of the blocking portion when a thumb receiving portion on the sliding member is pressed downward.

A feature and advantage of embodiments is a thin, thumb-actuated release actuation mechanism that fits between the holster and a mounting plate defining one or more slots for receiving belts, straps, and the like.

A feature and advantage of embodiments is that the actuation receiving portion is in a position that is not readily accessible or visible to potential attackers.

A feature and advantage of embodiments is a thin, thumb-actuated release actuation mechanism configured such that pressing downward on a thumb receiving portion moves a blocking portion from a blocking position in which the blocking portion prevents the accessory from being withdrawn from the first cavity defined by the holster body to a non-blocking position in which the retention mechanism allows the accessory to be withdrawn from the first cavity.

A feature and advantage of embodiments is a holster with a capture mechanism with an elongate sliding planar bar extending from the thumb push button to the end of the bar with no motion transfer mechanisms or bends in the bar. Pressure from the thumb actuation is efficiently transferred to the cam surface to deflect the spring member and blocking portion. An integral cam surface positioned on the middle of the bar deflects the spring member for releasing the handgun.

In embodiments of the invention, the holster captures the accessory when the handgun with accessory in inserted into the holster to capture the accessory and handgun, the holster and accessory engagement constraining all freedom of motion of the accessory except freedom of motion in the insertion and withdrawal direction along a forward rearward axis of the handgun. The holster further providing a stop portion whereby the accessory seats in the slot and abuts the stop portion, the only freedom of motion of the accessory with respect to the holster is a linear withdrawal motion. A spring member configured as a leaf spring, is deflected by the accessory upon insertion of the handgun as it is seated; when the handgun is seated in the holster, a blocking portion of the spring member blocks the handgun from withdrawal there restricting any movement of the handgun with respect to the holster.

In embodiments of the invention, a slot defined by the holster structure captures the accessory when the handgun with accessory in inserted into the holster to capture the accessory and constrain all freedom of motion of the accessory and attached handgun. The slot defined by holster structure to engage a combination of corners and surfaces of the accessory to limit any freedom of motion of the accessory. The holster is form fit to the accessory to capture and constrains the holster accessory combination by exclusively or primarily capturing the accessory. The holster structure defining the slot may be part of side wall portions of the holster, with the side wall portions joined and unitary at the top and bottom of the holster thereby providing the sufficient strength and structural stability to the slot defined by the side wall portions to secure the holster accessory combination in the holster.

An advantage and feature of embodiments is an holster system having an accessory that is attachable to a multiplicity of different shaped handguns at the respective rails of the handguns, the accessory form fit to a holster, the holster not form fit to the multiplicity of different shaped handguns, and the holster being sized sufficient to have clearances with the multiplicity of different sized handguns whereby each of the handguns with the accessory attached receives and secures each handgun therein.

In embodiments of the invention, an accessory clamped to the handgun rail has a singular function of interfacing with the holster while maintaining a reduced profile. In particular, the "interface-only" accessory has the interface features of other accessories (e.g., camera, flashlight and/or laser that clamps to a rail but is of reduced size and/or weight. A holster that accommodates a specific flashlight design can accommodate the interface-only accessory attached to a handgun with an additional insert adaptor that seats into and is fixed within the accessory pocket of the holster body. The lower downwardly facing surface of the interface-only accessory slidingly engages the insert adaptor upon insertion and withdrawal of the handgun and seats on the insert adaptor when the firearm is fully holstered. In embodiments of the invention the holster body can be configured for the interface only accessory whereby the adaptor is not needed. In such a case the secondary pocket for the accessory will be reduced in size with pocket defined as extending from the bottom inside upwardly facing surface of the pocket to the inwardly projecting ribs that engage an upwardly facing surface of the clamp portion of the interface only accessory. The height of the pocket corresponding to the height of the accessory and in embodiments will be less than one half the height of the trigger guard. In embodiments, the height of the pocket will be less than 0.5 inches.

A feature and advantage of embodiments is automatic retention of the accessory (and therefore the handgun) upon insertion of the handgun/accessory combination into the holster. The system includes a blocking portion with a protrusion that engages a surface of the accessory. The protrusion extends through an aperture defined by the wall of the holster. The blocking portion includes a rearwardly facing face with a sloped surface configured to cause deflection of a cantilevered portion of the blocking portion member upon insertion of the handgun/accessory combination into the holster.

A feature and advantage of embodiments is a locking action which resists or prevents actuation of the release actuation mechanism while rearward forces are being applied to the handgun; for example, when an attacker is attempting to draw the user's weapon or when the user is running and jostling the holster and firearm. The blocking member of the system include a rearward facing ramp oriented such that the ramp engages a portion of the holster body at the aperture when the blocking portion is forced rearwardly such as when the handgun is pulled without the blocking member being moved out of position. The ramp engaging surface of the holster body applies a reaction force to the distal ramp. The reaction force has a lateral force component securing the blocking portion in the blocking position such that depression of the thumb receiving portion is resisted or prevented. The spring member and blocking portion may be attached to the holster body with some minimal forward backward movement, with respect to the holster body for example, less than 0.25 inches. In other embodiments the forward backward movement may be less than 0.125 inches. In embodiments the blocking portion may be slidably moveable on the spring member. The blocking portion may be biased toward a non-locking position.

A feature and advantage of embodiments involves providing a holster that is capable of receiving handguns of various makes and models without requiring a user to make adjustments to the holster. The holster has sufficient clearance around each handgun to provide a multi-handgun fit. For example, a user can switch handguns in the middle of a three gun competition without removing the holster from his or her body so long as a predetermined accessory for which the holster is configured to receive and retain is attached to each handgun on the handgun rail.

A feature and advantage of embodiments involves providing a holster capable of receiving a first handgun with a slide portion having a first shape and a second handgun with a slide portion having a second shape that is different from the first shape so long as the first and second handguns have an accessory with predetermined form that conforms to an accessory pocket in the holster.

A feature and advantage of embodiments is that the release actuation mechanism is actuated by the user's thumb rather than the user's index finger and that the actuation portion is narrow having the height and width of the elongate sliding member.

A feature and advantage of embodiments is that certain retention mechanism components are housed in a cavity defined by the elongate sliding member that actuates the retention mechanism and a wall portion of the holster. Specifically, the elongate spring member with the blocking portion and the spring that biases the elongate sliding member, are in said cavity. The cavity may be open downwardly to allow debris to exit the cavity. Moreover, the elongate sliding member is secured in a recess defined by a pair of guides or tracks extending forwardly and backwardly on the wall portion and is retained in position by a mounting plate or belt attachment member.

In an embodiment, a holster system is configured for receiving and releasably retaining differently configured handguns, each of the differently configured handguns having a mounting rail positioned below barrels of the differently configured handgun. The holster system comprises an accessory configured to be fixed to the mounting rail of the differently configured handguns. The accessory has a body with an upper clamp sized to grip the mounting rail, the upper clamp having a pair of shoulders, and each shoulder having an upwardly facing surface. The body further having a lower most downwardly facing surface below the shoulders. the holster system further including a holster body having a forward end and a rearward end, the holster body comprising a pair of opposing side wall portions 120, 122 defining a cavity with an open rearward end. The holster body having a handgun receiving and withdrawal axis extending forwardly and rearwardly. The holster body further having a pair of opposing ribs projecting inwardly from each of the opposing side wall portions. The ribs extending forwardly and rearwardly and defining a lower accessory receiving pocket in the cavity. The lower accessory receiving pocket being sized for a conforming fit with the accessory including engagement of the holster body with the pair of shoulders with the pair of ribs. The holster system further including a cover attached to one of the opposing sidewall portions, the cover defining a chamber having an opening that is covered by the one of the opposing sidewall portions. The holster system further including a retention mechanism supported by the wall of the holster body. The retention mechanism comprising an elongate spring member disposed inside the chamber defined by the cover. The elongate spring member extending rearwardly and having a blocking portion at the rearward end of the elongate spring member. The blocking portion swingable in a direction transverse to the handgun receiving and withdrawal axis between a blocking position and a non-blocking position with respect to the accessory such that when the accessory is mounted on one of the differently configured handguns the accessory and handgun attached thereto is retained in the accessory receiving pocket when the blocking portion is in the blocking position and the accessory and handgun attached thereto may be withdrawn from accessory receiving pocket when the blocking portion is in the non-blocking position. The blocking portion being biased toward the blocking position and engageable with the accessory at one of the pair of shoulders of the accessory. The spring member and blocking portion being movable rearwardly with respect to the holster body when a holstered accessory and handgun attached thereto is moved rearwardly in a withdrawal motion with respect to the holster body and the blocking portion is in the blocking position whereby a rearward face of the blocking portion engages a portion of the holster body to at least inhibit the blocking portion from moving to the non-blocking position thereby retaining the handgun in the holster.

In an embodiment, the retention mechanism of the holster system further comprises a thumb actuated release actuation mechanism including an elongate sliding member extending along an exterior surface of one of the side wall portions. The elongate member having opposing ends with a thumb receiving portion at a rearward end thereof and having a protrusion that engages structure on the spring member positioned intermediate a forward end and the rearward end. In an embodiment, the protrusion and structure are configured to produce cantilevered bending of the spring member when the elongate member is slid forwardly and the blocking member is unconstrained thereby moving the blocking member in a direction outwardly with respect to the holster body from the blocking position to the non-blocking position. In an embodiment elongate sliding member engages the spring member forwardly of the blocking portion and when the handgun is moved rearwardly in a withdrawal motion with respect to the holster body and the blocking portion is in the blocking position depressing of the thumb receiving portion causes a bowing of the spring member while retaining the blocking portion in the blocking position.

In an embodiment, a holster system is configured for receiving a handgun having a forward rail below the barrel with an accessory secured thereto. The holster system comprising a holster body having a pair of opposing side wall portions defining an interior with an upper first cavity portion and a lower second cavity portion. In an embodiment, the first cavity portion is sized to receive a slide of the handgun and the second cavity portion is dimensioned to form fit the particular form of the accessory secured to the mounting rail of the handgun. In an embodiment, each of the first and second cavities are open at a rearward end for receiving and withdrawing the handgun and attached accessory in a forward and rearward direction. The holster system further including a cover attached to one of the opposing sidewall portions. The cover defining a chamber having an opening that is covered by the one of the opposing sidewall portions. The holster system further including a retention mechanism supported by the wall of the holster body. The retention mechanism comprising a spring member disposed inside the chamber defined by the cover. The spring member being secured with respect to the one of the opposing sidewall portions at a first end thereof and the spring member extending rearwardly along an exterior surface of the one of the opposing sidewall portions. The second end of the spring member being fixed to a blocking portion. The blocking portion being positioned at a aperture in the one of the opposing sidewall portions and movable between a blocking position and a non-blocking position with respect to the accessory when the accessory is in the second cavity portion. The retention mechanism further comprising an elongate sliding member extending along an exterior surface of the one of the side wall portions and slidable therealong. A first portion of the elongate member extending into the chamber defined by the cover. The first portion of the elongate member being sandwiched between the cover and the one of the side wall portions. The elongate member having opposing ends with a thumb receiving portion at a rearward end thereof and a protrusion that engages structure on the spring member positioned intermediate a forward end and the rearward end. The protrusion and structure producing cantilevered bending of the spring member when the elongate member is slid forwardly thereby moving the blocking member in a direction outwardly with respect to the holster body from the blocking position to the non-blocking position.

In an embodiment, a holster system is configured for receiving and releasably retaining differently configured handguns, each of the differently configured handgun having a mounting rail positioned below a barrel of the differently configured handgun with a predetermined accessory attached to the rail. The accessory having a vertical distance from the bottom surface of the accessory to the top surface of a pair of clamp portions. The holster system comprising a holster body having a forward end and a rearward end. The holster body comprising a pair of opposing side wall portions defining an interior with an open rearward end. The holster body having a handgun receiving and withdrawal axis extending forwardly and rearwardly. The holster body further having a pair of opposing ribs extending linearly forwardly and backwardly and projecting inwardly from each of the opposing side wall portions. The ribs being spaced from an upwardly facing bottom surface of the holster body a distance substantially equal to the vertical distance so that the pair of opposing side walls and the ribs defining a lower accessory receiving pocket in the interior. The holster system further comprising a cover attached to one of the opposing sidewall portions. The cover defining a chamber having an opening that is covered by the one of the opposing sidewall portions. The holster system further comprising a retention mechanism supported by the wall of the holster body. The retention mechanism comprising an elongate spring member connecting to a blocking portion. The elongate spring member being disposed in the chamber defined by the cover. The blocking portion movable in a direction transverse to the handgun receiving and withdrawal axis between a blocking position and a non-blocking position with respect to the accessory such that when the accessory is mounted on one of the differently configured handguns the accessory and handgun attached thereto is retained in the accessory receiving pocket when the blocking portion is in the blocking position and the accessory and handgun attached thereto may be withdrawn from accessory receiving pocket when the blocking portion is in the non-blocking position, the blocking portion biased toward the blocking position. The retention mechanism further comprising a thumb actuated release actuation mechanism. The thumb actuated release actuation mechanism comprising an elongate member extending into the chamber defined by the cover. The elongate member being slidably supported by the cover and the one of the opposing sidewall portions. The elongate member having opposing ends with a thumb receiving portion at a rearward end thereof and having a protrusion that engages structure on the spring member positioned intermediate a forward end and the rearward end. The protrusion and the structure producing cantilevered bending of the spring member when the elongate member is slid forwardly thereby moving the blocking member in a direction outwardly with respect to the holster body from the blocking position to the non-blocking position.

In an embodiment, a holster system comprises a holster and an accessory configured to be fixed to a mounting rail of a handgun. The accessory includes an activator switch carried by a housing of the accessory. In an embodiment, the activator switch has a projecting portion biased into a projecting position, the projecting portion being movable out of the projecting position and into a depressed position. In an embodiment, the activator switch is operatively connected to a camera so that the camera is activated when the projecting portion is in the projecting position and is deactivated when the projecting portion is in the depressed position. In an embodiment, a surface of the holster body holds the projecting portion in the depressed position while the accessory is in a cavity defined by the holster body. The camera may be mounted in various locations. Examples of camera mounting locations include locations on the body of a person, locations on the holster, and locations on the handgun. The camera may be automatically activated upon withdrawal of the gun from the holster regardless of the location of the camera. In an embodiment, the accessory may comprise a camera and the system may include a retention mechanism having a blocking portion movable between a blocking position and a non-blocking position so that the retention mechanism either prevents or allows the accessory attached to the handgun from being withdrawn from the interior of the holster body thus retaining the handgun in the holster.

"Portion" when used herein may refer to a discrete component or an integral part of a component that includes other portions. For example, "blocking portion" may be a separately formed component that is then subsequently attached to another component, such as a spring member. Or it may be the end of a single molded component that has the blocking function and a spring function. The above summary of the various representative features and aspects of the present invention is not intended to describe each illustrated embodiment or every implementation of the present invention. Rather, the various representative features and aspects are chosen and described so that others skilled in the art may appreciate and understand the principles of certain aspects of the present invention. The figures in the detailed description that follows more particularly exemplify such aspects of the present invention.

DESCRIPTION OF THE FIGURES

FIG. 7A, FIG. 7B and FIG. 7C are a sequence of diagrams illustrating the forces acting on the ramp portion of the elongate spring member shown in FIG. 6.

DETAILED DESCRIPTION

Figure 1:
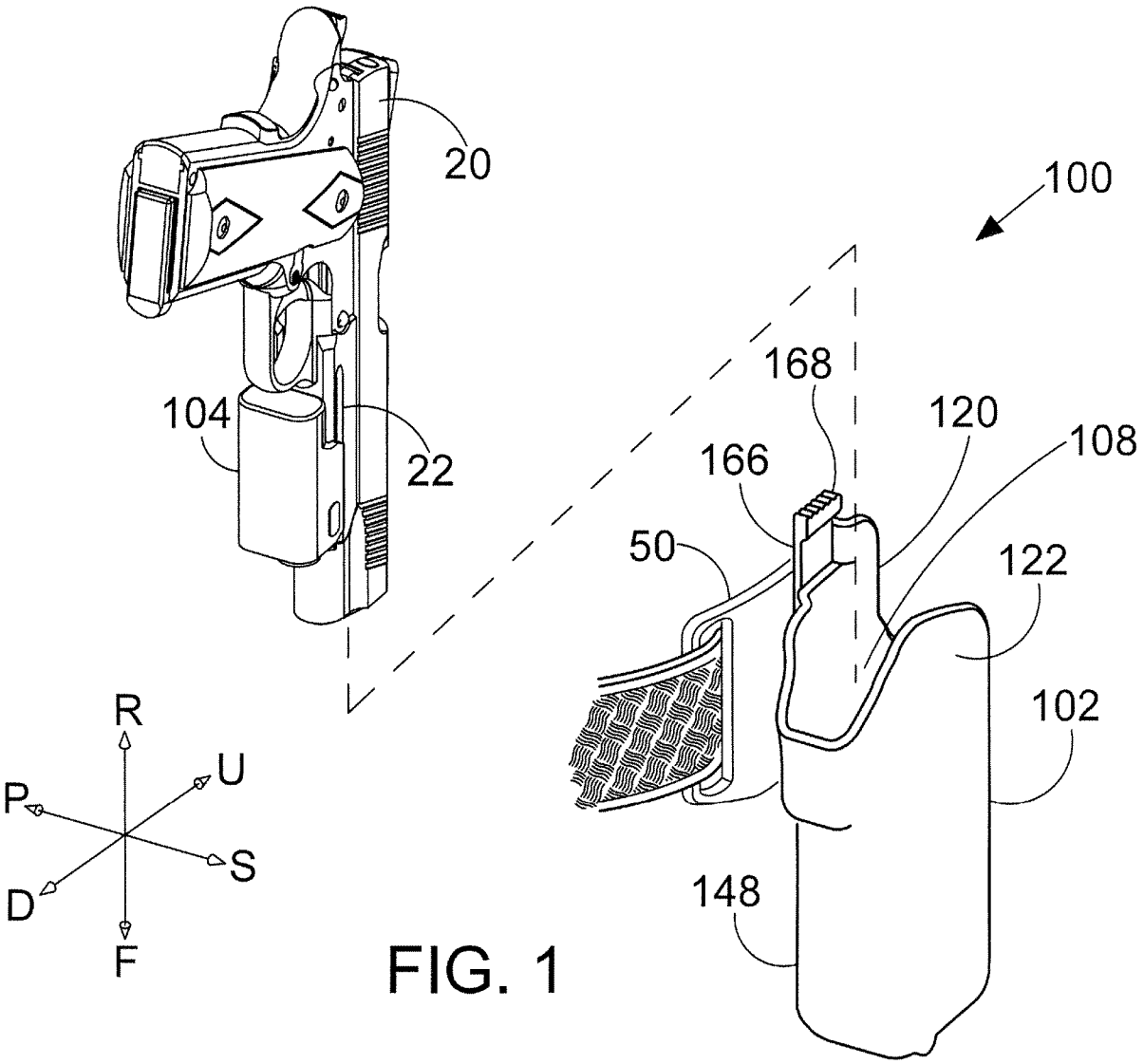
FIG. 1 is a perspective view showing a universal holster system in accordance with the detailed description.
Figure 14:
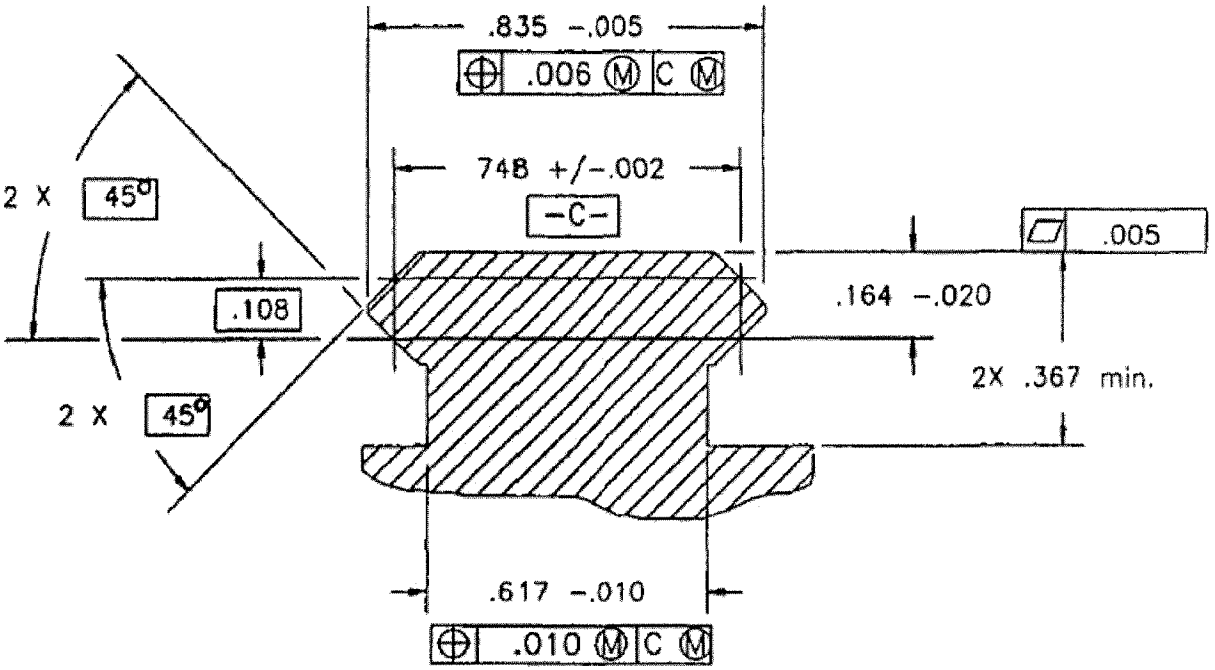
FIG. 14 PRIOR ART
FIG. 14 is a prior art copy of Military Standard MIL-STD-1913 (AR) of mounting rails.

FIG. 1 is a perspective view showing a holster system 100 in accordance with this detailed description. The holster system 100 of FIG. 1 comprises a holster 102 and an accessory 104 configured to be fixed to a mounting rail 22 of a handgun 20. The mounting rail may conform to Military Standard MIL-STD-1913 (AR) as shown in FIG. 14. In embodiments, the system may include the handgun 20. The accessory 104 may comprise various types of accessories without deviating from the spirit and scope of this detailed description. Examples of accessories that may be suitable in some applications include cameras, targeting devices, such as LASER sighting devices, and target illuminators, such as flashlights, and non-active mounting adaptors. In the example embodiment of FIG. 1, accessory 104 comprises a light source. A feature and advantage of embodiments of the holster system 100 includes providing a universal holster system that allows a single holster to be utilized with various makes and models of handgun. In these embodiments, a predetermined weapon mounted accessory, such as a light, is used as the sole or primary interface with the holster. In embodiments, the holster partially encloses the handgun while leaving a predetermined clearance around the handgun. The clearance around the handgun allows a single holster system to be utilized with various makes and models of handgun as long as the handgun has the predetermined accessory.

The holster 102 has a holster body 148 having a wall 106 defining an interior or cavity 108. The wall 106 of the holster body 148 includes a port side wall portion 120 and a starboard side wall portion 122. In the embodiment of FIG. 1, a mounting plate 50 is fixed to the port wall portion 120 of the holster 102. In the embodiment of FIG. 1, the mounting plate 50 defines a plurality of slots that may receive a belt, straps, and/or other retaining means.

In embodiments, the holster system 100 of FIG. 1 includes a retention mechanism that is capable of selectively allowing and preventing withdrawal of the handgun 20 from the holster 102. In the embodiment of FIG. 1, the retention mechanism includes an elongate sliding member 166 having a thumb receiving portion 168. The sliding member 166 extends between the mounting plate 50 and the port side wall portion 120 of the holster in the embodiment of FIG. 1. The sliding member 166 is slidingly supported by a port side wall portion 120 of the holster 102. The state of the retention mechanism may be changed by applying a forward force to the thumb receiving portion 168 of the sliding member 166.

In FIG. 1, orientations are keyed from the handgun in a normal firing position and are applicable to the holster throughout this application. An upward direction U and a downward or lower direction D are illustrated using arrows labeled "U" and "D," respectively. A forward direction F and a rearward direction R are illustrated using arrows labeled "F" and "R," respectively, in FIG. 1. A starboard direction S and a port direction P are illustrated using arrows labeled "S" and "P," respectively.

Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portly," and "starboardly," should not be interpreted to limit the scope of the invention recited in the attached claims.

Figure 2A:
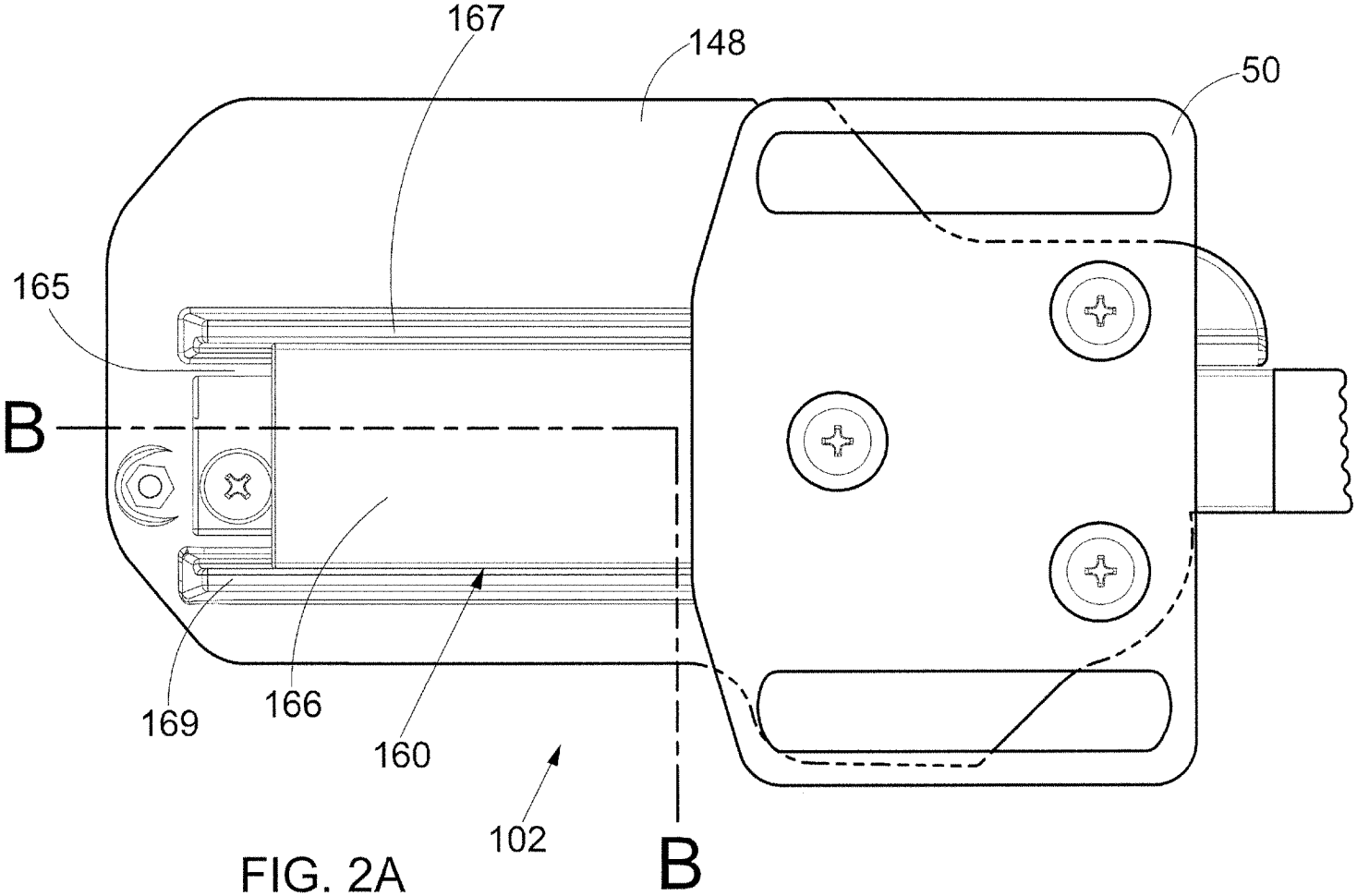
FIG. 2A is a port side view showing the holster shown in FIG. 1.
Figure 2C:
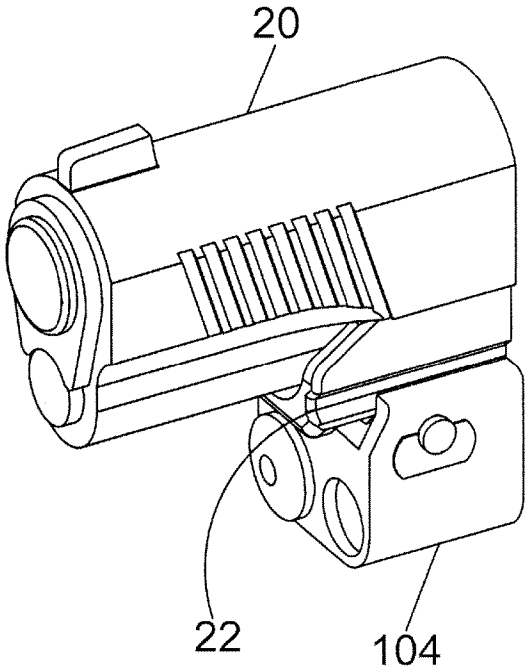
FIG. 2C is a perspective view showing a portion of an accessory fixed to a mounting rail of a handgun.
Figure 2B:
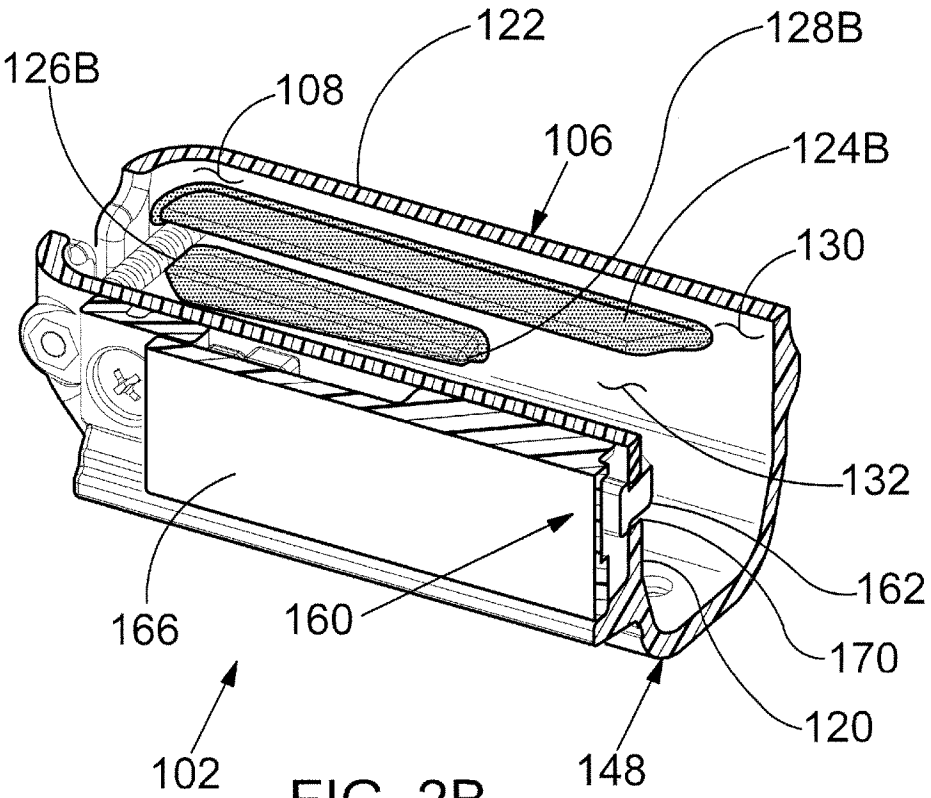
FIG. 2B is a perspective cross-sectional view further illustrating the holster shown in FIG. 2A.

FIG. 2A is a port side view showing the holster 102 shown in FIG. 1. FIG. 2B is a perspective cross-sectional view further illustrating the holster shown in FIG. 2A. The cross-sectional view of FIG. 2B was created by cutting holster 102 along section line B-B shown in FIG. 2A. FIG. 2C is a perspective view showing a portion of an accessory 104 fixed to a mounting rail 22 of a handgun 20.

The holster 102 has a holster body 148 with a wall 106 defining a cavity 108. The wall 106 of the holster body 148 includes a port wall portion 120 and a starboard wall portion 122. Each wall portion has an inwardly projecting track or rib 124, 124 dividing the cavity 108 into an upper first cavity portion 130 and a lower second cavity portion 132 configured as a conforming pocket. The rib extending inwardly from the port wall portion is shown in FIG. 2. In FIG. 2B, a starboard rib 124 can be seen extending inwardly from the starboard wall portion 122. For purposes of illustration, the starboard rib 124 is stippled with a pattern of dots in FIG. 2B.

The first cavity portion 130 is dimensioned to receive a slide portion of the handgun 20 and the second cavity portion 132 is dimensioned to receive the accessory 104. The holster body 148 is configured such that a conforming engagement is formed between the accessory 104 and the holster body 148 when the accessory 104 is received in the second cavity portion 132. The first cavity portion 130 is dimensioned to be oversized to receive various handgun makes and models in a spaced relationship from three sides thereof.

In FIG. 2B, a starboard ledge 126B can be seen extending inwardly from the starboard wall portion 122. For purposes of illustration, the starboard ledge 126B is shaded with a pattern of dots in FIG. 2B. The starboard ledge 126A includes a starboard side stop surface 128B that engages the accessory 104 upon insertion of the handgun 20 with the accessory 104 into the holster body 148. The holster body 148 also includes a port ledge that is not visible in FIG. 2. The port ledge extends inwardly from the port wall portion 120. The port ledge includes a port side stop surface.

The wall 106 of the holster body 148, the rails, and the stop surfaces of the ledges establish a seating position of the accessory 104 whereby the accessory 104 and thus the handgun attached thereto is constrained forwardly, backwardly, downwardly, portly, and starboardly. A retention mechanism 160 is capable of selectively preventing and allowing movement of the accessory 104 in the rearward direction. A portion of the retention mechanism 160 is visible in FIG. 2B. In the embodiment of FIG. 2, the retention mechanism 160 is supported by the port wall portion 120 of the holster body 148.

The retention mechanism 160 of FIG. 2A comprises a retention or blocking portion 162 movable between a retention or blocking position and a non-blocking position so that the retention mechanism 160 either prevents or allows withdrawal of the accessory 104 attached to the handgun 20 defined by the holster body 148 thus retaining the handgun 20 in the holster 102.

In FIG. 2B, the blocking portion 162 can be seen extending through an aperture 170 defined by the port wall portion 120. In the embodiment of FIG. 2, the blocking portion 162 is on a spring member biased to a retention position. The blocking portion 162 is positioned to engage an upward facing surface of the accessory 104. A sliding member 166 on the port side of the holster 102 engages the spring member for selectively deflecting the spring member to move the blocking portion 162 to the non-blocking position.

Figure 3A:
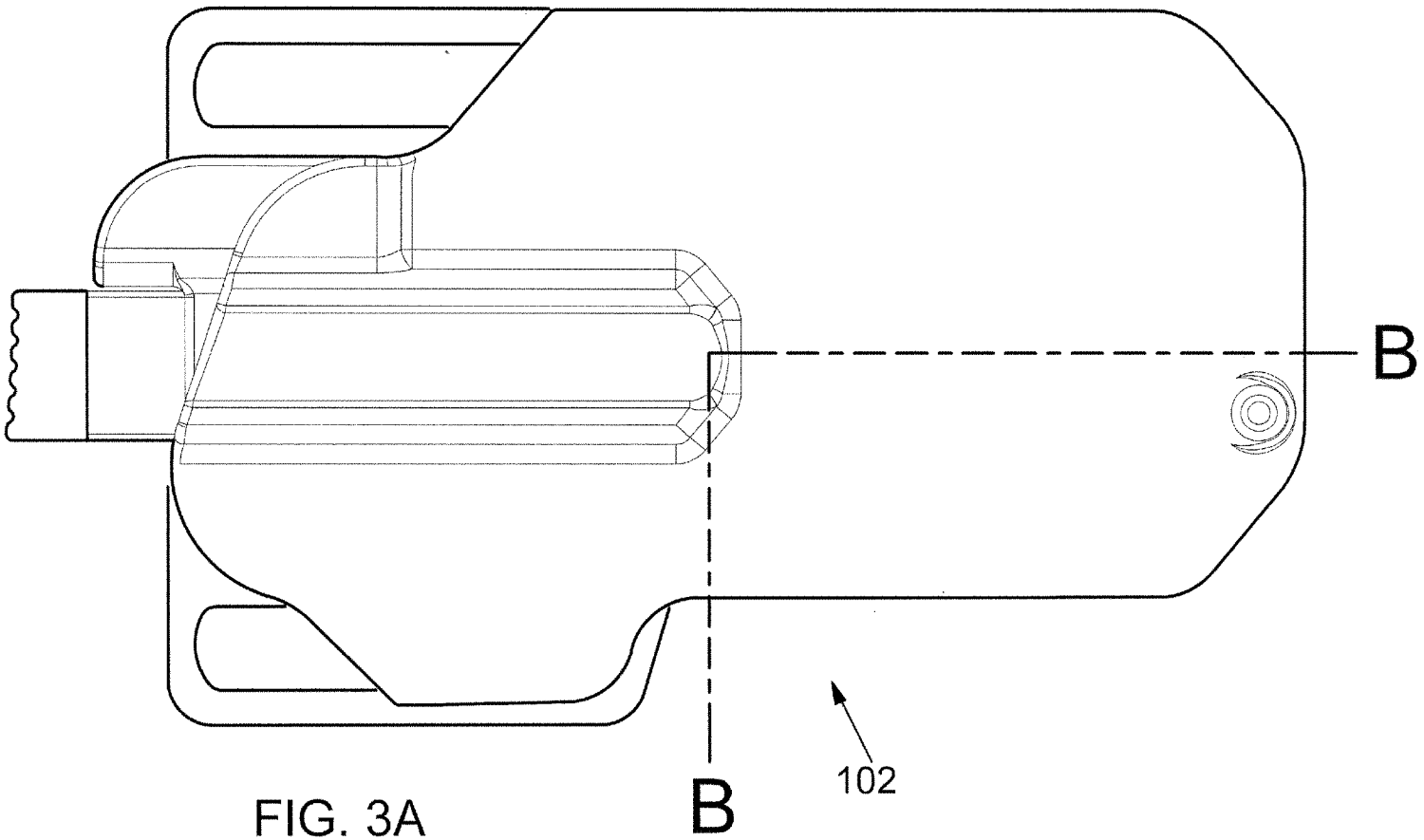
FIG. 3A is a port side view showing the holster shown in FIG. 1.
Figure 3B:
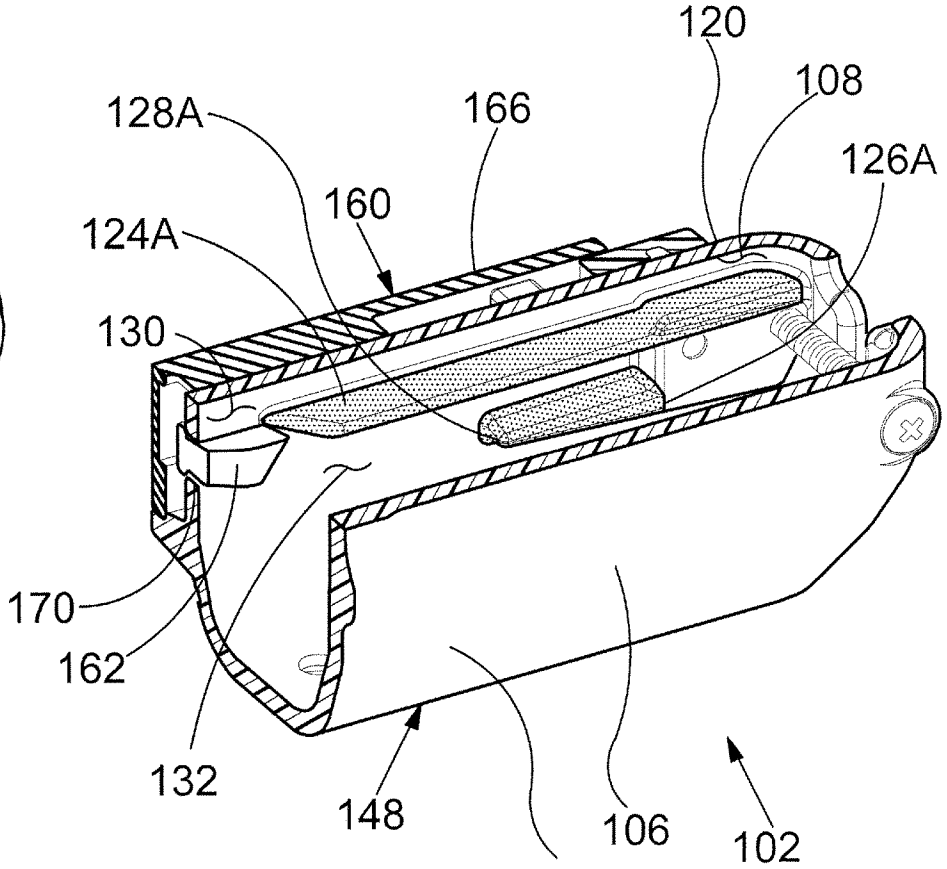
FIG. 3B is a perspective cross-sectional view further illustrating the holster shown in FIG. 3A.
Figure 3C:
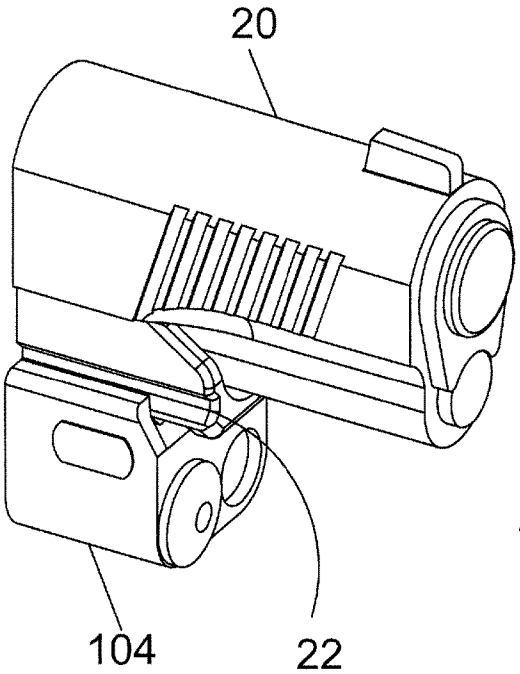
FIG. 3C is a perspective view showing a portion of an accessory fixed to a mounting rail of a handgun.

FIG. 3A is a starboard side view showing the holster 102 shown in FIG. 1. FIG. 3B is a perspective cross-sectional view further illustrating the holster shown in FIG. 3A. The cross-sectional view of FIG. 3B was created by cutting holster 102 along section line B-B shown in FIG. 3A. FIG. 3C is a perspective view showing a portion of an accessory 104 fixed to a mounting rail 22 of a handgun 20. FIG. 3A, FIG. 3B and FIG. 3C may be collectively referred to as FIG. 3.

The holster 102 has a holster body 148 with a wall 106 defining a cavity 108. The wall 106 of the holster body 148 includes a port wall portion 120 and a starboard wall portion 122. Each wall portion has an inwardly projecting rib dividing the cavity 108 into an upper first cavity portion 130 and a lower second cavity portion 132. The rib extending inwardly from the starboard wall portion 122 is not visible in FIG. 3. In FIG. 3B, a port rib 124 can be seen extending inwardly from the port wall portion 120. For purposes of illustration, the port rib 124 is shaded with a pattern of dots in FIG. 3B.

The first cavity portion 130 is dimensioned to receive a slide portion of the handgun 20 and the second cavity portion 132 is dimensioned to receive the accessory 104. The holster body 148 is configured such that a conforming engagement is formed between the accessory 104 and the holster body 148 when the accessory 104 is received in the second cavity portion 132. The first cavity portion 130 is dimensioned to receive various handgun makes and models in a spaced relationship from three sides thereof.

In FIG. 3B, a port ledge 126A can be seen extending inwardly from the port wall portion 120. For purposes of illustration, the port ledge 126A is shaded with a pattern of dots in FIG. 3B. The port ledge 126A includes a port side stop surface 128A that engages the accessory 104 upon insertion of the handgun 20 and the accessory 104 mounted thereto into the holster body 148. The holster body 148 also includes a starboard ledge that is not visible in FIG. 3. The starboard ledge extends inwardly from the starboard wall portion 122. The starboard ledge includes a starboard side stop surface.

The wall portions 120, 122 of the holster body 148, the rails, and the stop surfaces of the ledges establish a seating position of the accessory 104 whereby the accessory 104 and thus the handgun attached thereto is constrained forwardly, backwardly, downwardly, portly, and starboardly. A retention mechanism 160 is capable of selectively preventing and allowing movement of the accessory 104 in the rearward direction. A portion of the retention mechanism 160 is visible in FIG. 3B. In the embodiment of FIG. 3, the retention mechanism 160 is supported by the port wall portion 120 of the holster body 148.

The retention mechanism 160 of FIG. 3 comprises a blocking portion 162 movable between a blocking position and a non-blocking position so that the retention mechanism 160 either prevents or allows the accessory 104 attached to the handgun 20 from being withdrawn from the second cavity portion 132 defined by the holster body 148 thus retaining the handgun 20 in the holster 102.

In FIG. 3B, the blocking portion 162 can be seen extending through an aperture 170 defined by the port wall portion 120. In the embodiment of FIG. 3, the blocking portion 162 is on a spring member biased to a retention position. The blocking portion 162 is positioned to engage an upward facing surface of the accessory 104. A sliding member 166 on the port side of the holster 102 engages the spring member for selectively deflecting the spring member to move the blocking portion 162 to the non-blocking position.

Figure 4A:
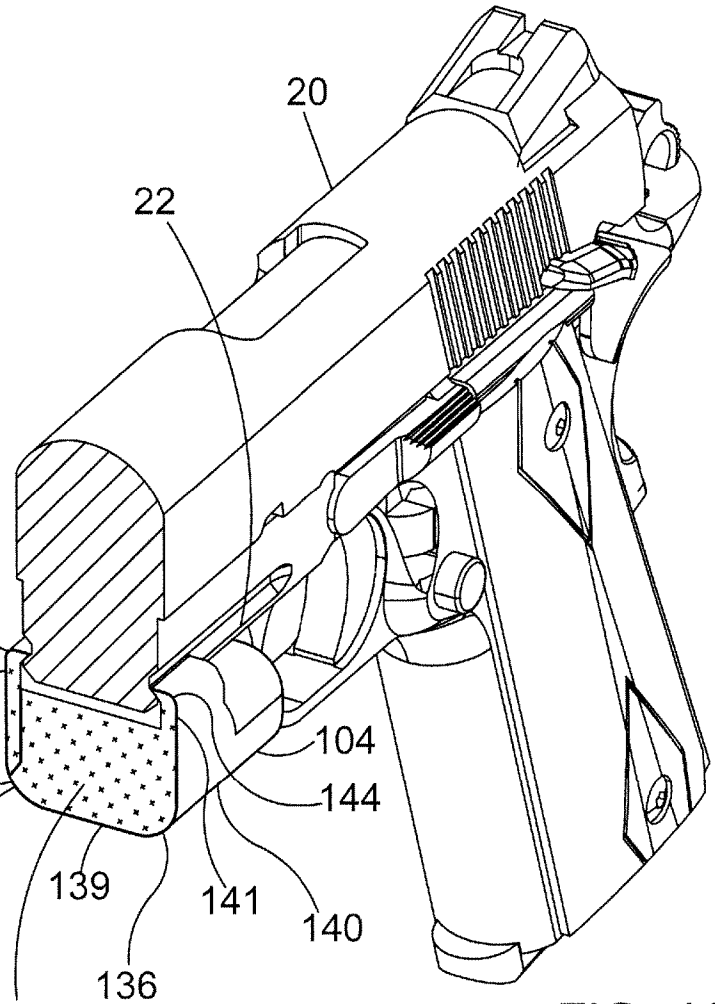
FIG. 4 is a perspective view showing a portion of an accessory fixed to a mounting rail of a handgun and how it is received into a slot or pocket of a holster.
Figure 4B:
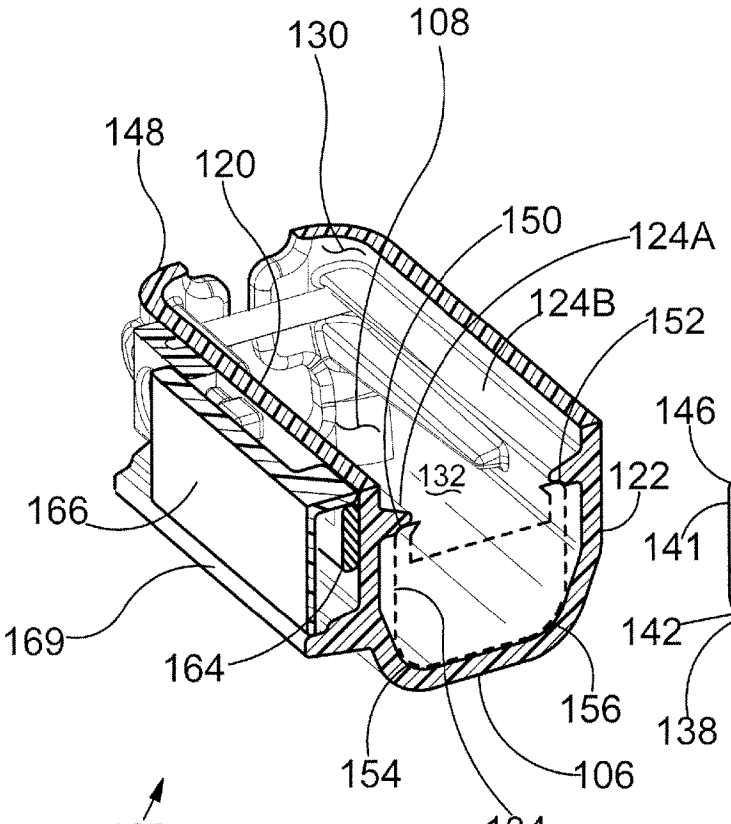

FIG. 4 is a perspective view showing a portion of an accessory 104 fixed to a mounting rail 22 of a handgun 20 by way of clamp portions 141. The accessory 104 has a transverse cross-sectional shape 134 that is filled with a pattern of x-shaped marks in FIG. 4. The transverse cross-sectional shape 134 of the accessory 104 has a first fillet 136 and a second fillet 138 and a lower most downwardly facing surface 139. The first fillet 136 of the cross-sectional shape 134 corresponds to a first convex surface 140 of the accessory 104. The second fillet 138 of the cross-sectional shape 134 corresponds to a second convex surface 142 of the accessory 104.

The transverse cross-sectional shape 134 of the accessory 104 also has a first corner 144 and a second corner 146. In the embodiment of FIG. 4, the first corner 144 and the second corner 146 each have a convex outer surface. With reference to FIG. 4, it will be appreciated that first corner 144 has a radius of curvature that is smaller than the radius of curvature of first fillet 136. It will also be appreciated that second corner 146 has a radius of curvature that is smaller than the radius of curvature of second fillet 138.

FIG. 4 illustrates the accessory and where it interfaces with a portion of the holster 102. The holster 102 has a holster body 148 with a wall 106 defining a cavity 108. The wall 106 of the holster body 148 comprises a port wall portion 120 and a starboard wall portion 122. In FIG. 4, a port rib 124 can be seen extending into the cavity 108 from the port wall portion 120. A starboard rib 124 is shown extending into the cavity 108 from the starboard wall portion 122. The cutting plane used to create the section view of FIG. 4 passes through both the port rib 124 and the starboard rib 124. The port rib 124 defines a first groove 150 and the starboard rib 124 defines a second groove 152. In the embodiment of FIG. 4, the first groove 150 is defined by a concave surface of the starboard rib 124. The second groove 152 is defined by a concave surface of the port rib 124. When received in the slot or pocket, the freedom of motion of the accessory is limited to a forward and rearward motion due to the tight interface.

The port rib 124 and the starboard rib 124 divide the cavity 108 of the holster into a first cavity portion 130 and a second cavity portion 132. With reference to FIG. 4, it will be appreciated that the second cavity portion 132 is partially defined by a first concave surface 154 of the wall 106 and a second concave surface 156 of the wall 106.

For purposes of illustration, the transverse cross-sectional shape 134 of the accessory 104 is shown disposed in the second cavity portion 132 of FIG. 4. The transverse cross-sectional shape 134 is represented by a pattern of x-shaped marks in FIG. 4.

In the embodiment of FIG. 4, the first concave surface 154 of the wall 106 is configured to mate with the first convex surface 140 of the accessory 104 and the second concave surface 156 of the wall is configured to mate with the second convex surface 142 of the accessory 104 when the accessory is received in the second cavity portion 132. The first groove 150 is configured to receive the first corner 144 of the accessory 104 and the second groove 152 is configured to receive the second corner 146 of the accessory 104 when the accessory 104 is received in the second cavity portion 132.

Figure 5A:
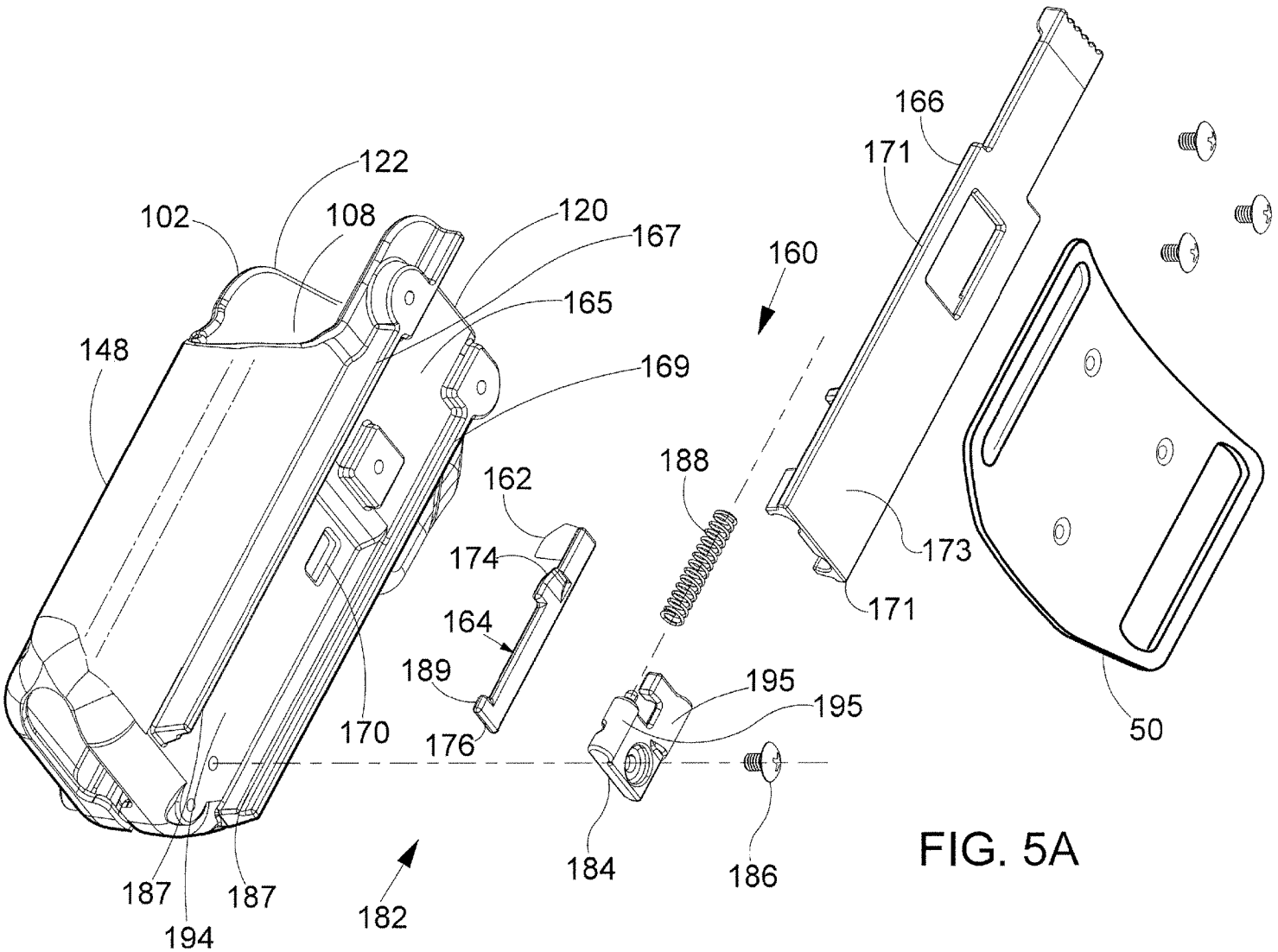
FIG. 5A is an exploded perspective view of an assembly including a holster and a retention mechanism viewed from the port side.
Figure 5B:
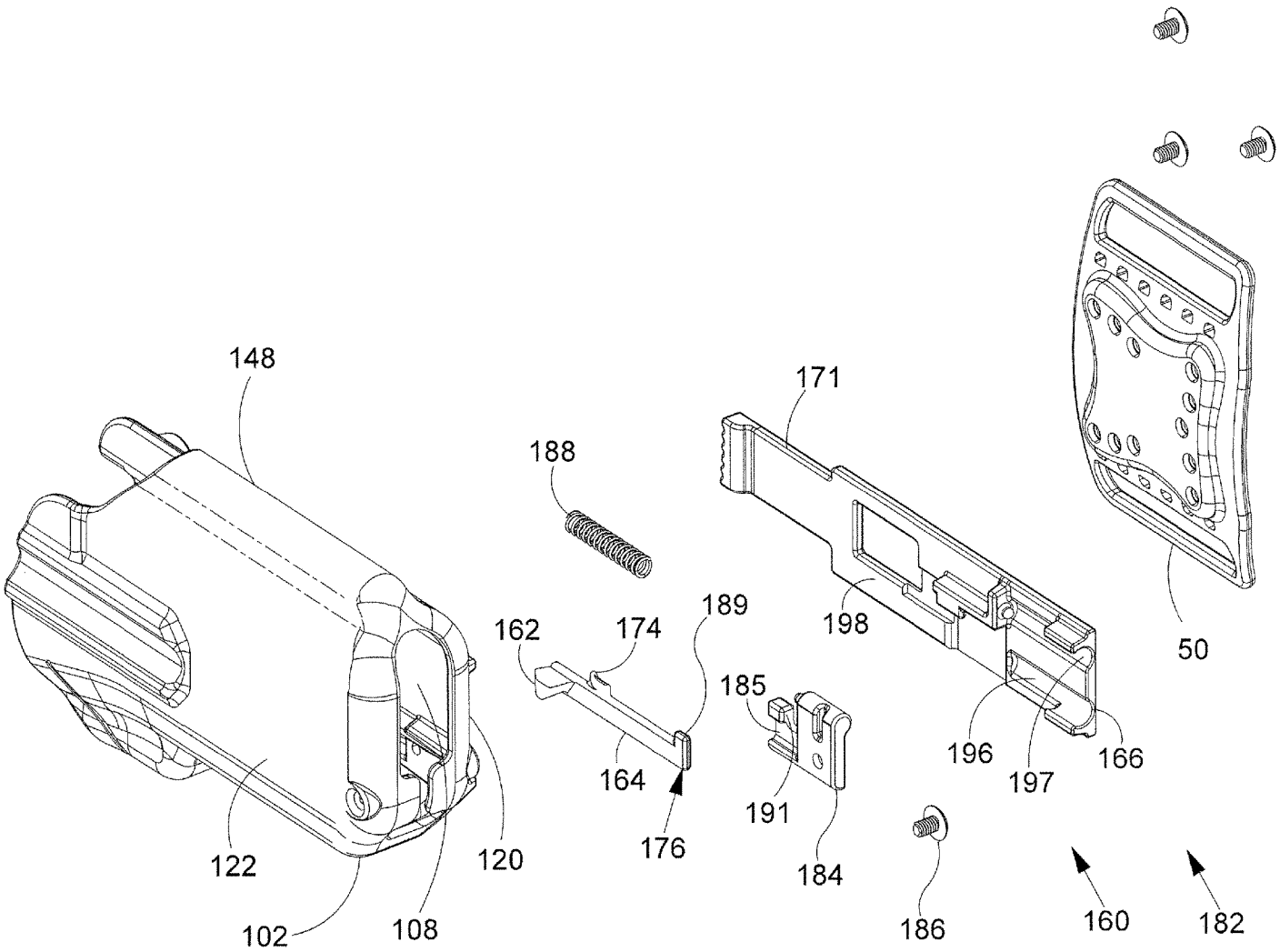
FIG. 5B is an exploded perspective view of the assembly of FIG. 5A view from the starboard side.
Figure 5C:
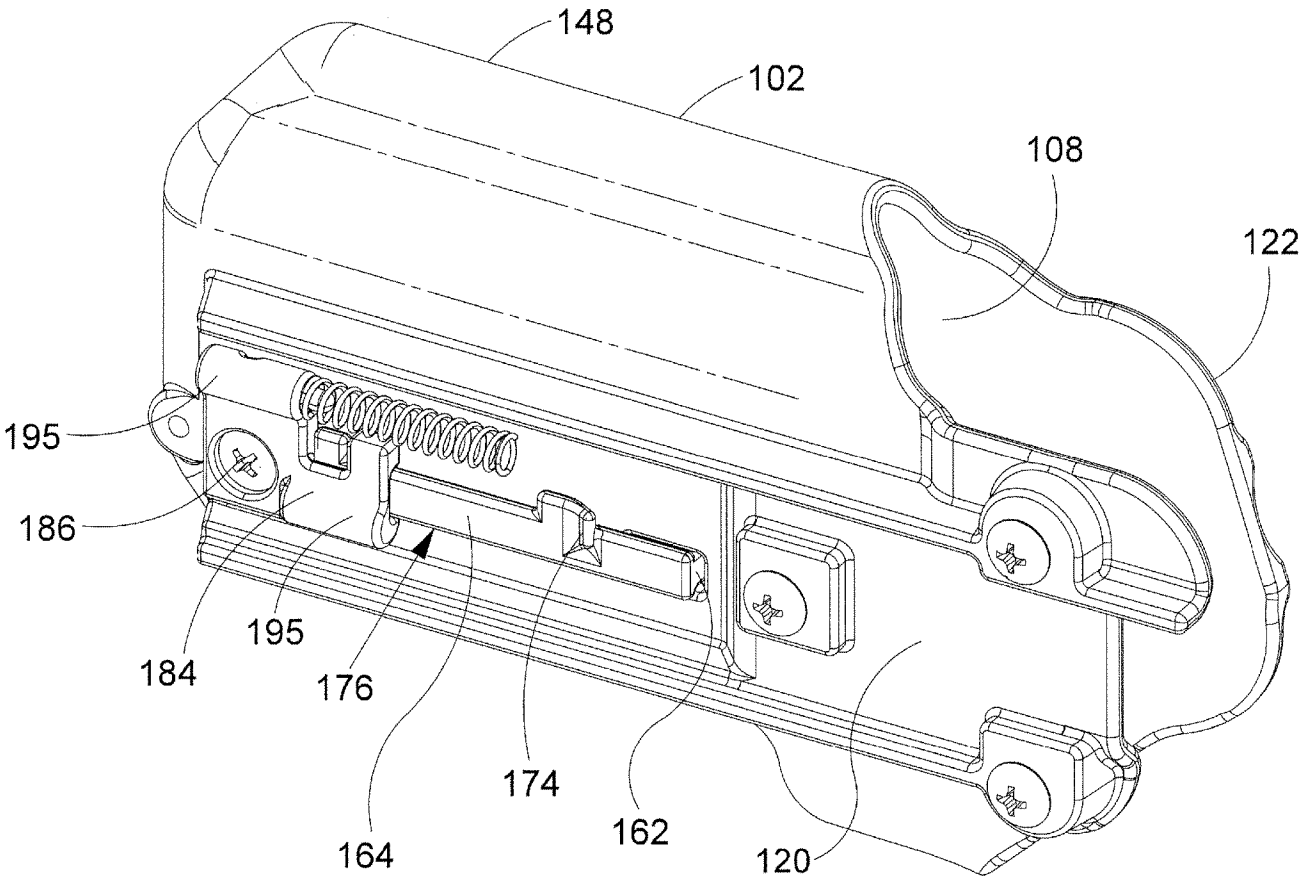
FIG. 5C is a perspective view of the holster body with the plate and elongate sliding member removed.

Referring to FIGS. 2A, 4, 5A, 5B, and 5C, a holster assembly 182 including a holster 102 with a retention mechanism 160 is depicted. The holster 102 having the holster body 148 with a port wall portion 120 and an opposite starboard wall portion 122. The walls of the holster body defining the cavity 108. The retention mechanism 160 primarily comprises a spring member 164 and elongate sliding member 166. The sliding member is illustrated with a planar exterior surface 173 that may be flush with or recessed from the outer surfaces of the guides. The spring member 164 has a forward end 176, a protrusion with a ramp 174 and a blocking portion 162. In the embodiment of FIGS. 5A and 5B, the spring member 164 is in a relaxed state with no external forces acting on it. When the assembly 182 is in an assembled state, a holding member configured as a bracket 184 holds one end of the spring member 164 against the port wall portion 120 so that the spring member 164 may be deflected in a cantilevered fashion. In embodiments the spring member can be preloaded when attached to the side wall portion so that the blocking portion exerts some pressure against the wall portion at or proximate the aperture. A blocking portion 162 is disposed at an end of the elongate spring member opposite the bracket 184. When the assembly 182 is in an assembled state, the blocking portion 162 extends through an aperture 170 defined by the port wall portion 120. The bracket 184 is fixed to the port wall portion 120 using a screw 186. The bracket or holding member 184 defines a slot 185 from which the spring member 164 extends. The spring member 164 may be movable forwardly and backwardly in the slot with the movement being limited by the tab 189 in the recess 190 of the bracket 184 with stop surfaces 191 and 192.

An elongate sliding member 166 slidingly engages the port wall portion 120 of the holster body 148 on guides 187 that define a forward and backward extending recess or slot 194 that receives the sliding member. Ribs 195 on the bracket cooperate with grooves 196, 197 on the inside surface 198 of the elongate sliding member. A coil spring 188 extends between sliding member 166 and the bracket 184 when the assembly 182 is in an assembled state. The coil spring 188 is positioned to bias the sliding member 166 in a rearward direction. The spring may be anchored at other locations, for example, the tab 176 or a suitably positioned protrusion on the side wall portion, not shown. With reference to FIG. 5, it will be appreciated that assembly 182 includes a mounting plate 50. When the assembly 182 is in an assembled state the mounting plate 50 is fixed to the port wall portion 120 of the holster 102. The sliding member 166 extends between mounting plate 50 and the port wall portion 120 of the holster body 148 when the assembly 182 is in an assembled state. In the embodiment of FIG. 5, the mounting plate 50 defines a plurality of slots that may receive a belt, straps, and/or other retaining means.

Referring to FIGS. 4, 5A-5C and 6A-6C, components of and the operation of a retention mechanism 160 in accordance embodiments are illustrated. The retention mechanism 160 comprises a blocking portion 162 that is movable between a blocking position and a non-blocking position, and the elongate sliding member 166 including a cam portion 172. A cross-sectional depiction of the cam-portion 172 is included in FIG. 6A-6C.

Figures 6A, 6B, 6C:
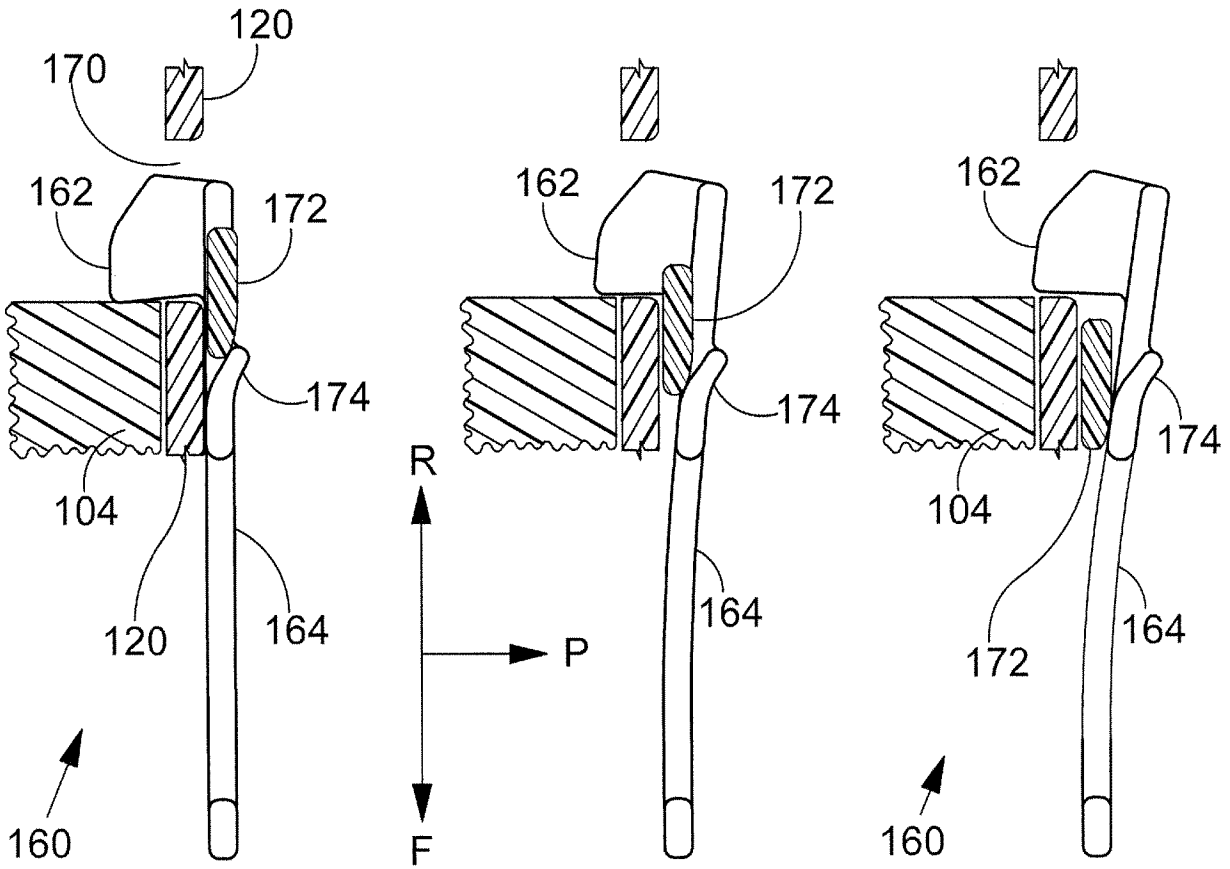
FIG. 6A, FIG. 6B and FIG. 6C are a sequence of stylized front plan views illustrating the operation of a retention mechanism in accordance with the detailed description.

FIG. 6A shows the blocking portion 162 disposed in the blocking position with the blocking portion 162 extending through an aperture 170 defined by the port wall portion 120. The blocking portion 162 can be seen contacting a rearwardly facing surface of the accessory 104 in FIG. 6A. When the blocking portion 162 is in the blocking position, the accessory 104 is prevented from moving in a rearward direction R.

The retention mechanism 160 comprises spring member 164 having a forward end 176 with a tab 189, a protrusion 175 with a ramp 174 and a blocking portion 162. In the embodiment of FIG. 6A, the spring member 164 is in a normal state with no external forces acting on it. It may have a pretension, on attachment, inwardly so that the blocking member is well set in the aperture. In FIG. 6A, the surface of the cam portion 172 is shown making initial contact with the surface of the ramp portion 174. In the embodiment of FIG. 6, the spring member 164 may be deflected in a cantilevered fashion by moving the cam portion 172 in a downward direction D.

FIG. 6B illustrates the blocking portion 162 and the cam portion 172. With the blocking portion 162 in the process of moving from the blocking position (shown in FIG. 6A) to the non-blocking position (shown in FIG. 6C). In the embodiment of FIG. 6A-6C, the ramp portion 174 and the cam portion 172 are shaped and dimensioned such that forces applied to the ramp portion 174 by the cam portion 172 will cause the blocking portion 162 to move in a port direction P as the cam portion 172 is moved in a forward direction F. In the embodiment of FIG. 6B, the cam portion 172 has been moved in a downward direction relative to the position of the cam portion 172 shown in FIG. 6A. By comparing FIG. 6B and FIG. 6A, it will be appreciated that the blocking portion 162 has moved in the port direction P.

FIG. 6C shows the blocking portion 162 disposed in the non-blocking position. In the embodiment of FIG. 6C, the cam portion 172 has moved further in the forward direction relative to the position of the cam portion 172 shown in FIG. 6B. By comparing FIG. 6C with FIG. 6B, it will be appreciated that the cam portion 172 slides along the surface of the ramp portion 174 as the cam portion 172 moves in the forward direction. In the embodiment of FIG. 6C, the blocking portion 172 has moved in the port direction P a sufficient distance to reach the non-blocking position. When the blocking portion 162 is in the non-blocking position, the accessory 104 is free to move in the rearward direction R.

FIGS. 7A-7C are a sequence of diagrams illustrating the forces acting on the ramp portion 174 of the spring member 164 shown in FIGS. 6A-6C. Each of these FIGS. include a cross-sectional depiction of the cam portion 172 shown in FIG. 6. The ramp portion 174 is also shown in each of these FIGS.

FIGS. 7A-7C, a surface of the cam portion 172 is shown contacting a surface of the ramp portion 174 at a point of tangency. A tangent line TAN is shown extending through the point of tangency in FIG. 7.

As shown in FIGS. 7A-7C, the surface of the cam portion 172 acts on the surface of the ramp portion 174 with a slider force FS. The slider force FS may be resolved into a forwardly force component FF and a portward force component FP. In FIG. 6, a forward direction F and a port direction P are illustrated using arrows labeled "F" and "P," respectively. The portward force component FP acts to deflect the spring member of the spring member 164 in a cantilevered fashion.

At FIG. 7A, the surface of the cam portion 172 makes initial contact with the surface of the ramp portion 174 and begins to act on the ramp portion 174 with slider force FS.

At FIG. 7B, the cam portion 172 has moved in the forward direction D relative to the position of the cam portion 172 shown in FIG. 7A. As illustrated in the figures, the cam portion 172 slides along the surface of the ramp portion 174 as the cam portion 172 moves in the forward direction. In the embodiment of FIGS. 7A-7C, the portward force component FP acts to deflect the spring member of the spring member 164 in a cantilevered fashion as the cam portion 172 slides along the surface of the ramp portion 174.

At FIG. 7C, the cam portion 172 has moved further in the forward direction F relative to the position of the cam portion 172 shown in FIG. 7B. By comparing FIG. 7C with FIG. 7B, it will be appreciated that the cam portion 172 slides along the surface of the ramp portion 174 as the cam portion 172 moves in the downward direction. In the embodiment of FIG. 7, the portward force component FP acts to deflect the spring member of the spring member 164 in a cantilevered fashion as the cam portion 172 slides along the surface of the ramp portion 174.

Figure 8B:
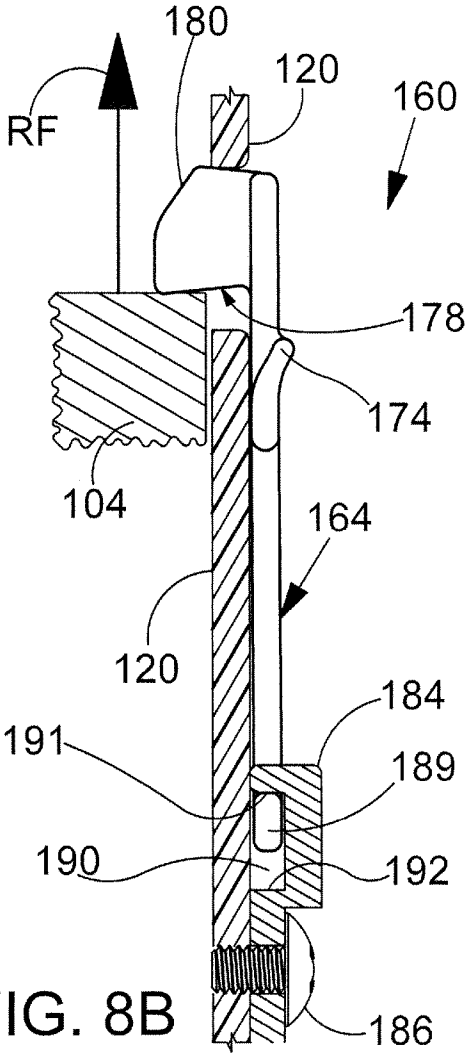
FIG. 8A and FIG. 8B are stylized front plan views showing an elongate spring member of a retention mechanism in accordance with the detailed description.
Figure 8A:
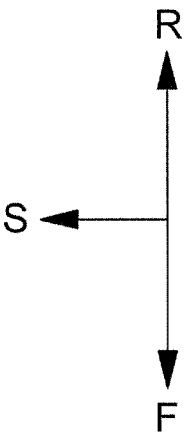
Figure 8A:
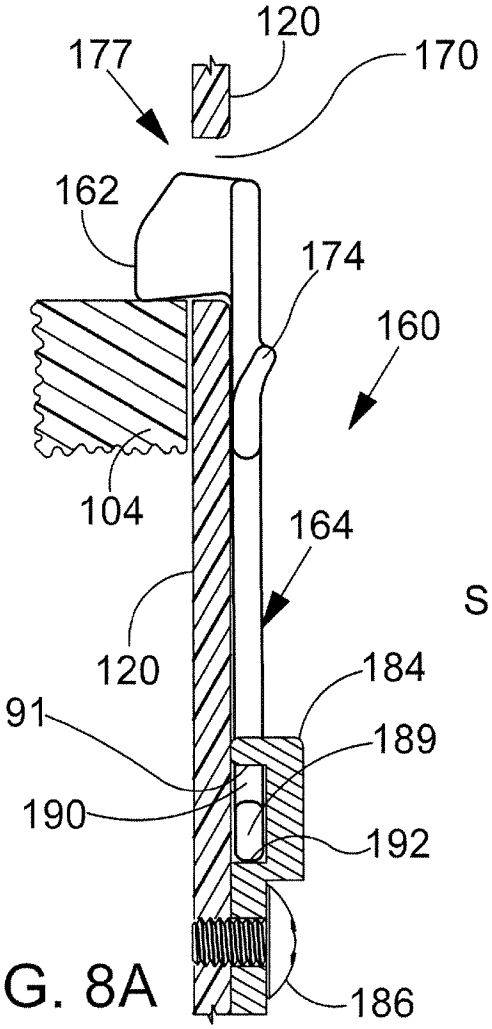

FIGS. 8A-8B are stylized front plan views showing a spring member 164 of a retention mechanism 160 in accordance with this detailed description. The spring member 164 includes a blocking portion 162 that is movable between a blocking position and a non-blocking position. In the embodiment of FIG. 8A, the blocking portion 162 is disposed in the blocking position and has a rearward facing face 177 and a forward facing face 178.

With reference to FIG. 8A, it will be appreciated that the blocking portion 162 extends through an aperture 170 defined by the port wall portion 120 when the blocking portion 162 is disposed in the blocking position. The blocking portion 162 can be seen contacting a rearwardly facing surface of the accessory 104 in FIG. 8A. When the blocking portion 162 is in the blocking position, the accessory 104 is prevented from moving in a rearward direction R. In FIGS.

8A-8B, a rearward direction R, a forward direction F, and a starboard direction S are illustrated using arrows labeled R, F and S, respectively.

In the embodiment of FIG. 8B, a rearwardly directed force RF has been applied to the accessory 104. This may occur, for example, when an assailant is attempting to pull a police officer's handgun out of its holster or when the police officer is running. By comparing FIG. 8A and FIG. 8B, it will be appreciated that the application of the upwardly directed pulling force RF to the accessory 104 has caused the spring member 164 to move in the upward direction U so that an rearward surface 180 of the spring member 164 is contacting an edge surface of the port wall portion 120 that defines the aperture 170. When this is the case, the edge surface of the port wall portion 120 provides a reaction force that stops the movement of the spring member 164. In the embodiment of FIG. 8B, the rearward surface 180 of the spring member 164 is sloped so that the reaction force provided by the edge surface of the port wall portion 120 will have a starboardly directed component. In some useful embodiments, the rearward surface 180 of the spring member 164 is oriented such that the starboardly directed component of the reaction force provided by the edge surface of the port wall portion 120 resists or prevents release of the retention mechanism 160 while rearward or pulling forces are being applied to the handgun.

Figure 8D:
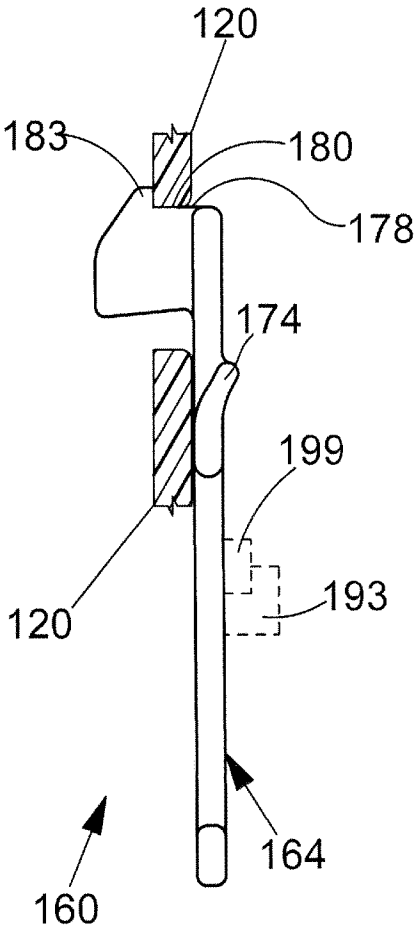
FIG. 8D illustrates alternative actuation lockout configurations of the elongate spring member.
Figure 8C:
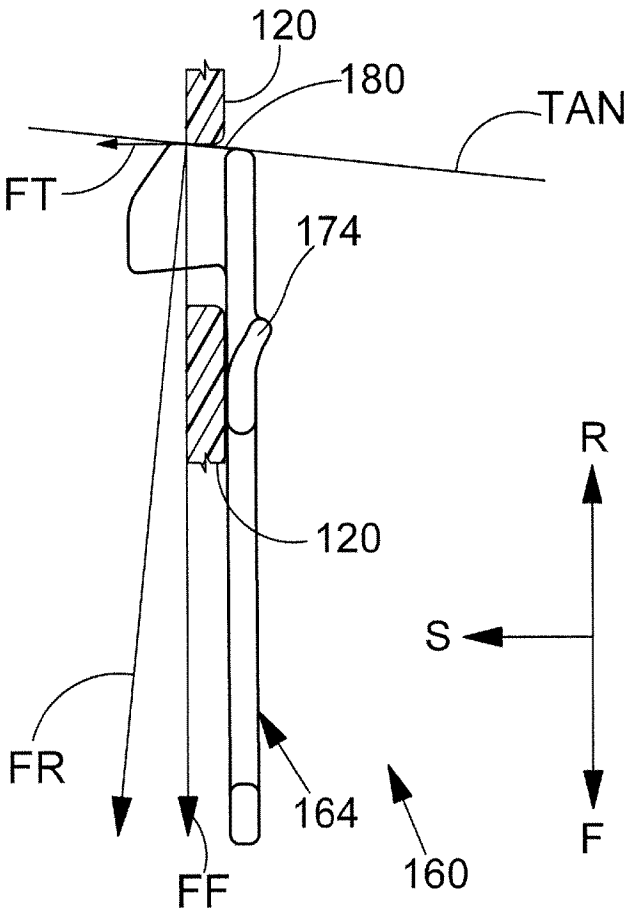
FIG. 8C is a diagram illustrating forces applied to the blocking portion 162 under circumstances such as the ones illustrate in FIG. 8B providing actuation lockout.

FIG. 8C is a diagram illustrating forces applied to the blocking portion 162 under circumstances such as the ones illustrate in FIG. 8B. The components of a reaction force FR provided by the edge surface of the port wall portion 120 are illustrated in arrows in FIG. 8C. In FIG. 8C, the edge surface of the port wall portion 120 is shown contacting the rearward surface 180 of the spring member 164 at a point of tangency. A tangent line TAN is shown extending through the point of tangency in FIG. 8C. As illustrated in FIG. 8C, the reaction force FR provided by the edge surface of the port wall portion 120 may be resolved into a downward force component FD and a starboard force component FT.

In the embodiment of FIG. 8C, the surface 180 of the spring member 164 is sloped so that the reaction force FR provided by the edge surface of the port wall portion 120 will has a starboardly directed component, such a starboard force component FT shown in FIG. 8C.

In some useful embodiments, the rearward surface 180 of the spring member 164 is a locking surface that is oriented such that the starboardly directed component of the reaction force provided by the edge surface of the port wall portion 120 urges the blocking portion to the blocking position.

In the example embodiment of FIG. 8C, the spring member 164 is part of the retention mechanism 160 having a locked state and an unlocked state. The blocking portion 162 is disposed in the blocking position when the retention mechanism 160 is in the locked state. In the embodiment of FIG. 8C, starboard force component FT has a direction causing blocking portion 162 to resist movement of blocking portion 162 from the blocking position to the non-blocking position.

Referring to FIG. 8D, blocking portion rearward facing face 178 has a recess 179 and a tab 183 to more positively lock out the release actuation mechanism when the firearm is urged rearwardly. These locking features may be displaced from the blocking portion, for example on an intermediate portion of the spring member, by way, for example, with a hook portion 193 integral with the spring member that engages a tab 199 that is fixed with respect to the holster body when the spring member moves forwardly.

Figures 9A, 9B, 9C:
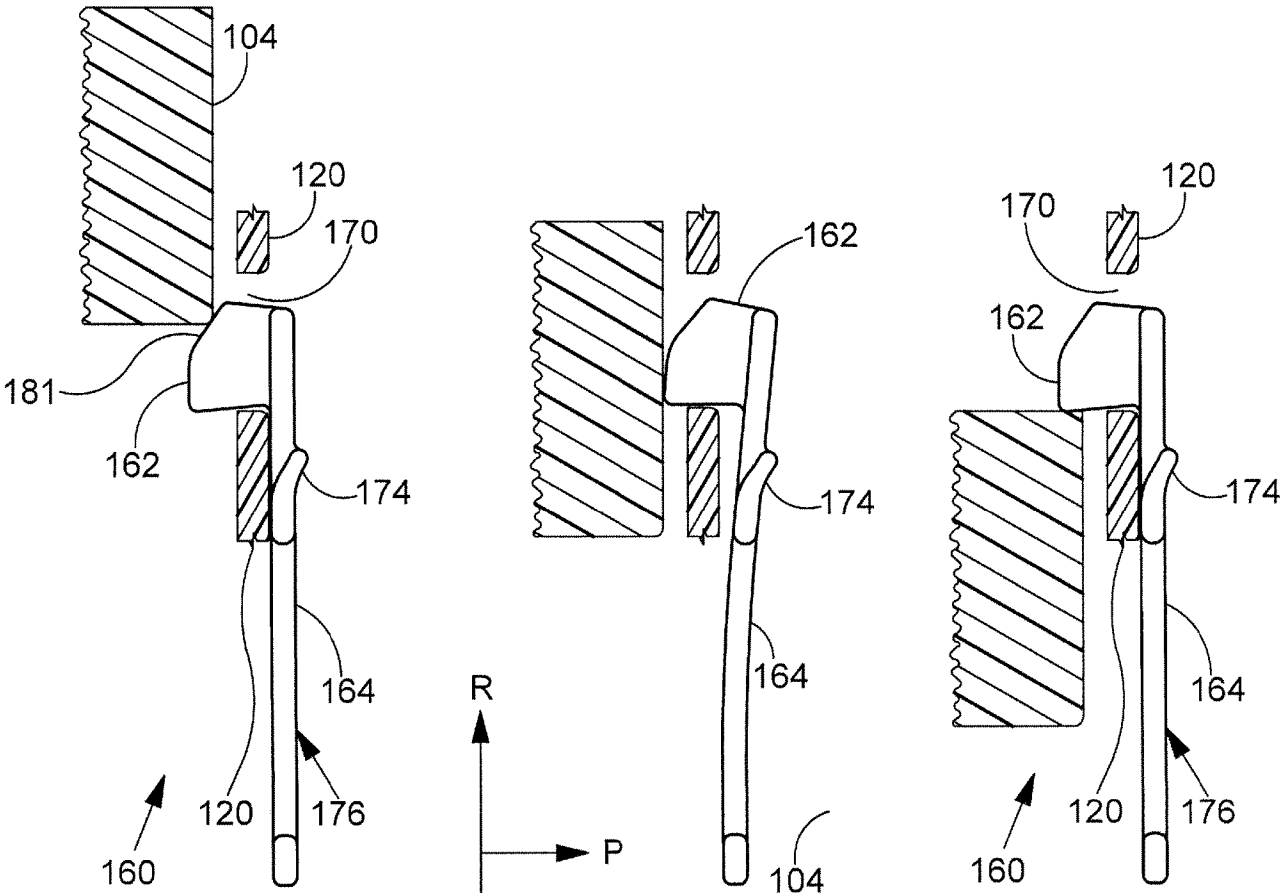
FIG. 9A, FIG. 9B and FIG. 9C are a series of stylized front plan views illustrating a sequence of events occurring as an accessory attached to a handgun is inserted into a cavity defined by the wall of a holster.

FIGS. 9A-9C are a series of stylized front plan views illustrating a sequence of events occurring as an accessory 104 attached to a handgun (not shown in FIG. 9) is inserted into a cavity defined in part by a port wall portion 120 of a holster. The retention mechanism 160 also includes the accessory 104 and a spring member 164. In the embodiment of FIG. 9, a feature and advantage of the retention mechanism 160 is automatic retention of the accessory 104 (and therefore the handgun) upon insertion of the handgun/accessory combination into a holster. The retention mechanism 160 includes a spring member 164 with a blocking portion 162 that engages a surface of the accessory 104. The blocking portion 162 includes a sloped or ramp surface 181 configured to cause deflection of the spring member 164 upon insertion of the handgun/accessory combination into the holster. In FIG. 9A, the blocking portion 162 can be seen extending through an aperture 170 defined by the port wall portion 120.

In FIG. 9A, a downward facing surface or corner of the accessory 104 is shown making initial contact with a sloped surface of the blocking portion 162 as the accessory 104 is inserted into the cavity defined in part by a port wall 120 of a holster. In the embodiment of FIG. 9A, the spring member 164 is in a normal state. In the embodiment of FIG. 9, the spring member 164 may be deflected in a cantilevered fashion by moving the accessory 104 in a forward direction D. The forward direction is illustrated with an arrow labeled "F" in FIG. 9. Additionally, a rearward direction R and a port direction P are illustrated using arrows labeled "R" and "P," respectively. As the accessory is moved in the forward direction, the accessory 104 acts on the sloped surface of the blocking portion 162 to urge the blocking portion 162 in the port direction.

FIG. 9B illustrates the position of the blocking portion 162 after the accessory 104 has moved further in the downward direction relative to the position of the accessory 104 shown in FIG. 9A. With reference to FIG. 9B, it will be appreciated that movement of the accessory 104 in the downward direction has caused deflection of the spring member 164. The blocking portion 162 can be seen contacting a side surface of accessory 104 in FIG. 9B.

FIG. 9C is a stylized front plan view showing the blocking portion 162 disposed in the blocking position. With reference to FIG. 9C, it will be appreciated that the blocking portion 162 extends through an aperture 170 defined by the port wall portion 120 when the blocking portion 162 is disposed in the blocking position. The blocking portion 162 can be seen contacting an upwardly facing surface of the accessory 104 in FIG. 9C. When the blocking portion 162 is in the blocking position, the accessory 104 is prevented from moving in the rearward direction R.

Figure 10:
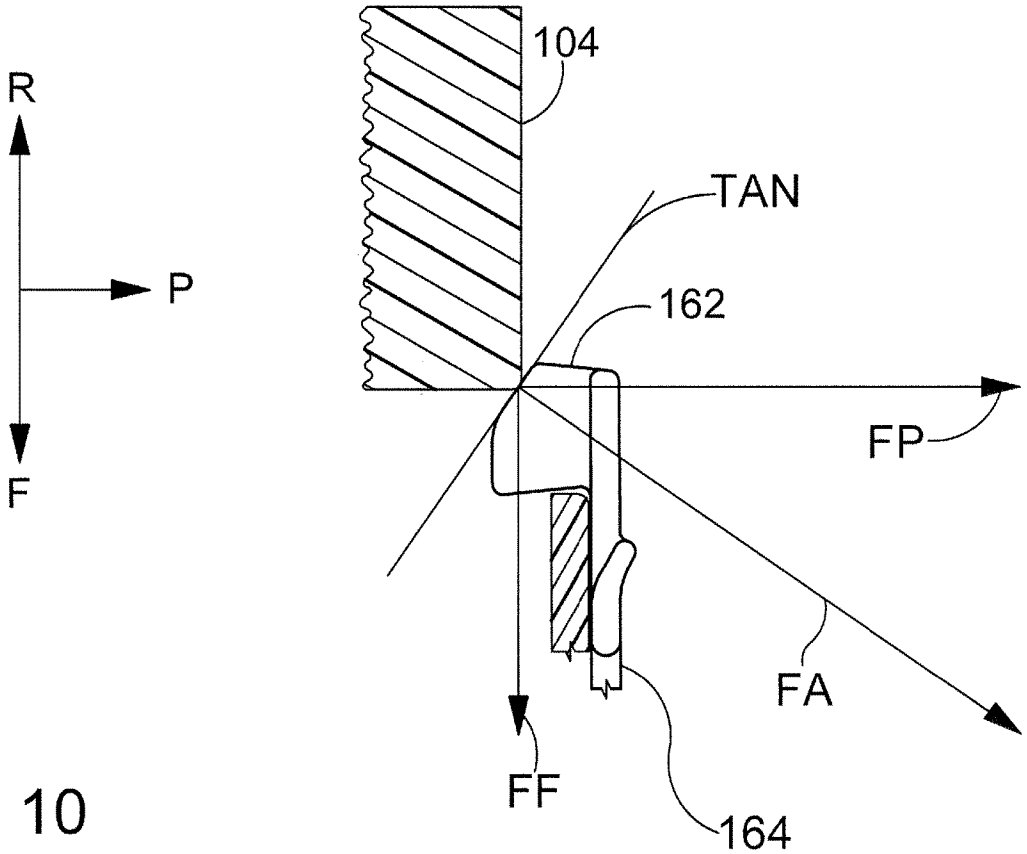
FIG. 10 is a diagram illustrating forces applied to the blocking portion of a retention mechanism during a sequence of events such as the events illustrated in FIG. 9.

FIG. 10 is a diagram illustrating forces applied to the blocking portion 162 during a sequence of events such as the events illustrated in FIGS. 9A-9C. In FIG. 10, the accessory 104 is shown contacting the sloped surface of the blocking portion 162 at a point of tangency. A tangent line TAN is shown extending through the point of tangency in FIG. 10. An accessory force FA applied to the sloped surface of the blocking portion 162 is illustrated using an arrow in FIG. 10. As illustrated in FIG. 10, the accessory force FA may be resolved into a downward force component FD and a port force component FP. In the embodiment of FIG. 10, the port force component FP acts to deflect the spring member of the spring member 164 in a cantilevered fashion as a downward facing surface of the accessory 104 slides along the sloped surface of the blocking portion 162. The blocking portion 162 moves in a portward direction as the spring member of the spring member 164 is deflected.

Figure 11:
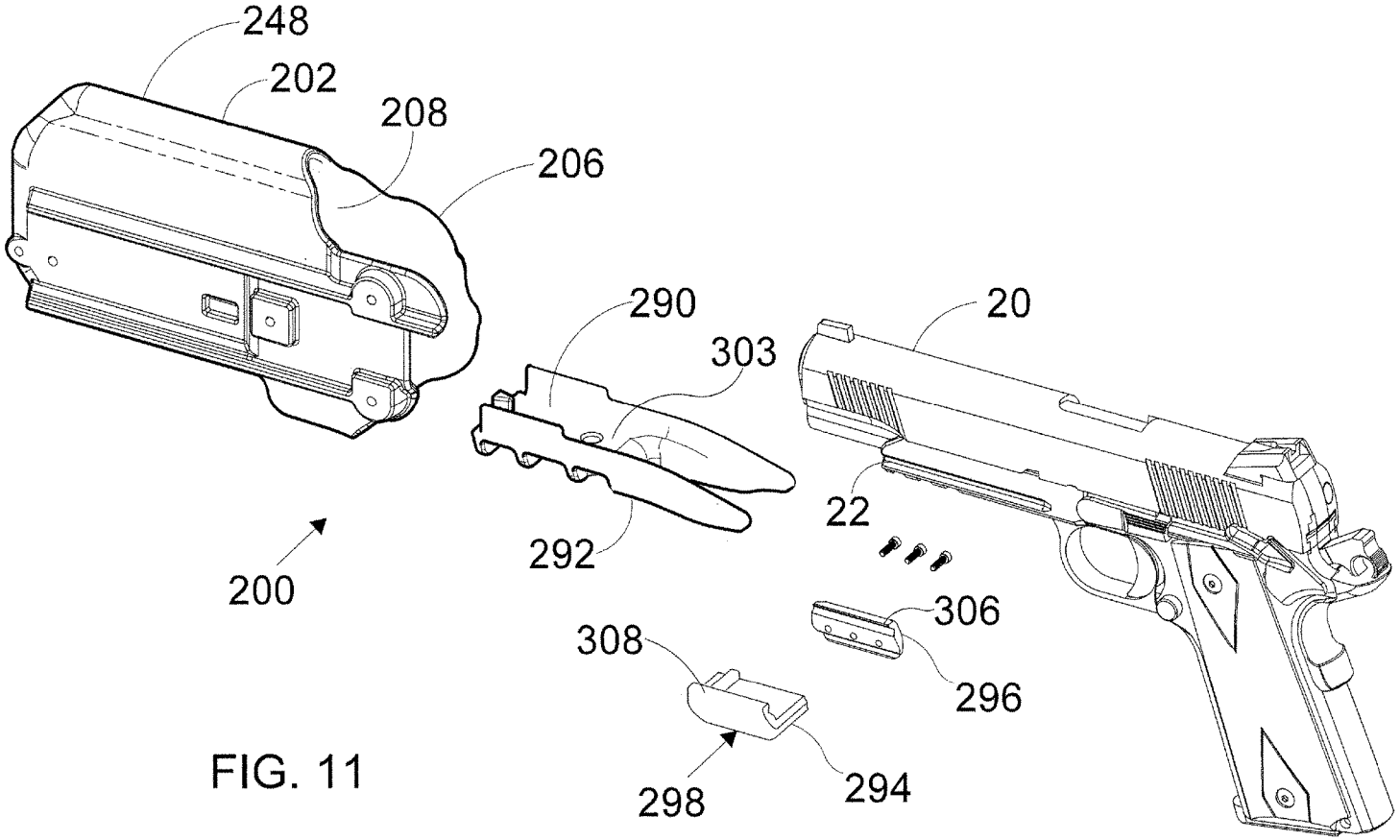
FIG. 11 is an exploded perspective view showing a universal holster system in accordance with the detailed description.
Figure 12:
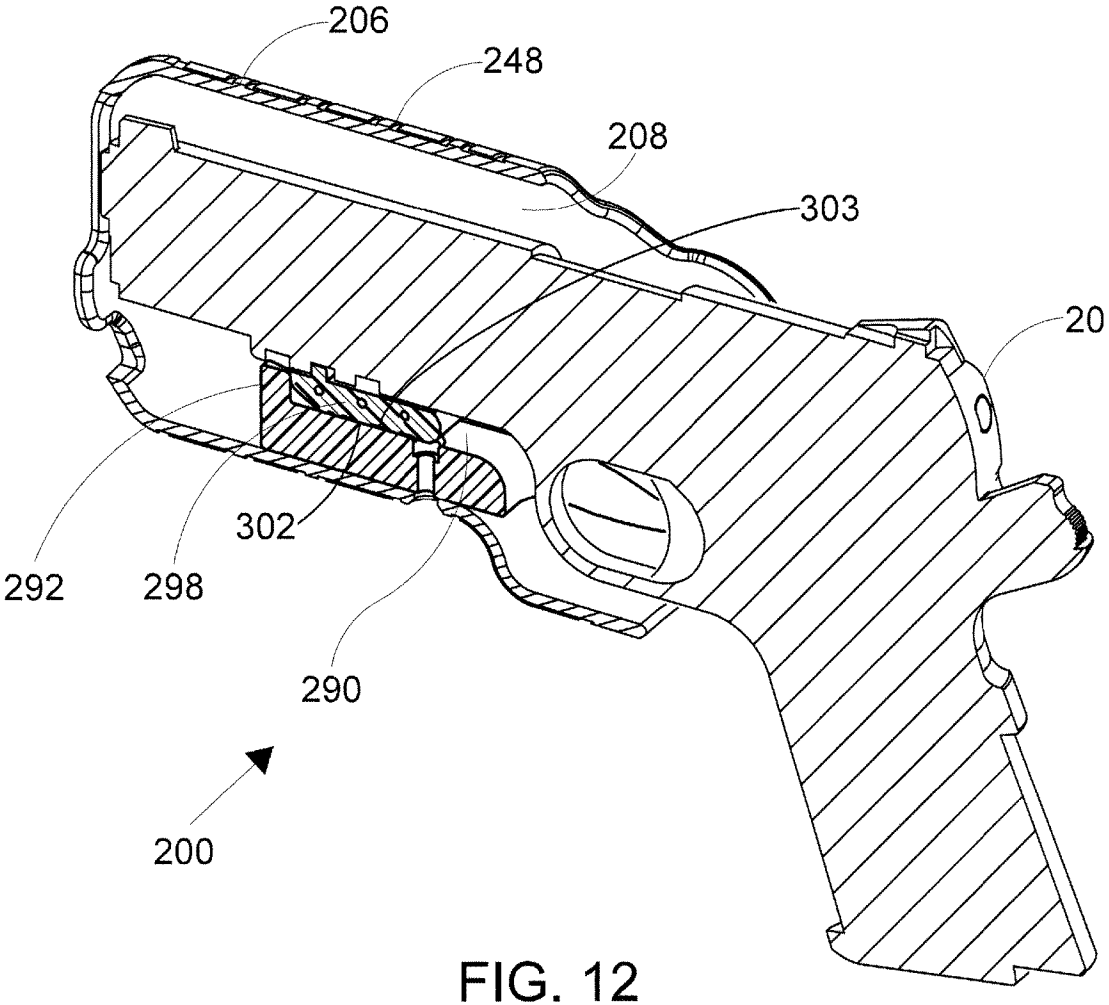
FIG. 12 is a cross-sectional view further illustrating the holster system shown in FIG. 11.
Figure 13:
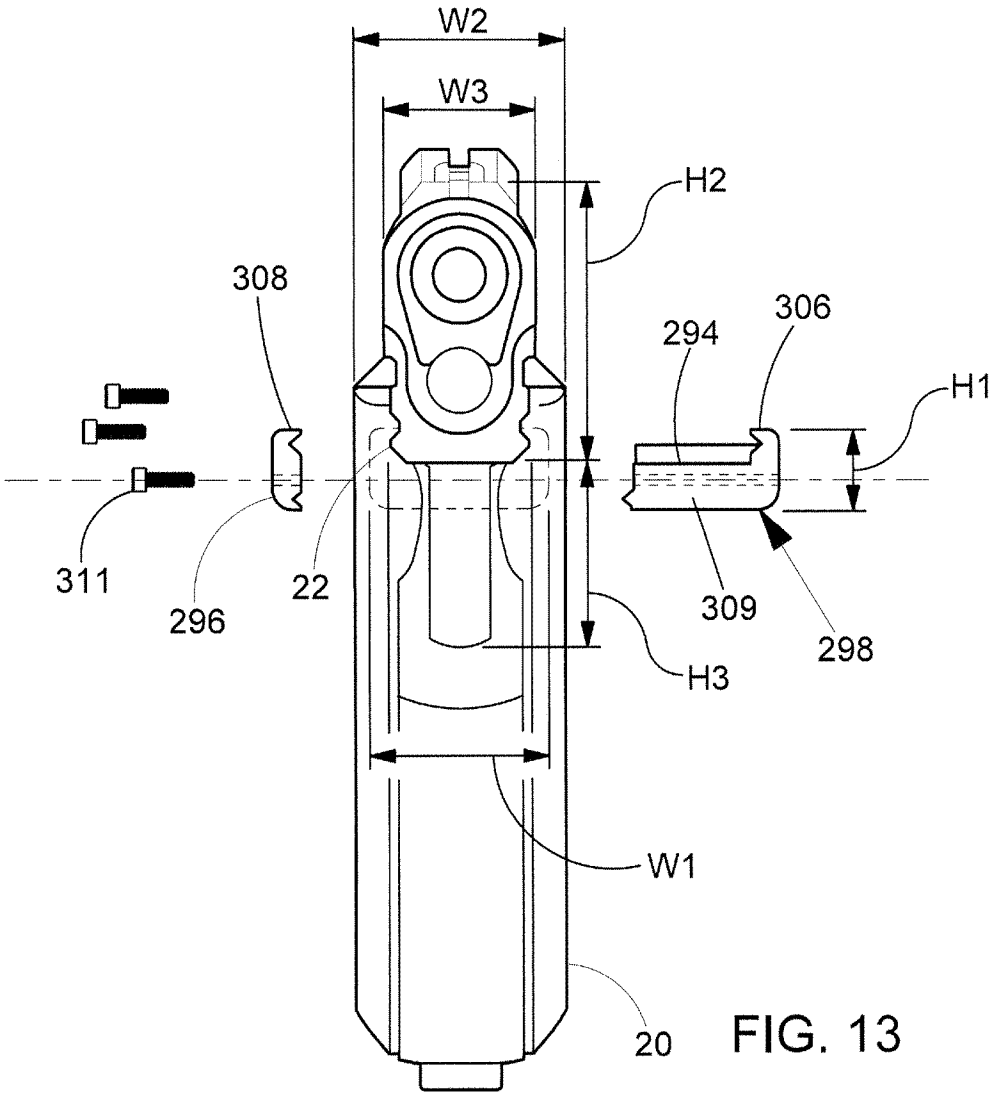
FIG. 13 is an exploded plan view illustrating a dummy accessory configured to be fixed to a mounting rail of a handgun.

Referring to FIGS. 11-13, a universal holster system 200 comprises a holster 202 and an interface only dummy accessory 298 configured to be fixed to a mounting rail 22 of a handgun 20. The "dummy" accessory may be nonfunctional, other than being an interface-only accessory. A feature and advantage of embodiments of the holster system 200 includes providing a universal holster system that allows a single holster to be utilized with various makes and models of handgun with minimal size and weight accessory. In these embodiments, dummy accessory 298, is used as the sole or primary interface with the holster. The holster partially encloses the handgun while leaving a predetermined clearance around the handgun. The clearance around the handgun allows a single holster system to be utilized with various makes and models of handgun.

The dummy accessory may interface with the ribs of the holster body at the accessory's shoulders at the clamp portions as described in the embodiments associated with FIGS. 1-4.

The holster 202 of the holster system 200 has a holster body 248 having a wall 206 defining a cavity 208. The holster system 200 also includes an adaptor 292 that is configured to be received in the cavity 208 defined by the wall 206 of the holster body 248. The adaptor 292 defines a pocket 290 that is dimensioned to receive the dummy accessory 298 by the bottom facing surface 302 engaging the upwardly facing surface 303 of the adaptor 292. The dummy accessory 298 includes a main portion 294 and a cap 296. The cap 296 may be fixed to the main portion 294 using a plurality of screws. The mounting rail 22 of the handgun 20 may be clamped between the cap 296 and the main portion of the dummy accessory 298.

The adaptor 292 is disposed inside the cavity 208 defined by the wall 206 of the holster body 248. The adaptor 292 may be fixed to the wall 206 of the holster body 248, for example, with one or more screws. In the embodiment of FIG. 12, a portion of a handgun 20 with a dummy accessory 298 fixed thereto has been inserted into the cavity 208 defined by the wall 206 of the holster body 248. In FIG. 12, the dummy accessory 298 can be seen resting in the pocket 290 defined by the adaptor 292.

FIG. 13 is an exploded plan view illustrating a dummy accessory 298 configured to be fixed to a mounting rail 22 of a handgun 20. The dummy accessory 298 includes a main portion 294 and a cap 296. The accessory has two clamp portions 306, 308 with one clamp portion 306 integral with the body 309 of the accessory and the other clamp portion 308 movable and tightenable with respect to the body 309. The cap 296 may be fixed to the main portion 294 using a plurality of screws 311. The mounting rail 22 of the handgun 20 may be clamped between the cap 296 and body portion of the dummy accessory 298.

In embodiments, the accessory 104, 309, has a maximum width, taken in a port-starboard direction of W1. The maximum width of the handgun is illustrated as dimension W2. In embodiments, the dimension of W2 is greater than W1. In embodiments, the handgun has a maximum slide width of dimension W3 and the maximum width of the dimension W1 of the accessory is no more than 20% greater than the maximum width dimension of the slide.

In embodiments, the accessory has a maximum height dimension H1, and the slide has a maximum height dimension H2, and H1 is 30% or less than H2. In other embodiments, H1 is 40% or less of H2. In other embodiments, H1 is 25% or less of H2.

In embodiments the handgun trigger guard has a maximum height dimension of H3 and H1 is 30% or less of H3. In other embodiments H1 is 40% or less of H3.

Figure 15A:
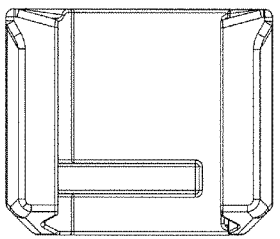
FIGS. 15A through 15G are several views showing an additional embodiment of a dummy accessory in accordance with the detailed description.
Figure 15B:
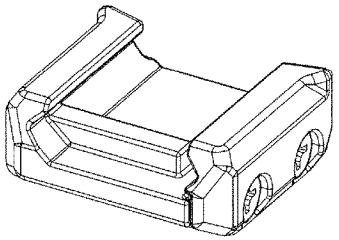
Figure 15C:
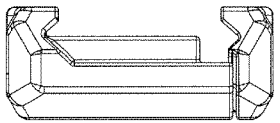
Figure 15D:
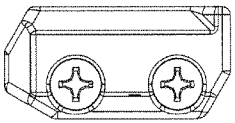
Figure 15F:
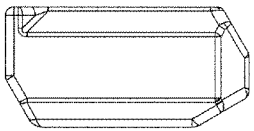
Figure 15E:
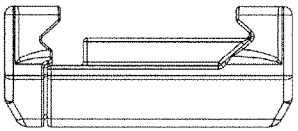
Figure 15G:
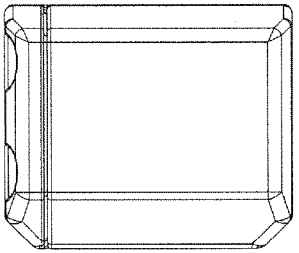

Referring to FIG. 15A through FIG. 15G, an additional embodiment of a dummy accessory is depicted. FIG. 15A through FIG. 15G may be collectively referred to as FIG. 15. The dummy accessory of FIG. 15 may form part of universal holster system in accordance with this detailed description. The universal holster system may include the dummy accessory and a holster having a retention mechanism. The dummy accessory of FIG. 15 is configured to be fixed to a mounting rail of a handgun. The dummy accessory of FIG. 15 may be nonfunctional, other than being an interface-only accessory. A feature and advantage of embodiments of a holster system in accordance with this detailed description includes providing a universal holster system that allows a single holster to be utilized with various makes and models of handgun with an accessory having minimal size and weight. In these embodiments, the dummy accessory is used as the sole or primary interface with the holster. The holster partially encloses the handgun while leaving a predetermined clearance around the handgun. The clearance around the handgun allows a single holster system to be utilized with various makes and models of handgun. FIG. 15A is a top view of the accessory. FIG. 15B is a perspective view of the accessory. FIG. 15C is a front side view of the accessory. FIG. 15D is a port side view of the accessory. FIG. 15E is a rear side view of the accessory. FIG. 15F is a starboard side view of the accessory. FIG. 15G is a bottom view of the accessory.

Figure 16A:
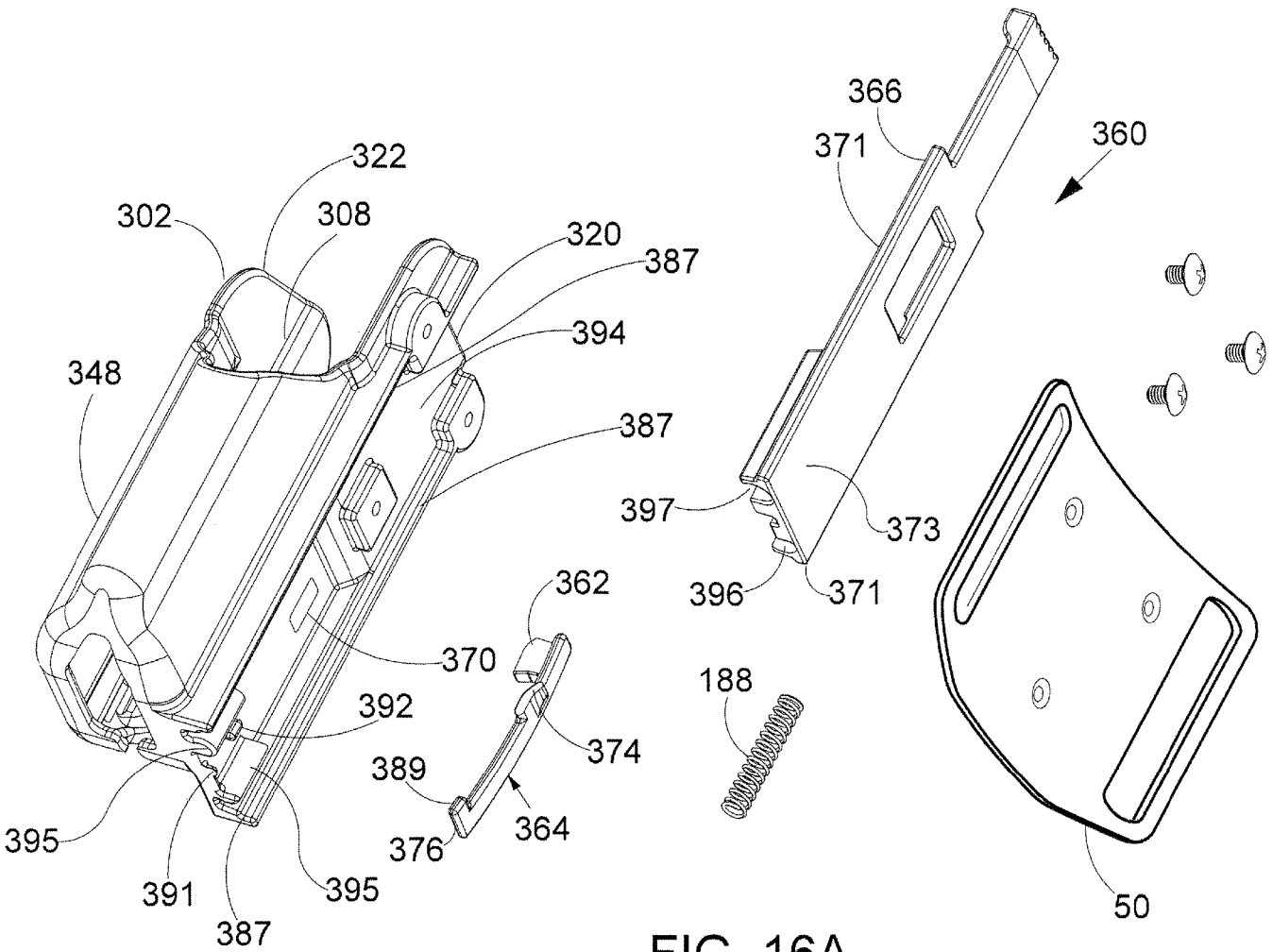
FIGS. 16A and 16B are exploded perspective views depicting an additional embodiment of a holster assembly in accordance with the detailed description.
Figure 16B:
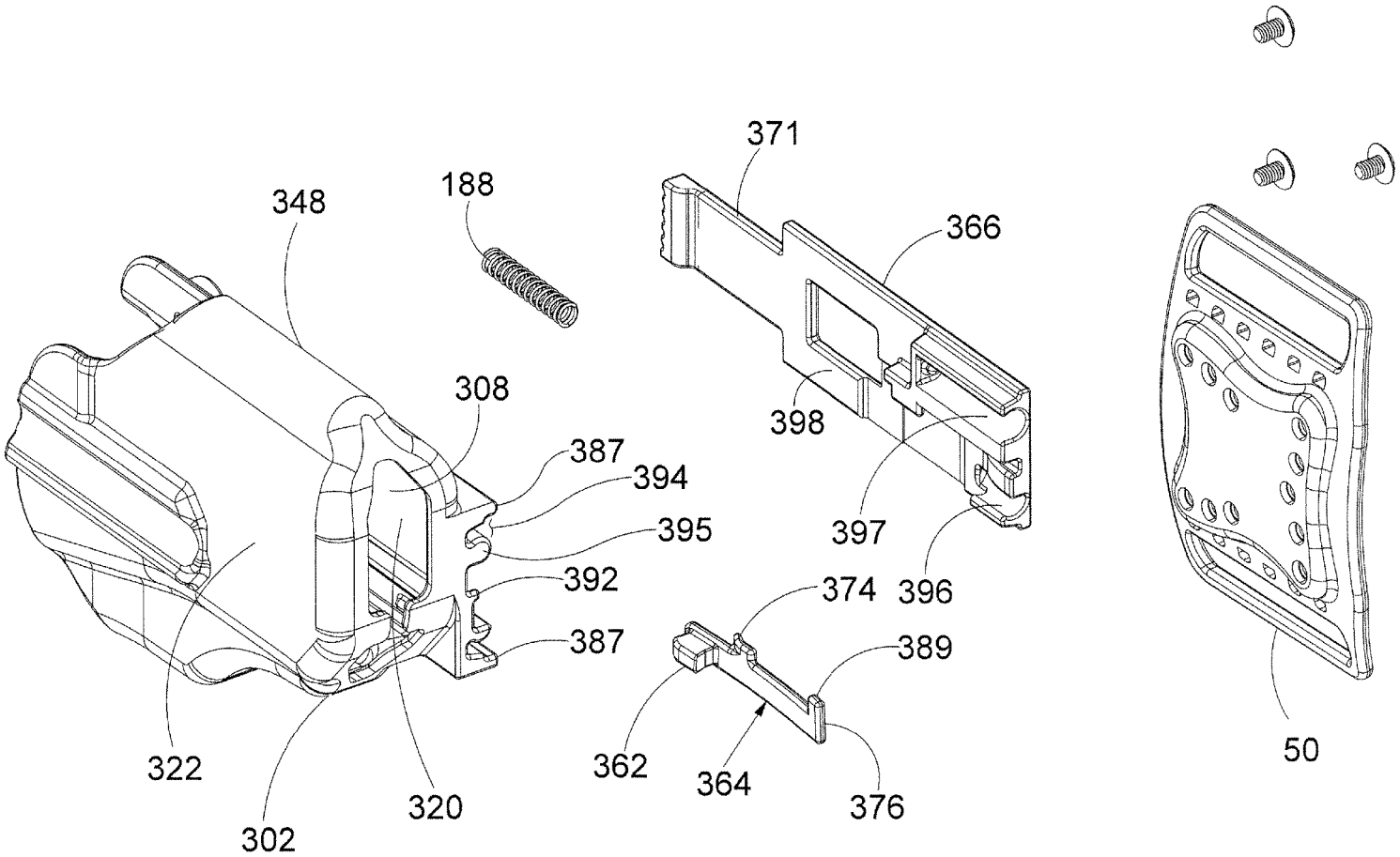
Figure 16C:
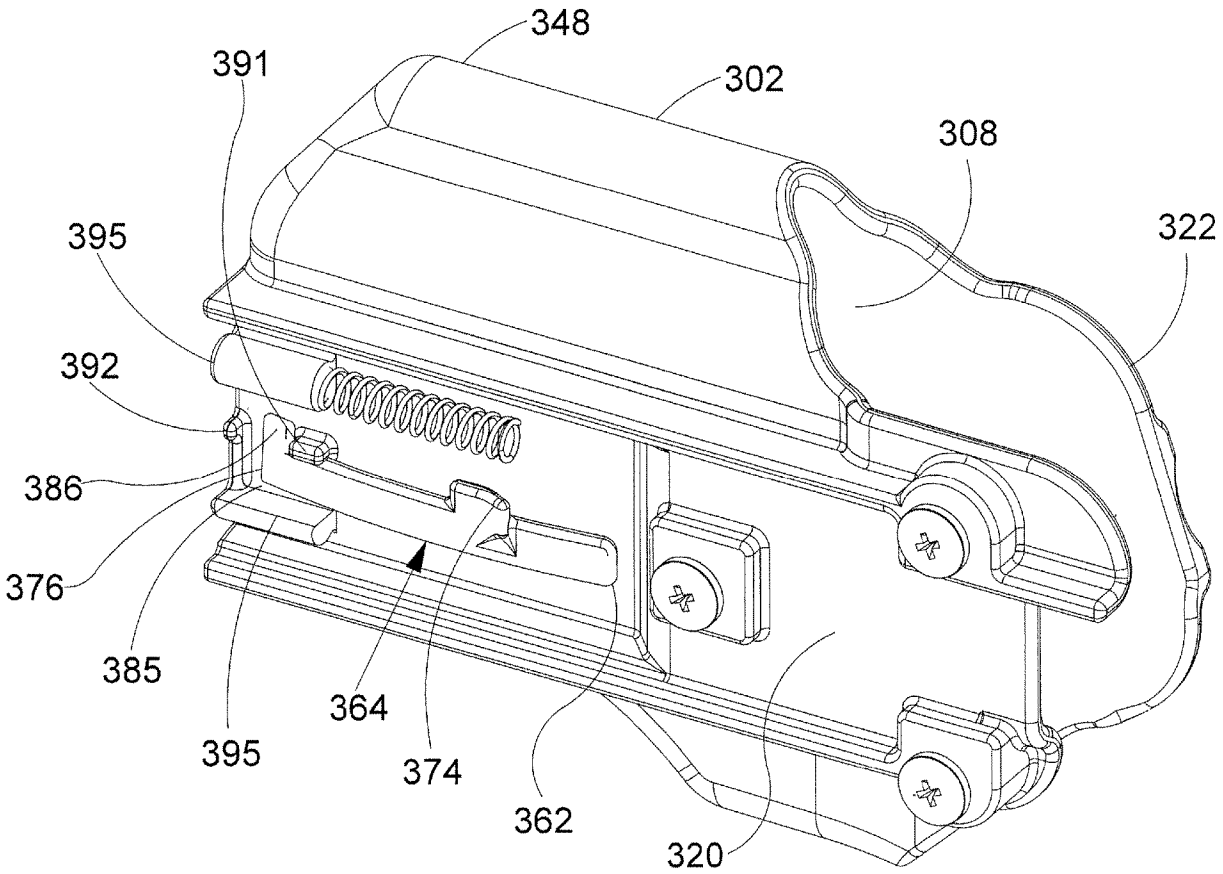
FIG. 16C is a perspective view showing the holster assembly of FIGS. 16A and 16B in a partially assembled state.

Referring to FIGS. 16A, 16B, and 16C, an additional embodiment of a holster assembly 382 is depicted. The holster assembly 382 may be used with a handgun while an interface only dummy accessory, such as the dummy accessory shown in FIG. 15A through FIG. 15G is fixed to a mounting rail of the handgun. The holster assembly 382 includes a holster 302 and a retention mechanism 360. The holster 302 has a holster body 348 with a port wall portion 320 and an opposite starboard wall portion 322. The walls of the holster body 348 define a cavity 308. The retention mechanism 360 primarily comprises a spring member 364 and elongate sliding member 366. The spring member 364 has a forward end 376, a protrusion with a ramp 374, a blocking portion 362, and a tab 389. In the embodiment of FIGS. 16A and 16B, the spring member 364 is in a relaxed state with no external forces acting on it.

When the assembly 382 is in an assembled state, a forward portion of the spring member 364 is held between the port wall portion 320 and the elongate sliding member 366 so that the spring member 364 may be deflected in a cantilevered fashion. In embodiments the spring member 364 can be preloaded when attached to the side wall portion so that the blocking portion exerts some pressure against the wall portion at or proximate the aperture. A blocking portion 362 is disposed at an end of the elongate spring member opposite the forward end 376. When the assembly 382 is in an assembled state, the blocking portion 362 extends through an aperture 370 defined by the port wall portion 320. The port wall portion 320 defines a slot 385 from which the spring member 364 extends. The spring member 364 may be movable forwardly and backwardly in the slot 385 with the movement being limited by the tab 389 which is disposed between a first stop surface of a first stop member 391 and a second stop surface of a second stop member 392.

An elongate sliding member 366 slidingly engages the port wall portion 320 of the holster body 348 on guides 387 that define a forward and backward extending recess or slot 394 that receives the sliding member. Ribs 395 on the port wall portion 320 cooperate with grooves 396, 397 on the inside surface 398 of the elongate sliding member 366.

A coil spring 388 extends between sliding member 366 and a spring pocket defined by the port wall portion 320 when the assembly 382 is in an assembled state. The coil spring 388 is positioned to bias the sliding member 366 in a rearward direction. With reference to FIG. 16A and FIG. 16B, it will be appreciated that assembly 382 includes a mounting plate 50. When the assembly 382 is in an assembled state the mounting plate 50 is fixed to the port wall portion 320 of the holster 302. The sliding member 366 extends between mounting plate 50 and the port wall portion 320 of the holster body 348 when the assembly 382 is in an assembled state. In the embodiment of FIG. 16A and FIG. 16B, the mounting plate 50 defines a plurality of slots that may receive a belt, straps, and/or other retaining means.

Figure 17B:
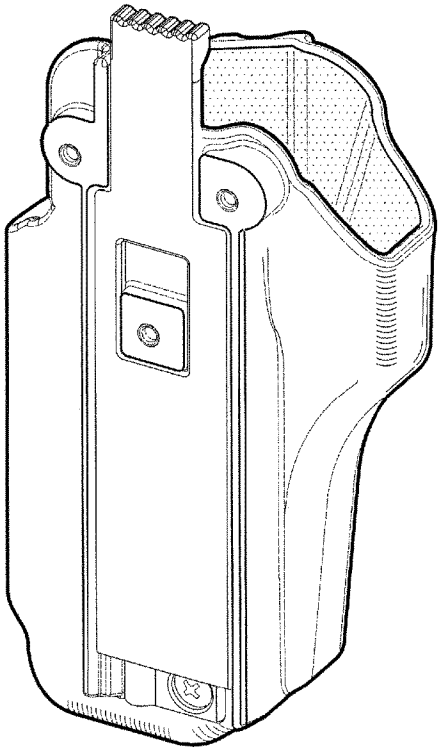
FIG. 17B is a port side perspective view of the holster of FIG. 17A.
Figure 17A:
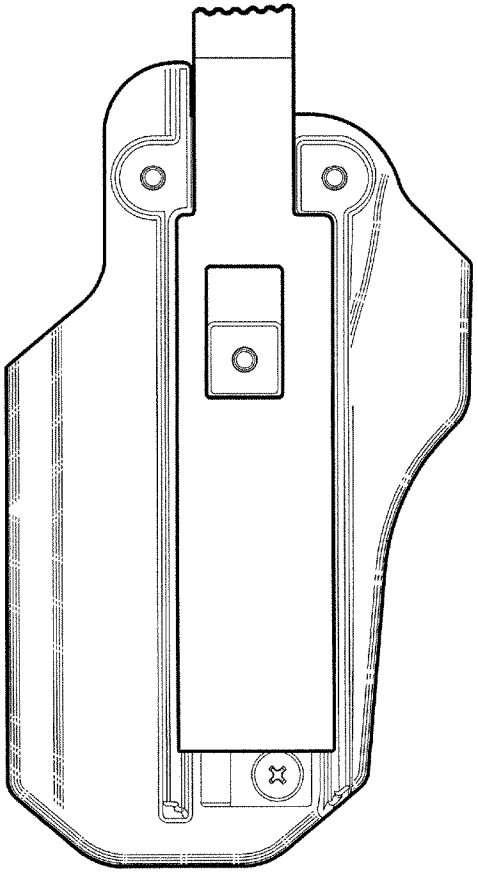
FIG. 17A is a port side elevation view of a holster.
Figure 17D:
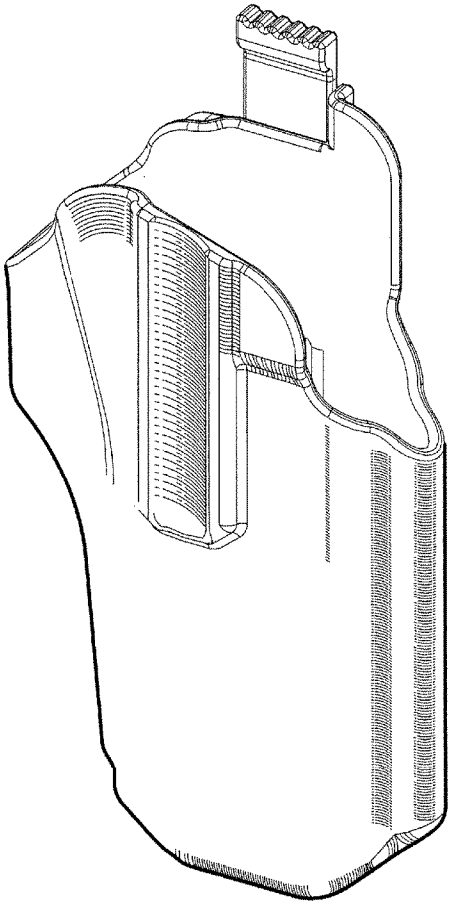
FIG. 17D is a starboard side perspective view of the holster of FIG. 17A.
Figure 17C:
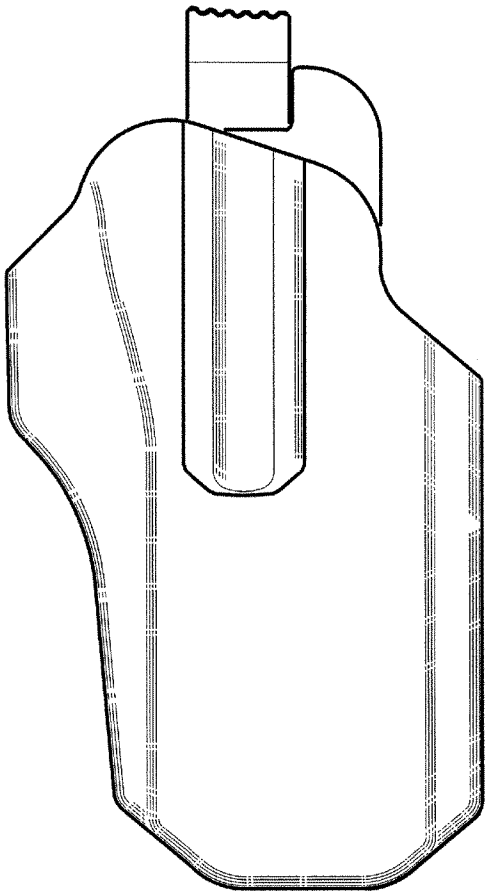
FIG. 17C is a starboard side elevation view of the holster of FIG. 17A.
Figure 17F:
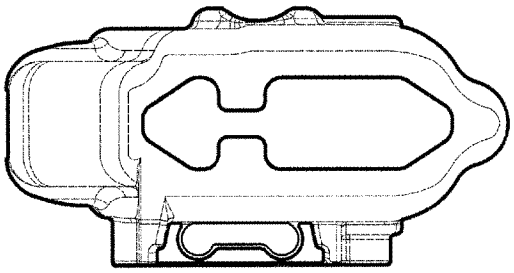
FIG. 17F is a bottom view of the holster of FIG. 17A.
Figure 17E:
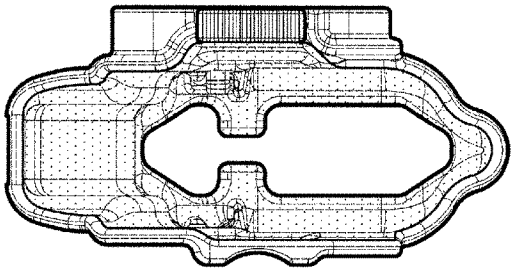
FIG. 17E is a top view of the holster of FIG. 17A.

Referring to FIG. 17A through FIG. 17F, an additional embodiment of a holster is depicted. FIG. 17A through FIG. 17F may be collectively referred to as FIG. 17. The holster of FIG. 17 may form part of universal holster system in accordance with this detailed description. The universal holster system may include a dummy accessory and a holster having a retention mechanism. The dummy accessory may be configured to be fixed to a mounting rail of a handgun. The dummy accessory may be nonfunctional, other than being an interface-only accessory. A feature and advantage of embodiments of a holster system in accordance with this detailed description includes providing a universal holster system that allows a single holster to be utilized with various makes and models of handgun with an accessory having minimal size and weight. In these embodiments, the dummy accessory is used as the sole or primary interface with the holster. The holster partially encloses the handgun while leaving a predetermined clearance around the handgun. The clearance around the handgun allows a single holster system to be utilized with various makes and models of handgun. FIG. 17A is a port side elevation view of a holster. FIG. 17B is a port side perspective view of the holster of FIG. 17A. FIG. 17C is a starboard side elevation view of the holster of FIG. 17A. FIG. 17D is a starboard side perspective view of the holster of FIG. 17A. FIG. 17E is a top view of the holster of FIG. 17A. FIG. 17F is a bottom view of the holster of FIG. 17A.

Figure 18B:
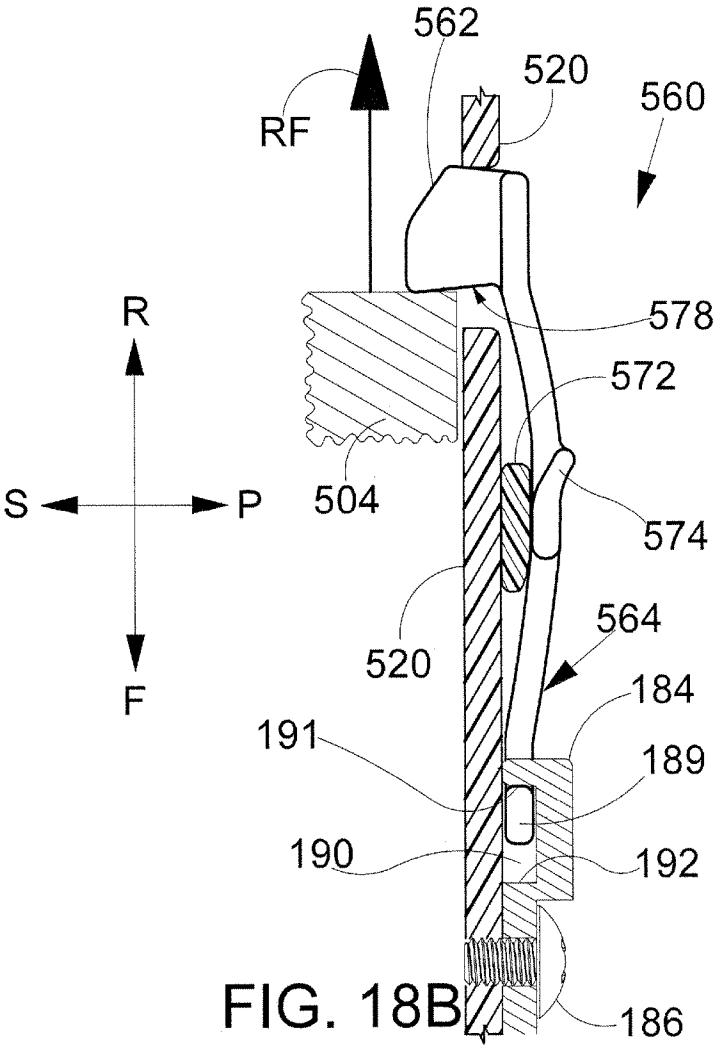
FIGS. 18A-18B are stylized front plan views showing a spring member of a retention mechanism in accordance with the detailed description.
Figure 18A:
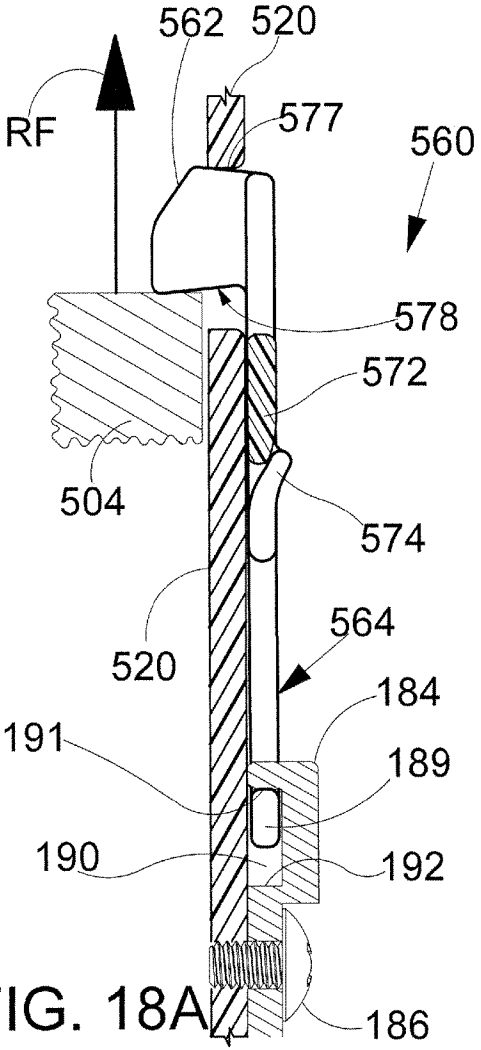

FIGS. 18A-18B are stylized front plan views showing a spring member 564 of a retention mechanism 560 in accordance with this detailed description. FIG. 18A and FIG. 18B may be collectively referred to as FIG. 18. The spring member 564 includes a blocking portion 562 that is normally movable between a blocking position and a non-blocking position. In the embodiment of FIG. 18A, the blocking portion 562 is disposed in the blocking position and has a rearward facing face 577 and a forward facing face 578.

With reference to FIG. 18A, it will be appreciated that the blocking portion 562 extends through an aperture 570 defined by the port wall portion 520 when the blocking portion 562 is disposed in the blocking position. The blocking portion 562 can be seen contacting a rearwardly facing surface of the accessory 504 in FIG. 18A. When the blocking portion 562 is in the blocking position, the accessory 504 is prevented from moving in a rearward direction R. In FIG. 18, a rearward direction R, a forward direction F, and a starboard direction S are illustrated using arrows labeled R, F and S, respectively.

In the embodiment of FIG. 18, a rearwardly directed force RF has been applied to the accessory 504. This may occur, for example, when an assailant is attempting to pull a police officer's handgun out of its holster. With reference to FIG. 18, it will be appreciated that the application of the upwardly directed pulling force RF to the accessory 504 is causing a rearward facing surface 577 of the spring member 564 to contact an edge surface of the port wall portion 520 that defines the aperture 570. When this is the case, the edge surface of the port wall portion 520 provides a reaction force that stops the movement of the spring member 564. In the embodiment of FIG. 18, the rearward facing surface 577 of the spring member 564 is sloped so that the reaction force provided by the edge surface of the port wall portion 520 will have a starboardly directed component. In some useful embodiments, the rearward facing surface 577 of the spring member 564 is oriented such that the starboardly directed component of the reaction force provided by the edge surface of the port wall portion 520 resists or prevents release of the retention mechanism 560 while rearward or pulling forces are being applied to the handgun (and thus the accessory 504).

The spring member 564 of FIG. 18 is part of a retention mechanism 560. The retention mechanism 560 also comprises a sliding member including a cam portion 572. A cross-sectional depiction of the cam portion 572 is included in FIG. 18A and FIG. 18B. In FIG. 18A, the surface of the cam portion 572 is shown making contact with the surface of the ramp portion 574 of the spring member 564. During normal operation of the embodiment shown in FIG. 18, the spring member 564 may be deflected in a cantilevered fashion by moving the cam portion 572 in a forward direction F. In the embodiment of FIG. 18, however, the rearward facing surface 577 of the spring member 564 is oriented such that the starboardly directed component of the reaction force provided by the edge surface of the port wall portion 520 resists or prevents release of the retention mechanism 560 while rearward or pulling forces (such as force RF) are being applied to the handgun (and thus the accessory 504).

The blocking portion 562 and the cam portion 572 can be seen in both FIG. 18A and FIG. 18B. By comparing FIG. 18B and FIG. 18A, it will be appreciated that the blocking portion 562 has moved in the port direction P the cam portion 572 has been moved in a downward direction relative to the position of the cam portion 572 shown in FIG. 18A. In the illustrative embodiment of FIG. 18B, the forces applied to the ramp portion 574 by the cam portion 572 have not caused the blocking portion 562 to move in a port direction P as the cam portion 572 is moved in a forward direction F. Instead, the forces applied to the ramp portion 574 by the cam portion 572 as the cam portion 572 is moved in the forward direction F have caused the spring member 564 to deflect or bow.

In some useful embodiments, the spring member 564 is dimensioned and configured so that forces applied to the ramp portion 574 by the cam portion 572 as the cam portion 572 is moved in the forward direction F cause the spring member 564 to deflect or bow rather than bending in a cantilevered fashion while rearward or pulling forces are being applied to the handgun (and thus the accessory 504). In an embodiment, the rearward facing surface 577 of the spring member 564 is oriented such that the starboardly directed component of the reaction force provided by the edge surface of the port wall portion 520 prevents the blocking member 562 from being moved in a port direction P. The spring member 564 deflects or bows rather than bending in a cantilevered fashion that moves the blocking member 562 in a port direction. The fact that moving the sliding member in the forward direction fails to unlock the handgun may confuse an assailant who is attempting to pull a police officer's handgun out of its holster.

Figure 19A:
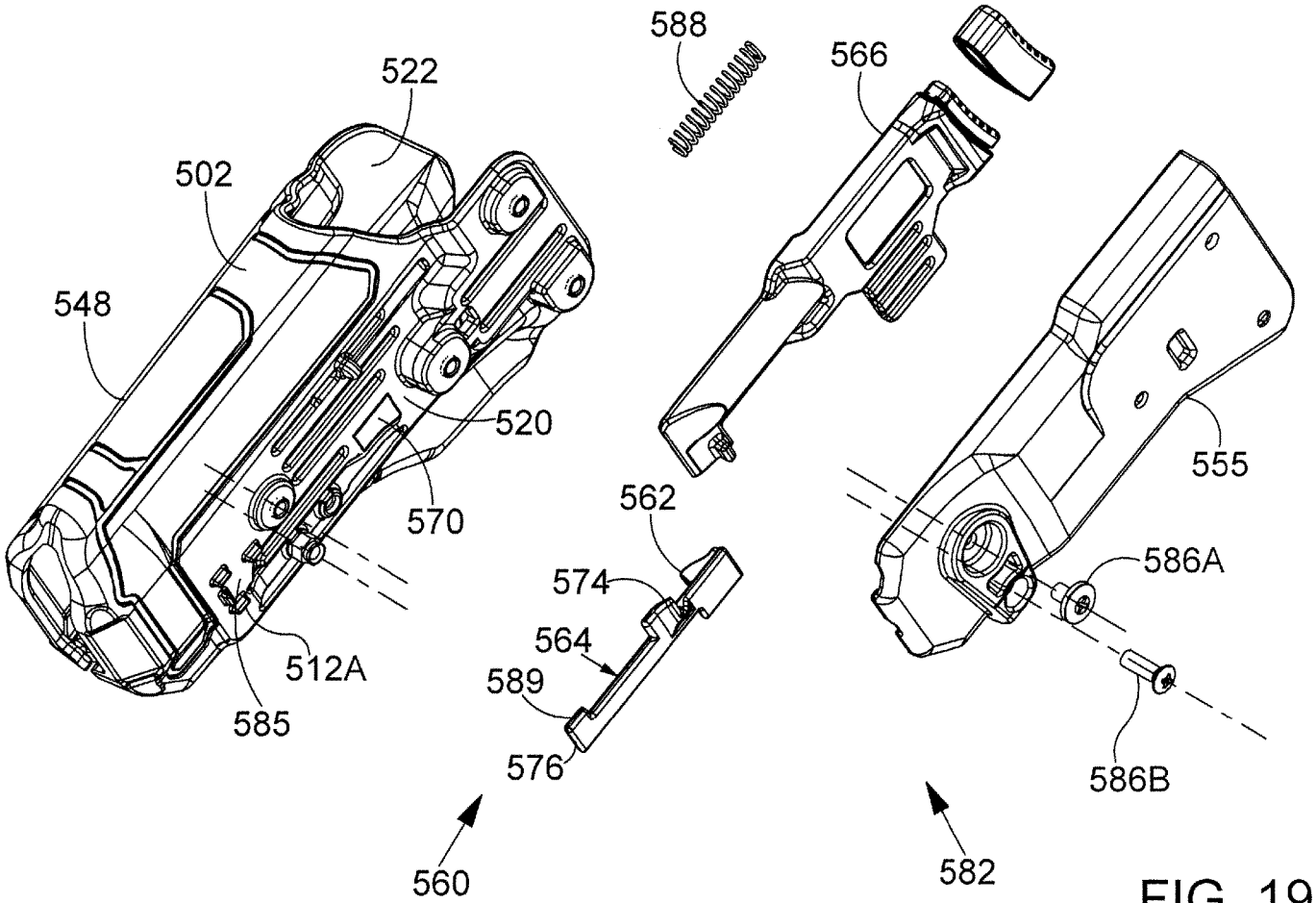
FIGS. 19A and 19B are exploded perspective views depicting an additional embodiment of a holster assembly in accordance with the detailed description.
Figure 19B:
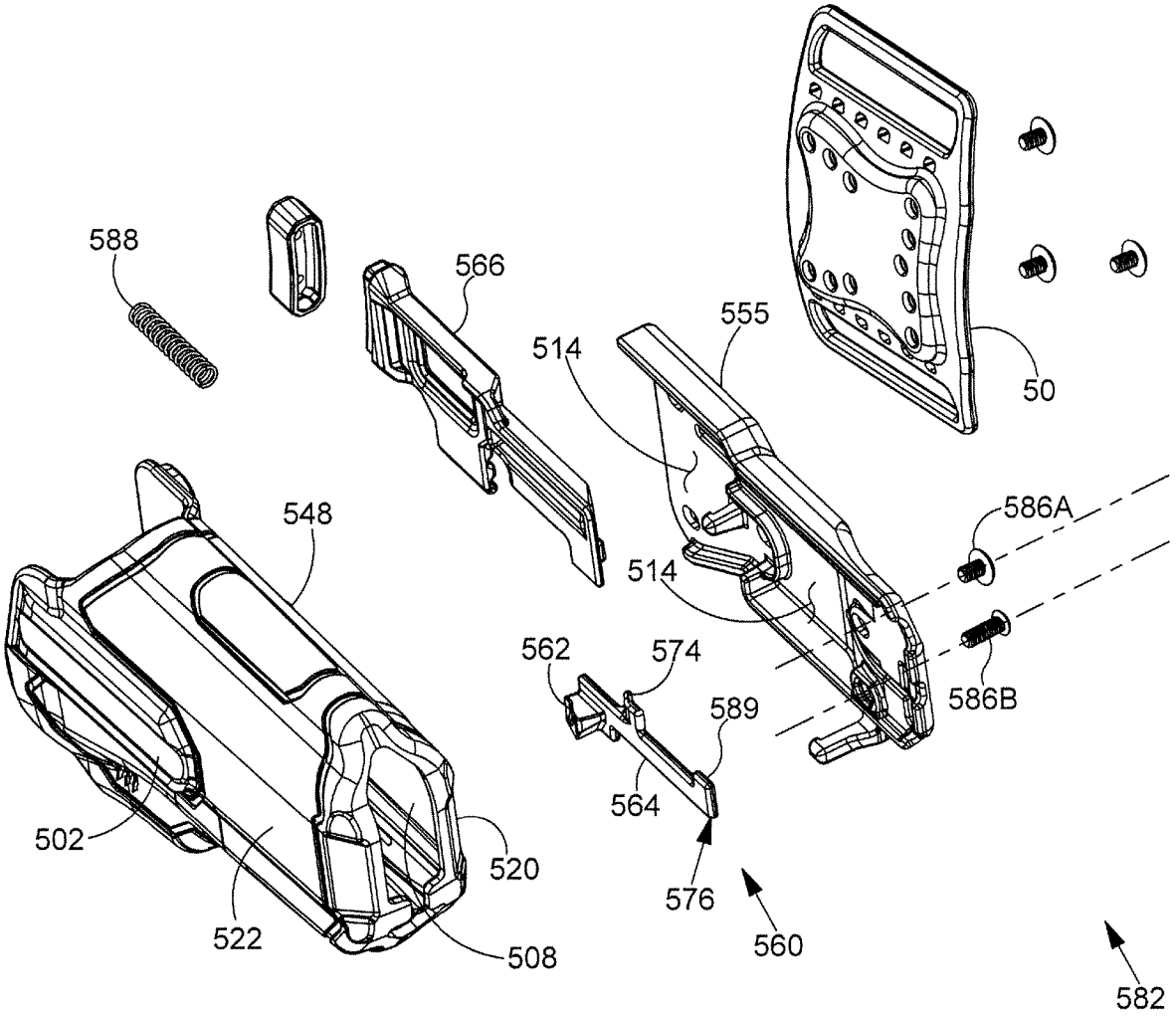
Figure 19C:
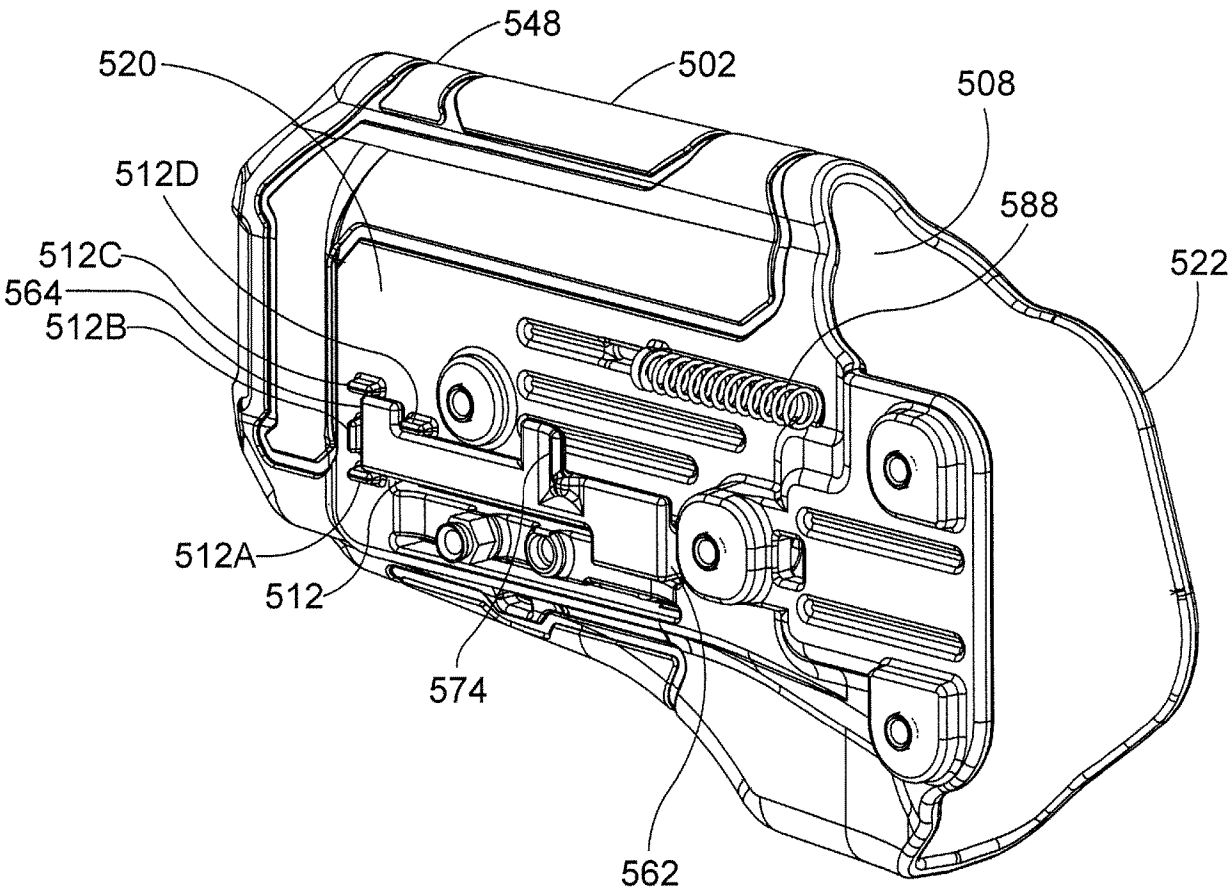
FIG. 19C is a perspective view showing the holster assembly of FIGS. 19A and 19B in a partially assembled state.

Referring to FIGS. 19A, 19B, and 19C, a holster assembly 582 including a holster 502 with a retention mechanism 560 is depicted. FIGS. 19A, 19B, and 19C may be collectively referred to as FIG. 19. The holster 502 has a holster body 548 with a port wall portion 520 and an opposite starboard wall portion 522. The walls of the holster body define a cavity 508. The retention mechanism 560 primarily comprises a spring member 564 and elongate sliding member 566. The spring member 564 has a forward end 576, a protrusion with a ramp 574 and a blocking portion 562. In the embodiment of FIG. 19, the spring member 564 is in a relaxed state with no external forces acting on it. When the holster assembly 582 is in an assembled state, a cover 555 holds one end of the spring member 564 against the port wall portion 520 so that the spring member 564 may be deflected in a cantilevered fashion. A blocking portion 562 is disposed at an end of the elongate spring member opposite the forward end 576. When the assembly 582 is in an assembled state, the blocking portion 562 extends through an aperture 570 defined by the port wall portion 520. The cover 555 is fixed to the port wall portion 520 using a first screw 586A and a second screw 586B. The port wall portion 520 includes a plurality of protrusions 512A, 512B, 512C, and 512D that define a slot 585 from which the spring member 564 extends. The cover 555 defines a chamber 514. When the assembly 582 of FIG. 19 is in an assembled state, the cover 555 is fixed to the port wall portion 520. The chamber 514 defined by the cover 555 has an opening that is covered by the port wall portion when the assembly 582 of FIG. 19 is in an assembled state The cover 555 may be fixed to the port wall portion 520, for example, using the first screw 586A and the second screw 586B.

The retention mechanism 560 is supported by the wall of the holster body 548 when the holster assembly 582 is in an assembled state. The elongate spring member 564 of the retention mechanism 560 is disposed in the chamber 514 defined by the cover 555 when the holster assembly 582 is in an assembled state. The elongate spring member 564 is secured with respect to the port sidewall portion 520 at a first end thereof when the holster assembly 582 is in an assembled state. The second end of the elongate spring member 564 fixed to a blocking portion 562. The blocking portion is positioned at an aperture 570 in the port sidewall portion 520 and is movable between a blocking position and a non-blocking position with respect to the port side wall portion 520. The retention mechanism 560 further comprises an elongate sliding member 566 extending along an exterior surface of the port sidewall portion 520 and slidable therealong when the holster assembly 582 is in an assembled state. A first portion of the elongate sliding member 566 extends into the cavity defined by the cover 555 when the holster assembly 582 is in an assembled state. The first portion of the elongate sliding member 566 is sandwiched between the cover 555 and the port side wall portion 580 when the holster assembly 582 is in an assembled state. A coil spring 588 is positioned between the sliding member 566 and the port wall portion 520 when the holster assembly 582 is in an assembled state. The coil spring 588 is positioned to bias the sliding member 566 in a rearward direction.

With reference to FIG. 19, it will be appreciated that assembly 582 includes a mounting plate 50. When the assembly 582 is in an assembled state the mounting plate 50 is fixed to the port wall portion 520 of the holster 502. The cover 555 is disposed between the mounting plate 50 and the port wall portion 520 of the holster body 548 when the assembly 582 is in an assembled state. The sliding member 566 extends between cover 555 and the port wall portion 520 of the holster body 548 when the assembly 582 is in an assembled state. The sliding member 566 extends between mounting plate 50 and the port wall portion 520 of the holster body 548 when the assembly 582 is in an assembled state. In the embodiment of FIG. 19, the mounting plate 50 defines a plurality of slots that may receive a belt, straps, and/or other retaining means.

Figure 20B:
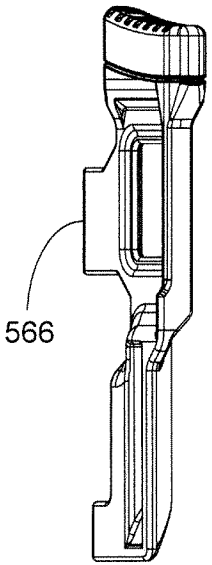
FIG. 20B is a perspective view showing a sliding member of a retention mechanism in accordance with the detailed description. The sliding member of FIG. 20B is also visible in the partially exploded perspective view of FIG. 20A.
Figure 20A:
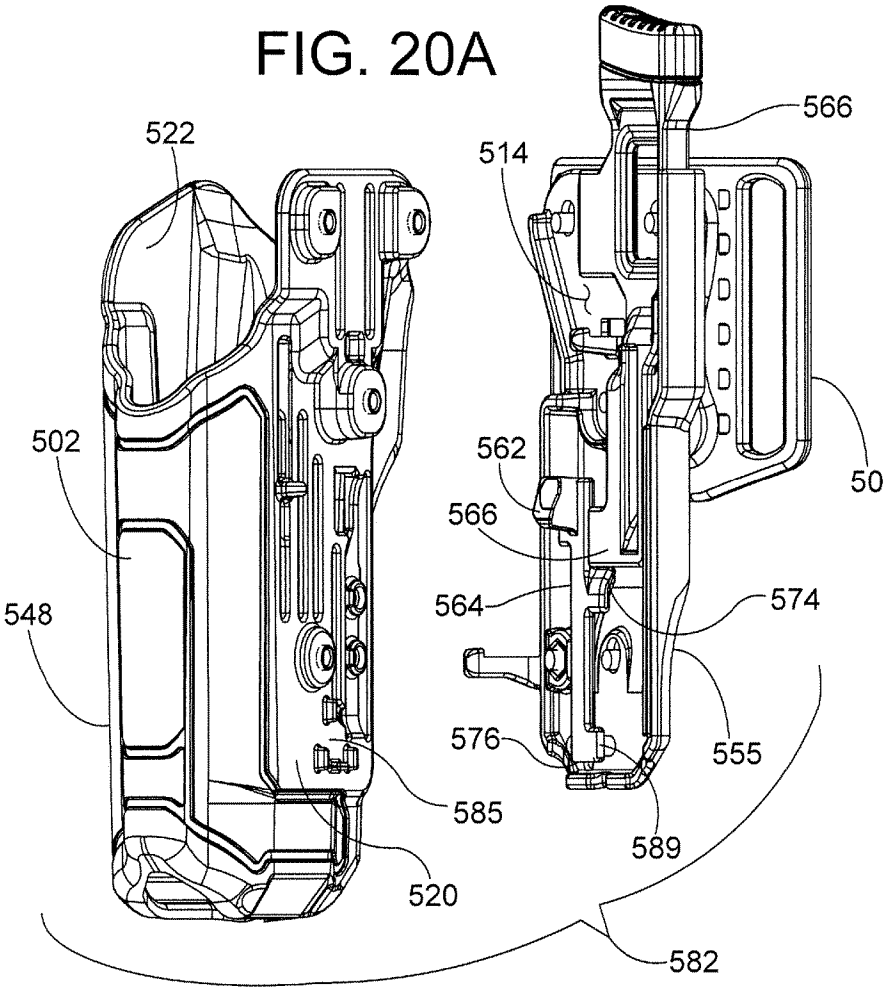
FIG. 20A is a partially exploded perspective view further illustrating the holster assembly shown in FIGS. 19A, 19B and 19C.

FIG. 20A is a partially exploded perspective view further illustrating the holster assembly 582 shown in FIGS. 19A, 19B and 19C. FIG. 20B is a perspective view showing a sliding member 566 of a retention mechanism 560 in accordance with the detailed description. The sliding member 566 of FIG. 20B is also visible in the partially exploded perspective view of FIG. 20A. FIG. 20A and FIG. 20B may be collectively referred to as FIG. 20. The holster assembly 582 comprises a holster 502 having a holster body 548 with a port wall portion 520 and an opposite starboard wall portion 522. The walls of the holster body 548 define a cavity 508.

When the assembly 582 of FIG. 20 is in an assembled state, the cover 555 is fixed to the port wall portion 520. The cover 555 defines a chamber 514. The chamber 514 defined by the cover 555 has an opening that is covered by the port wall portion 520 when the assembly 582 of FIG. 20 is in an assembled state The cover 555 may be fixed to the port wall portion 520, for example, using a first screw 586A and a second screw 586B. A retention mechanism 560 is supported by the wall of the holster body 548 when the holster assembly 582 is in an assembled state. The retention mechanism 560 comprises an elongate spring member 564 that is disposed in the chamber 514 defined by the cover 555. The spring member is secured with respect to the one of the port sidewall portion 520 at a first end thereof when the holster assembly 582 is in an assembled state.

The retention mechanism 560 primarily comprises a spring member 564 and elongate sliding member 566. The spring member 564 has a forward end 576, a protrusion with a ramp 574 and a blocking portion 562. In the embodiment of FIG. 20, the spring member 564 is in a relaxed state with no external forces acting on it. When the holster assembly 582 is in an assembled state, the cover 555 holds one end of the spring member 564 against the port wall portion 520 so that the spring member 564 may be deflected in a cantilevered fashion. A blocking portion 562 is disposed at an end of the elongate spring member 564 opposite the forward end 576. When the assembly 582 is in an assembled state, the blocking portion 562 extends through an aperture 570 defined by the port wall portion 520. The cover 555 is fixed to the port wall portion 520 using a first screw 586A and a second screw 586B.

The elongate spring member 564 extends rearwardly along an exterior surface of the port sidewall portion 520 when the holster assembly 582 is in an assembled state. The second end of the spring member 564 fixed to the blocking portion 562. The blocking portion 562 is movable between a blocking position and a non-blocking position with respect to the port side wall portion 520. The retention mechanism 560 further comprises an elongate sliding member 566 extending along an exterior surface of the port sidewall portion 520 and slidable therealong when the holster assembly 582 is in an assembled state. A first portion of the elongate sliding member 566 extends into the cavity defined by the cover 555 when the holster assembly 582 is in an assembled state. The first portion of the elongate sliding member 566 is sandwiched between the cover 555 and the port side wall portion 580 when the holster assembly 582 is in an assembled state. A coil spring 588 is positioned between the sliding member 566 and the port wall portion 520 when the holster assembly 582 is in an assembled state. The coil spring 588 is positioned to bias the sliding member 566 in a rearward direction.

With reference to FIG. 20, it will be appreciated that assembly 582 includes a mounting plate 50. When the assembly 582 is in an assembled state the mounting plate 50 is fixed to the port wall portion 520 of the holster 502. The cover 555 is disposed between the mounting plate 50 and the port wall portion 520 of the holster body 548 when the assembly 582 is in an assembled state. The sliding member 566 extends between cover 555 and the port wall portion 520 of the holster body 548 when the assembly 582 is in an assembled state. The sliding member 566 extends between mounting plate 50 and the port wall portion 520 of the holster body 548 when the assembly 582 is in an assembled state. In the embodiment of FIG. 20, the mounting plate 50 defines a plurality of slots that may receive a belt, straps, and/or other retaining means.

Figure 21A:
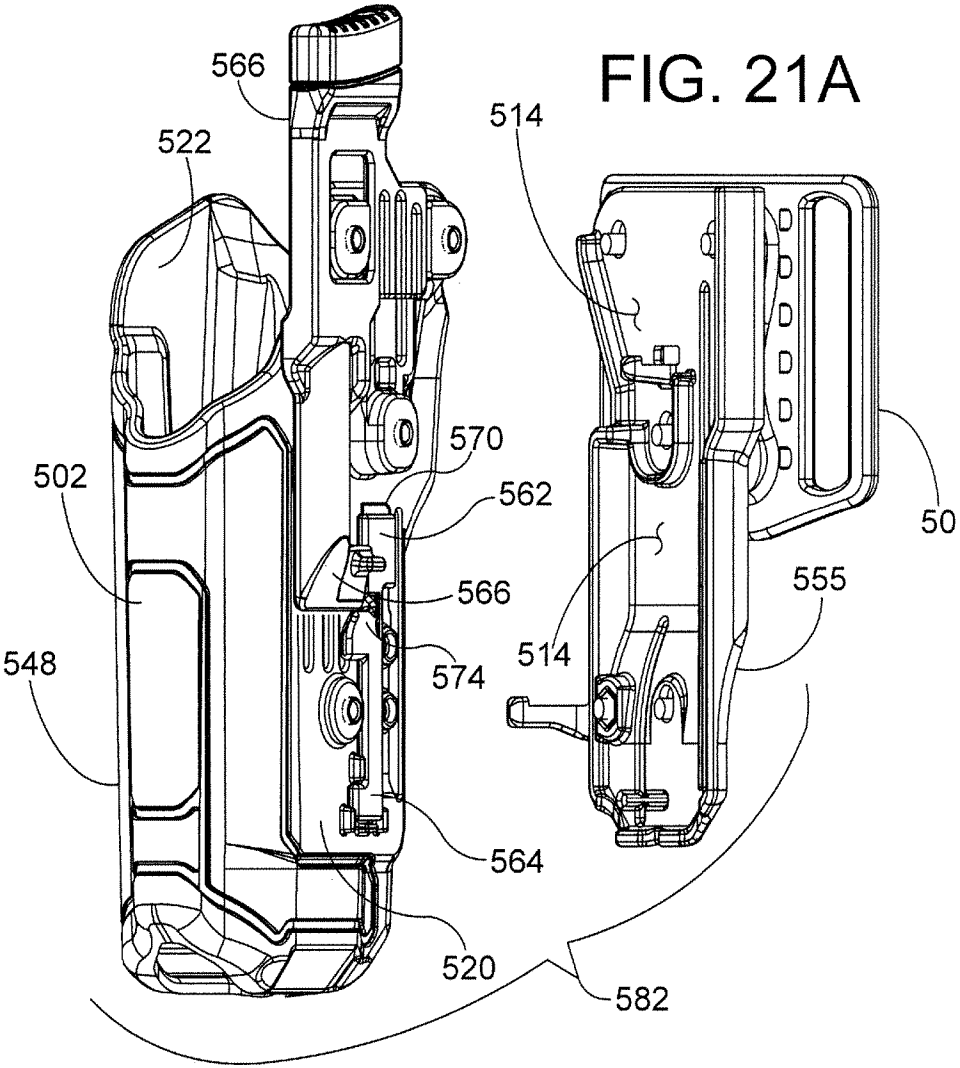
FIG. 21A is a partially exploded perspective view further illustrating the holster assembly shown in FIGS. 20A, 20B and 20C.
Figure 21B:
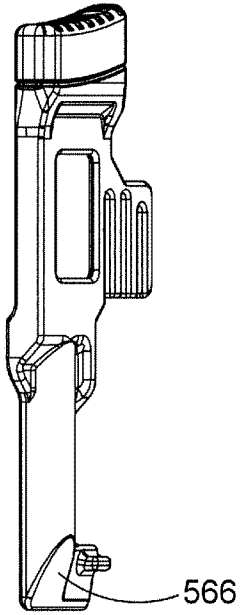
FIG. 21B is a perspective view showing a sliding member of a retention mechanism in accordance with the detailed description.

FIG. 21A is a partially exploded perspective view further illustrating the holster assembly 582 shown in FIGS. 19A, 19B and 19C. FIG. 21B is a perspective view showing a sliding member 566 of a retention mechanism 560 in accordance with the detailed description. The sliding member 566 of FIG. 21B is also visible in the partially exploded perspective view of FIG. 21A. FIG. 21A and FIG. 21B may be collectively referred to as FIG. 21. The holster assembly 582 comprises a holster 502 having a holster body 548 with a port wall portion 520 and an opposite starboard wall portion 522. The walls of the holster body 548 define a cavity 508.

When the assembly 582 of FIG. 21 is in an assembled state, the cover 555 is fixed to the port wall portion 520. The cover 555 defines a chamber 514. The chamber 514 defined by the cover 555 has an opening that is covered by the port wall portion 520 when the assembly 582 of FIG. 21 is in an assembled state The cover 555 may be fixed to the port wall portion 520, for example, using a first screw 586A and a second screw 586B. A retention mechanism 560 is supported by the wall of the holster body 548 when the holster assembly 582 is in an assembled state. The retention mechanism 560 comprises an elongate spring member 564 that is disposed in the chamber 514 defined by the cover 555. The spring member is secured with respect to the one of the port sidewall portion 520 at a first end thereof when the holster assembly 582 is in an assembled state.

The retention mechanism 560 primarily comprises a spring member 564 and elongate sliding member 566. The spring member 564 has a forward end 576, a protrusion with a ramp 574 and a blocking portion 562. In the embodiment of FIG. 21, the spring member 564 is in a relaxed state with no external forces acting on it. When the holster assembly 582 is in an assembled state, the cover 555 holds one end of the spring member 564 against the port wall portion 520 so that the spring member 564 may be deflected in a cantilevered fashion. A blocking portion 562 is disposed at an end of the elongate spring member 564 opposite the forward end 576. When the assembly 582 is in an assembled state, the blocking portion 562 extends through an aperture 570 defined by the port wall portion 520. The cover 555 is fixed to the port wall portion 520 using a first screw 586A and a second screw 586B.

The elongate spring member 564 extends rearwardly along an exterior surface of the port sidewall portion 520 when the holster assembly 582 is in an assembled state. The second end of the spring member 564 fixed to the blocking portion 562. The blocking portion 562 is movable between a blocking position and a non-blocking position with respect to the port side wall portion 520. The retention mechanism 560 further comprises an elongate sliding member 566 extending along an exterior surface of the port sidewall portion 520 and slidable therealong when the holster assembly 582 is in an assembled state. A first portion of the elongate sliding member 566 extends into the cavity defined by the cover 555 when the holster assembly 582 is in an assembled state. The first portion of the elongate sliding member 566 is sandwiched between the cover 555 and the port side wall portion 580 when the holster assembly 582 is in an assembled state. A coil spring 588 is positioned between the sliding member 566 and the port wall portion 520 when the holster assembly 582 is in an assembled state. The coil spring 588 is positioned to bias the sliding member 566 in a rearward direction.

With reference to FIG. 21, it will be appreciated that assembly 582 includes a mounting plate 50. When the assembly 582 is in an assembled state the mounting plate 50 is fixed to the port wall portion 520 of the holster 502. The cover 555 is disposed between the mounting plate 50 and the port wall portion 520 of the holster body 548 when the assembly 582 is in an assembled state. The sliding member 566 extends between cover 555 and the port wall portion 520 of the holster body 548 when the assembly 582 is in an assembled state. The sliding member 566 extends between mounting plate 50 and the port wall portion 520 of the holster body 548 when the assembly 582 is in an assembled state. In the embodiment of FIG. 21, the mounting plate 50 defines a plurality of slots that may receive a belt, straps, and/or other retaining means.

Figure 22A:
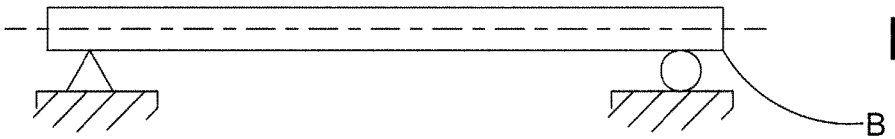
FIGS. 22A and 22B are diagrams showing a beam B in a relaxed state and in a bowed state, respectively.
Figure 22B:
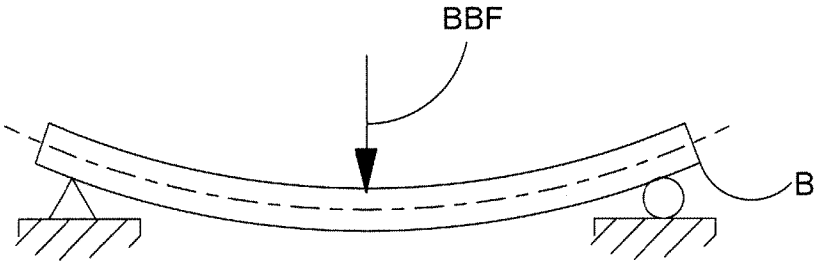

FIGS. 22A and 22B are diagrams showing a beam B. In the embodiment of FIG. 22A, the beam B is in a relaxed state with no external forces acting on it other than its own weight and forces from supports that are bearing the weight of the beam B. In the embodiment of FIG. 22B, beam B is bowing to the application of a force BFF.

Figure 23A:
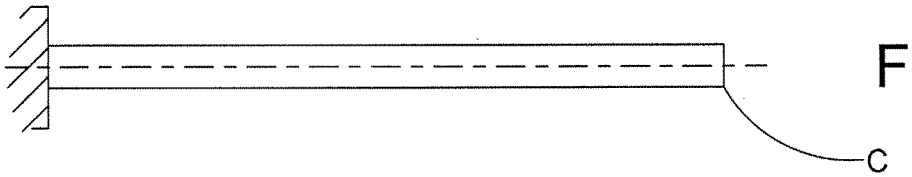
FIGS. 23A and 23B are diagrams showing a beam C in a relaxed state and in a cantilevered bending, respectively.
Figure 23B:
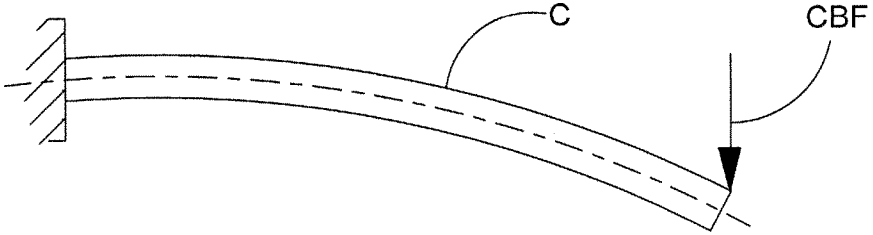

FIGS. 23A and 23B are diagrams showing a beam C. In the embodiment of FIG. 23A, the beam C is in a relaxed state with no external forces acting on it other than its own weight and forces from a support that is bearing the weight of the beam C. In the embodiment of FIG. 23B, beam C is exhibiting cantilevered bending to the application of a cantilevered bending force CBF.

Figure 24B:
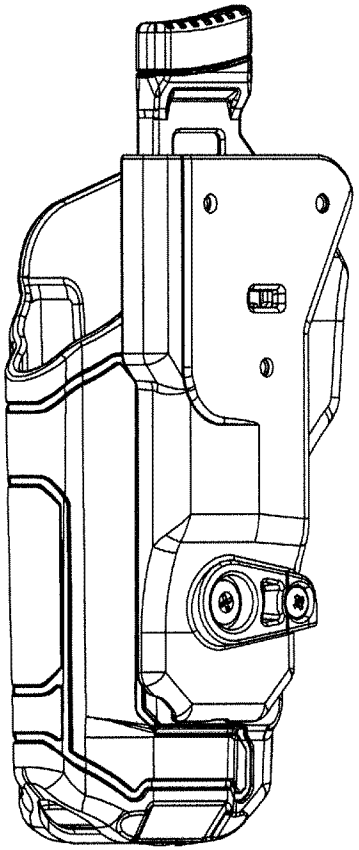
FIGS. 24A through 24F are perspective views showing the holster assembly.
Figure 24A:
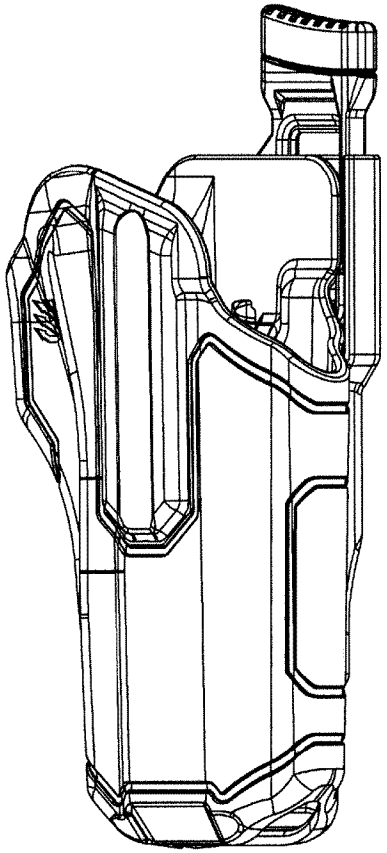
Figure 24D:
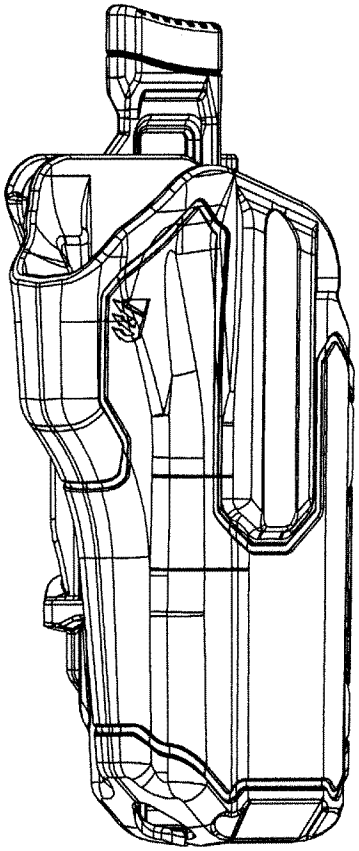
Figure 24C:
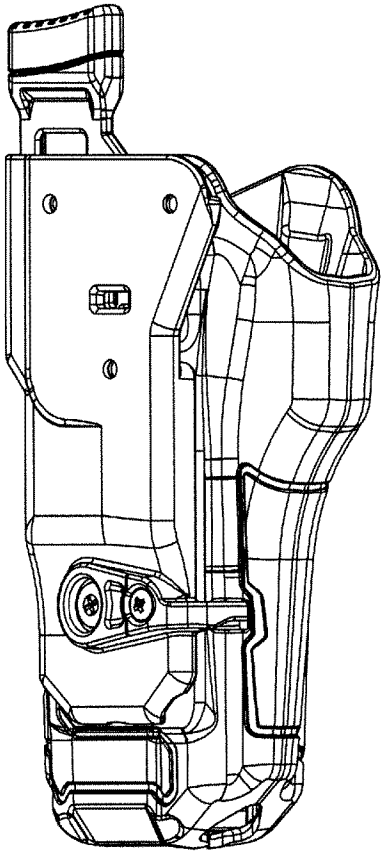
Figure 24F:
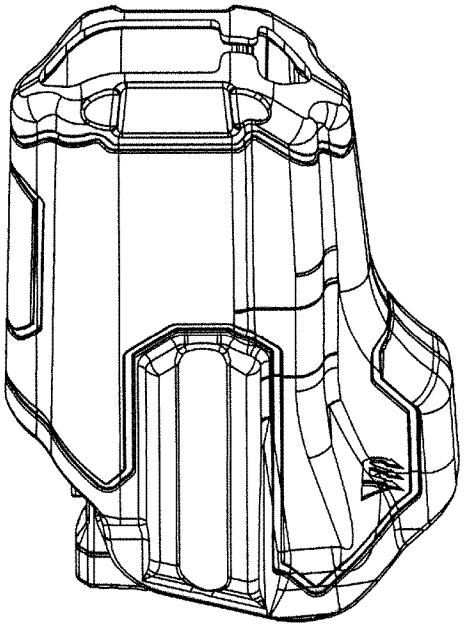
Figure 24E:
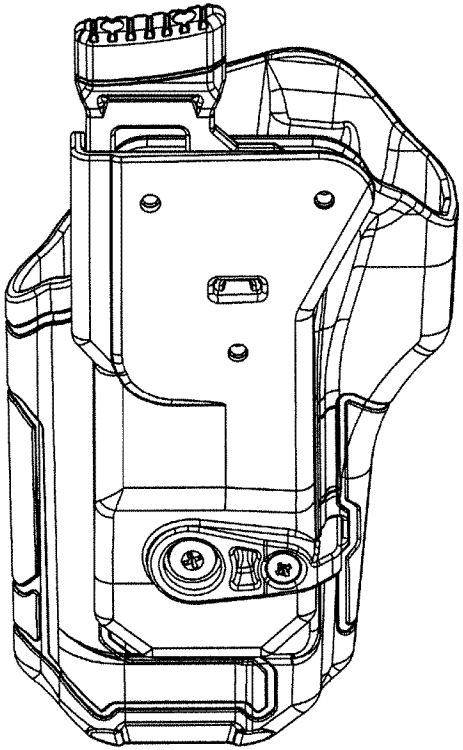

FIGS. 24 through 24F are perspective views showing the holster assembly 582 described above. Forward and starboard facing sides of the holster assembly 582 are visible in FIG. 24. Forward and portward facing sides of the holster assembly 582 are visible in FIG. 24. Rearward and portward facing sides of the holster assembly 582 are visible in FIG. 24C. Rearward and starboard facing sides of the holster assembly 582 are visible in FIG. 24D. Upward and portward facing sides of the holster assembly 582 are visible in FIG. 24E. Downward and starboard facing sides of the holster assembly 582 are visible in FIG. 24F.

Referring to FIGS. 19A through 24F, a holster assembly 582 including a holster 502 with a retention mechanism 560 is depicted. In an embodiment, a holster assembly 582 is configured for receiving and releasably retaining differently configured handguns, each of the differently configured handguns having a mounting rail positioned below barrels of the differently configured handgun. The holster assembly 582 comprises an accessory configured to be fixed to the mounting rail of the differently configured handguns. The accessory has a body with an upper clamp sized to grip the mounting rail, the upper clamp having a pair of shoulders, and each shoulder having an upwardly facing surface. The body further having a lower most downwardly facing surface below the shoulders. The holster assembly 582 further including a holster body 548 having a forward end and a rearward end, the holster body 548 comprising a pair of opposing side wall portions 520, 522 defining a cavity 508 with an open rearward end. The holster body 548 having a handgun receiving and withdrawal axis extending forwardly and rearwardly. The holster body 548 further having a pair of opposing ribs projecting inwardly from each of the opposing side wall portions 520, 522. The ribs extending forwardly and rearwardly and defining a lower accessory receiving pocket in the cavity 508. The lower accessory receiving pocket being sized for a conforming fit with the accessory including engagement of the holster body 548 with the pair of shoulders with the pair of ribs. The holster assembly 582 further including a cover 555 attached to one of the opposing side wall portions 520, 522, the cover 555 defining a chamber 514 having an opening that is covered by the one of the opposing side wall portions 520, 522. The holster assembly 582 further including a retention mechanism 560 supported by the wall of the holster body 548. The retention mechanism 560 comprising an elongate spring member 564 disposed inside the chamber 514 defined by the cover 555. The elongate spring member 564 extending rearwardly and having a blocking portion 562 at the rearward end of the elongate spring member 564. The blocking portion 562 swingable in a direction transverse to the handgun receiving and withdrawal axis between a blocking position and a non-blocking position with respect to the accessory such that when the accessory is mounted on one of the differently configured handguns the accessory and handgun attached thereto is retained in the accessory receiving pocket when the blocking portion 562 is in the blocking position and the accessory and handgun attached thereto may be withdrawn from accessory receiving pocket when the blocking portion 562 is in the non-blocking position. The blocking portion 562 being biased toward the blocking position and engageable with the accessory at one of the pair of shoulders of the accessory. The elongate spring member 564 and blocking portion 562 being movable rearwardly with respect to the holster body 548 when a holstered accessory and handgun attached thereto is moved rearwardly in a withdrawal motion with respect to the holster body 548 and the blocking portion 562 is in the blocking position whereby a rearward face of the blocking portion 562 engages a portion of the holster body 548 to at least inhibit the blocking portion 562 from moving to the non-blocking position thereby retaining the handgun in the holster.

In an embodiment, the retention mechanism 560 of the holster assembly 582 further comprises a thumb actuated release actuation mechanism including an elongate sliding member 566 extending along an exterior surface of one of the side wall portions. The elongate member having opposing ends with a thumb receiving portion at a rearward end thereof and having a protrusion that engages structure on the elongate spring member 564 positioned intermediate a forward end and the rearward end. In an embodiment, the protrusion and structure are configured to produce cantilevered bending of the elongate spring member 564 when the elongate member is slid forwardly and the blocking member is unconstrained thereby moving the blocking member in a direction outwardly with respect to the holster body 548 from the blocking position to the non-blocking position. In an embodiment elongate sliding member 566 engages the elongate spring member 564 forwardly of the blocking portion 562 and when the handgun is moved rearwardly in a withdrawal motion with respect to the holster body 548 and the blocking portion 562 is in the blocking position depressing of the thumb receiving portion causes a bowing of the elongate spring member 564 while retaining the blocking portion 562 in the blocking position.

Referring still to FIGS. 19A through 24F, in an embodiment, the holster assembly 582 is configured for receiving a handgun having a forward rail below the barrel with an accessory secured thereto. The holster assembly 582 comprising a holster body 548 having a pair of opposing side wall portions 520, 522 defining an interior with an upper first cavity portion and a lower second cavity portion. In an embodiment, the first cavity portion is sized to receive a slide of the handgun and the second cavity portion is dimensioned to form fit the particular form of the accessory secured to the mounting rail of the handgun. In an embodiment, each of the first and second cavities are open at a rearward end for receiving and withdrawing the handgun and attached accessory in a forward and rearward direction. The holster assembly 582 further including a cover 555 attached to one of the opposing side wall portions 520, 522. The cover 555 defining a chamber 514 having an opening that is covered by the one of the opposing side wall portions 520, 522. The holster assembly 582 further including a retention mechanism 560 supported by the wall of the holster body 548. The retention mechanism 560 comprising an elongate spring member 564 disposed inside the chamber 514 defined by the cover 555. The elongate spring member 564 being secured with respect to the one of the opposing side wall portions 520, 522 at a first end thereof and the elongate spring member 564 extending rearwardly along an exterior surface of the one of the opposing side wall portions 520, 522. The second end of the elongate spring member 564 being fixed to a blocking portion 562. The blocking portion 562 being positioned at a aperture in the one of the opposing side wall portions 520, 522 and movable between a blocking position and a non-blocking position with respect to the accessory when the accessory is in the second cavity portion. The retention mechanism 560 further comprising an elongate sliding member 566 extending along an exterior surface of the one of the side wall portions and slidable therealong. A first portion of the elongate member extending into the chamber 514 defined by the cover 555. The first portion of the elongate member being sandwiched between the cover 555 and the one of the side wall portions. The elongate member having opposing ends with a thumb receiving portion at a rearward end thereof and a protrusion that engages structure on the elongate spring member 564 positioned intermediate a forward end and the rearward end. The protrusion and structure producing cantilevered bending of the elongate spring member 564 when the elongate member is slid forwardly thereby moving the blocking member in a direction outwardly with respect to the holster body 548 from the blocking position to the non-blocking position.

Referring still to FIGS. 19A through 24F, in an embodiment, the holster assembly 582 is configured for receiving and releasably retaining differently configured handguns, each of the differently configured handgun having a mounting rail positioned below a barrel of the differently configured handgun with a predetermined accessory attached to the rail. The accessory having a vertical distance from the bottom surface of the accessory to the top surface of a pair of clamp portions. The holster assembly 582 comprising a holster body 548 having a forward end and a rearward end. The holster body 548 comprising a pair of opposing side wall portions 520, 522 defining an interior with an open rearward end. The holster body 548 having a handgun receiving and withdrawal axis extending forwardly and rearwardly. The holster body 548 further having a pair of opposing ribs extending linearly forwardly and backwardly and projecting inwardly from each of the opposing side wall portions 520, 522. The ribs being spaced from an upwardly facing bottom surface of the holster body 548 a distance substantially equal to the vertical distance so that the pair of opposing side walls and the ribs defining a lower accessory receiving pocket in the interior. The holster assembly 582 further comprising a cover 555 attached to one of the opposing side wall portions 520, 522. The cover 555 defining a chamber 514 having an opening that is covered by the one of the opposing side wall portions 520, 522. The holster assembly 582 further comprising a retention mechanism 560 supported by the wall of the holster body 548.

The retention mechanism 560 comprising an elongate spring member 564 connecting to a blocking portion 562. The elongate spring member 564 being disposed in the chamber 514 defined by the cover 555. The blocking portion 562 movable in a direction transverse to the handgun receiving and withdrawal axis between a blocking position and a non-blocking position with respect to the accessory such that when the accessory is mounted on one of the differently configured handguns the accessory and handgun attached thereto is retained in the accessory receiving pocket when the blocking portion 562 is in the blocking position and the accessory and handgun attached thereto may be withdrawn from accessory receiving pocket when the blocking portion 562 is in the non-blocking position, the blocking portion 562 biased toward the blocking position. The retention mechanism 560 further comprising a thumb actuated release actuation mechanism. The thumb actuated release actuation mechanism comprising an elongate member extending into the chamber 514 defined by the cover 555. The elongate member being slidably supported by the cover 555 and the one of the opposing side wall portions 520, 522. The elongate member having opposing ends with a thumb receiving portion at a rearward end thereof and having a protrusion that engages structure on the elongate spring member 564 positioned intermediate a forward end and the rearward end. The protrusion and the structure producing cantilevered bending of the elongate spring member 564 when the elongate member is slid forwardly thereby moving the blocking member in a direction outwardly with respect to the holster body 548 from the blocking position to the non-blocking position.

The holster body and other parts of the holster system may be formed of injection molded polymers or composite construction. Generally the holster body and other parts of the holster system will be rigid materials with some resilience. Polyamides (e.g., nylon), polyethylenes, polyurethanes, and epoxies, may be suitable for example; such may be reinforced with glass, carbon or other fiber materials. Other materials may also be suitable, for example, some components could be formed from a metallic material or a composite construction-polymer and metal.

The following United States patents are hereby incorporated by reference herein in accordance with MPEP 2163.07 (B) include: U.S. Pat. Nos. 5,918,784, 6,112,962, 6,267,279, 6,547,111, 6,641,009, 7,937,880, 7,434,712, 7,461,765, 7,556,181, 7,694,860, 7,841,497, 7,954,971, 8,132,355, 8,177,108, 8,235,263, 8,474,670, 8,517,235, 8,690,032, 8,720,755, 8,985,412, 9,057,579, 9,057,580, and 9,134,093. Components illustrated in such patents may be utilized with embodiments herein.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A holster, handgun, and accessory combination, the accessory attached to a rail of the handgun, the rail positioned below the barrel of the handgun, the holster comprising a pair of side wall portions formed of a polymer and being unitary with one another and joined at a top and bottom of the side wall portions, the side wall portions defining a slot configured for capturing and engaging the accessory when the handgun with accessory is inserted into the holster, the holster and accessory engagement constraining all freedom of motion of the accessory except freedom of motion in the insertion and withdrawal direction along a forward rearward axis of the handgun, the holster further providing a stop portion whereby the accessory seats in the slot as the accessory abuts the stop portion, wherein when the accessory is seated in the slot abutting the stop portion, the only freedom of motion of the accessory with respect to the slot is a linear withdrawal motion, the holster further comprising a spring member configured as a leaf spring, the leaf spring movable between an accessory blocking position and an accessory non-blocking position, the leaf spring deflectable to the non-blocking position by engagement with the accessory upon insertion of the handgun and accessory into the holster, as the handgun and accessory are seated in the holster the spring member returns to the blocking position with a blocking portion of the spring member blocking the handgun from withdrawal thereby restricting movement of the seated handgun and accessory with respect to the holster.

2. The holster, handgun, accessory combination of claim 1, wherein the holster is configured to receive differently configured handguns, each of the handguns having a rail for attachment of the accessory.

3. The holster, handgun, accessory combination of claim 1, wherein the accessory is a dummy accessory and is non-functional except as an interface with the holster;

wherein the accessory having a maximum height dimension, and wherein the accessory maximum height dimension is less than the height of the forward barrel, slide, rail portion of the handgun to which it is attached.

4. The holster, handgun, accessory combination of claim 1, wherein the accessory maximum height dimension is less than 30% of the height of a forward barrel, slide, rail portion of the handgun to which it is attached.

5. The holster, handgun, accessory combination of claim 1, wherein the accessory having a maximum height dimension, and wherein the accessory maximum height dimension is 30% or less than the height of the trigger guard of the handgun to which it is attached.

6. The holster, handgun, accessory combination of claim 1, wherein the spring member is slidingly attached to the one of the sidewall portions providing a forward-rearward travel of less than 0.425 inches of the spring member and blocking portion with respect to the holster body.

7. The holster, handgun, accessory combination of claim 1, wherein the accessory has a width measured in a side to side direction and said width is not greater than the width of the handgun.

8. A holster system for receiving a handgun having a forward rail below the barrel with an accessory secured thereto, the accessory having a particular form, the holster system comprising:

a holster body having a pair of opposing side wall portions defining an interior with an upper first cavity portion and a lower second cavity portion, the first cavity portion sized to receive a slide of the handgun and the second cavity portion being dimensioned to form fit the particular form of the accessory, each of the first and second cavities open at a rearward end for receiving and withdrawing the handgun and attached accessory in a forward and rearward direction;

a cover attached to one of the opposing sidewall portions, the cover defining a chamber having an opening that is covered by the one of the opposing sidewall portions;

a retention mechanism supported by the wall of the holster body, the retention mechanism comprising a spring member disposed in the chamber defined by the cover, the spring member being secured with respect to the one of the opposing sidewall portions at a first end thereof, the spring member extending rearwardly along an exterior surface of the one of the opposing sidewall portions, the second end of the spring member fixed to a blocking portion, the blocking portion positioned at a aperture in the one of the opposing sidewall portions and movable between a blocking position and a non-blocking position with respect to the accessory when the accessory is in the second cavity portion;

the retention mechanism further comprising an elongate sliding member extending along an exterior surface of the one of the side wall portions and slidable therealong, a first portion of the elongate member extending into the chamber defined by the cover, the first portion of the elongate member being sandwiched between the cover and the one of the side wall portions; the elongate member having opposing ends with a thumb receiving portion at a rearward end thereof and a protrusion that engages structure on the spring member positioned intermediate a forward end and the rearward end, the protrusion and structure producing cantilevered bending of the spring member when the elongate member is slid forwardly thereby moving the blocking member in a direction outwardly with respect to the holster body from the blocking position to the non-blocking position.

9. The holster system of claim 8, wherein the aperture is sized to the blocking member, the blocking member extending into the interior of the holster body at said aperture when in the blocking position, the blocking member movable outwardly with respect to the holster body at said aperture from the blocking position to the non-blocking position.

10. The holster system of claim 8, wherein the blocking member has a forward facing face and a rearward facing face, the rearward facing face having a ramp surface for engagement of the accessory when the firearm and attached accessory is inserted into the holster for deflecting the blocking member outwardly allowing insertion of the firearm and accessory.

11. The holster system of claim 10, wherein the rearward facing face wherein the blocking member has a freedom of movement in the forward and rearward direction and the forward and rearward movement is less than 0.125 inches, and wherein the rearward facing face has a rearward facing holding surface that is angled with respect to an interior facing surface of the one of the opposing sidewalls providing an angle measured rearwardly, between the interior facing surface and the rearward facing holding surface of less than 90 degrees, wherein when the handgun and accessory are pulled rearwardly with the blocking member in the blocking position, the blocking member moves rearwardly and the rearwardly facing holding surface engages an aperture edge surface thereby holding the blocking portion in the blocking position.

12. The holster system of claim 8, in combination with a handgun having a rail in conformance with Military Standard Mil-std-1913 dated 3 Feb. 1995, and an accessory attached to the rail, the handgun and accessory holstered in the holster.

13. The combination of claim 12, wherein the lower cavity is form fit to the accessory and the upper cavity is spaced from the handgun.

14. The combination of claim 13, wherein the lower cavity is form fit to the accessory and the upper cavity is spaced from the handgun, the holster body having opposing side walls with each side wall having a forwardly and rearwardly extending rib, the ribs engaging the accessory at shoulders on clamp portions of the accessory.

15. A holster for receiving a handgun and a dummy-accessory attached to the handgun, the holster comprising:

a holster body comprising a wall defining an interior cavity, the wall of the holster body including a port side wall portion and a starboard side wall portion, the cavity extending in a forward direction from a rearward end of the holster body to the forward end of the holster body and extending in a rearward direction from the forward end of the holster body to the rearward end of the holster body;

a retention mechanism supported by the wall of the holster body, the retention mechanism comprising a spring member, the spring member being secured with respect to the wall at a first end thereof, the spring member extending rearwardly along an exterior surface of the wall, the second end of the spring member fixed to a blocking portion, the blocking portion positioned proximate an aperture defined by the wall and movable between a blocking position and a non-blocking position with respect to the dummy-accessory when the dummy-accessory is disposed in the interior cavity defined by the wall;

the retention mechanism further comprising an elongate sliding member extending along an exterior surface of the wall and slidable therealong, the elongate member having opposing ends with a thumb receiving portion at a rearward end thereof and a protrusion that engages structure on the spring member positioned intermediate a forward end and the rearward end of the spring member.

16. The holster of claim 15, wherein the blocking portion is configured so that the holster body applies a reactionary force to the blocking portion while rearward or pulling force are applied to cause rearward translation of the blocking portion, the reaction force and the rearward or pulling force acting to fix the position of the blocking portion.

17. The holster of claim 15, wherein:

while the holster body is applying the reaction force to the blocking portion, the protrusion and structure produces bowing of the spring member when the elongate member is slid forwardly; and while the holster body is not applying the reaction force to the blocking portion, the protrusion and structure produces cantilevered bending of the spring member when the elongate member is slid forwardly thereby moving the blocking member in an outward direction with respect to the holster body from the blocking position to the non-blocking position.

18. The holster of claim 17, wherein the outward direction is a portward direction that is generally perpendicular to the forward and rearward directions.

19. The holster of claim 17, wherein the outward direction is a starboard direction that is generally perpendicular to the forward and rearward directions.

20. The holster of claim 15 wherein the elongate sliding member extends between an exterior surface of the one of the side wall portions and a belt or strap connector fixed to the one of the side wall portions.

* * * * *